United States Patent [19]

DeWitt

[11] Patent Number: 5,054,700

[45] Date of Patent: Oct. 8, 1991

[54] APPARATUS FOR THE AUTOMATED PROCESSING OF BULK MAIL AND THE LIKE

[75] Inventor: Robert R. DeWitt, Marlton, N.J.

[73] Assignee: Opex Corporation, Moorestown, N.J.

[21] Appl. No.: 363,605

[22] Filed: Jun. 8, 1989

Related U.S. Application Data

[62] Division of Ser. No. 904,966, Sep. 5, 1986, Pat. No. 4,863,037.

[51] Int. Cl.[5] ..... B02C 19/00

[52] U.S. Cl. ..... 241/101.4; 53/381.3; 53/381.5; 53/381.6; 83/35; 83/404; 83/407; 83/418; 83/421; 83/430; 83/912; 414/412

[58] Field of Search ..... 53/381 R, 381.3, 381.5, 53/381.6; 83/912, 35, 106, 404, 407, 418, 421, 430; 209/3.1, 900; 241/101.4; 414/412

[56] References Cited

U.S. PATENT DOCUMENTS

| | | | |
|---|---|---|---|
| 3,266,626 | 8/1966 | Simjian | 209/545 |
| 3,381,564 | 5/1968 | Whiteford | 83/912 X |
| 3,384,252 | 5/1968 | West | 414/412 |
| 3,808,926 | 5/1974 | Osland | 83/912 X |
| 4,124,169 | 11/1978 | Hatanaka | 241/101.4 |
| 4,142,430 | 3/1979 | Long et al. | 83/912 X |
| 4,863,037 | 9/1989 | Stevens et al. | 209/3.1 |
| 4,893,454 | 1/1990 | Russell | 53/381.3 X |

*Primary Examiner*—Michael S. Huppert
*Assistant Examiner*—Edward M. Wacyra
*Attorney, Agent, or Firm*—Weiser & Stapler

[57] ABSTRACT

An apparatus for severing envelope edges in continuous fashion comprises a plurality of devices for severing an envelope edge and a conveyor mechanism for carrying envelopes past the plurality of severing devices, and for rotating the envelopes to present envelope edges to the plurality of severing devices in orientations which permit the edge-severing of each presented envelope edge. Also a severing device for use in connection with the severing apparatus.

29 Claims, 40 Drawing Sheets

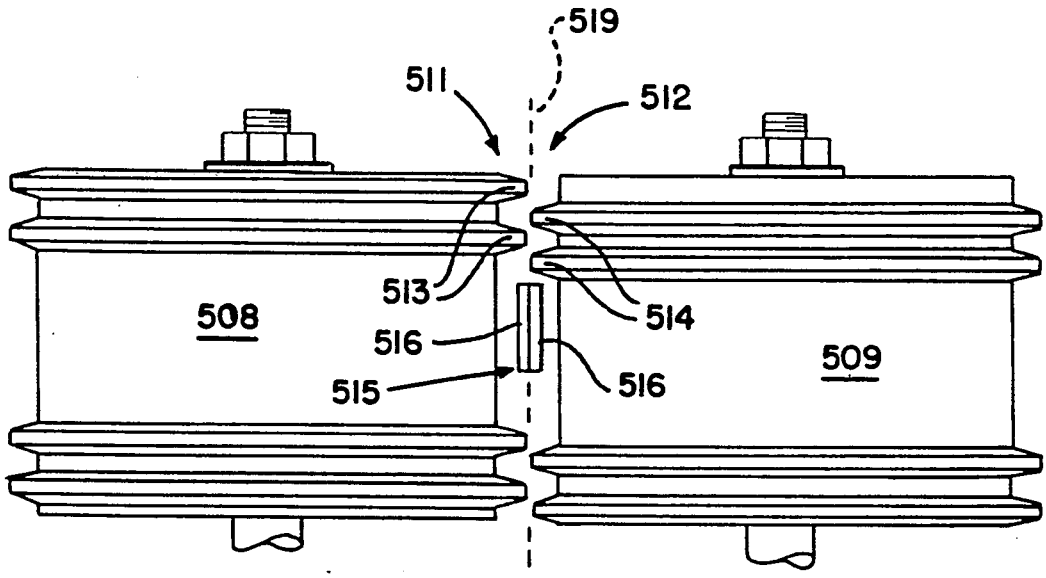
FIG. 29
FIG. 30
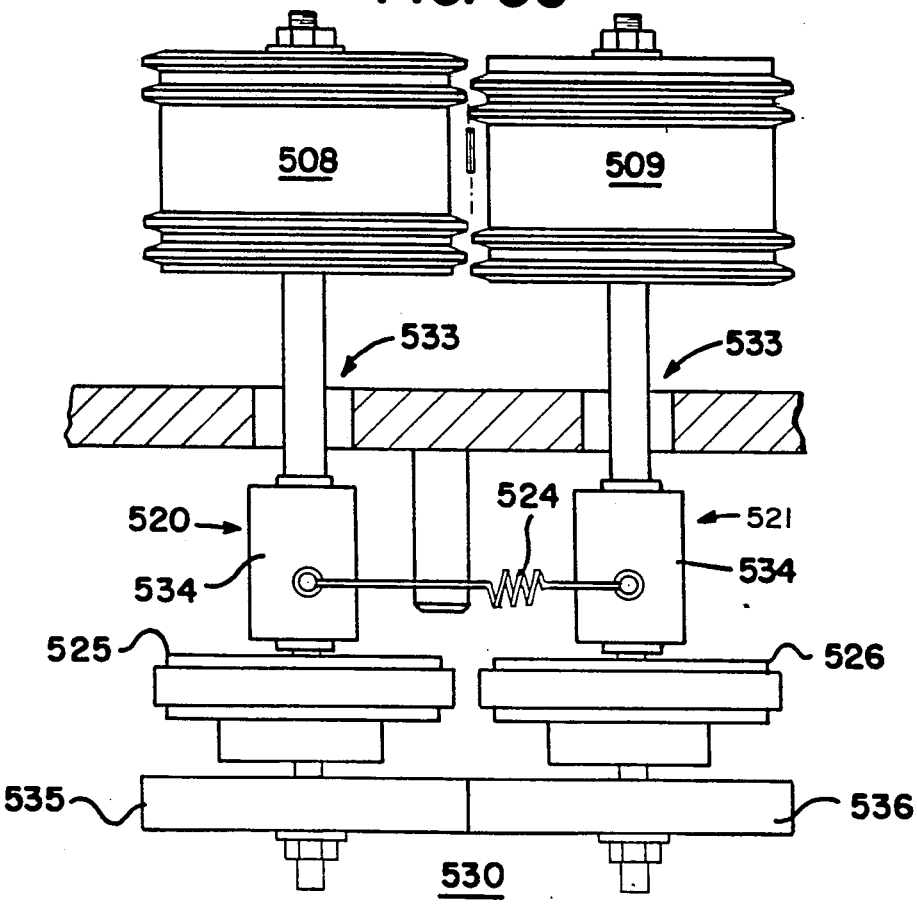

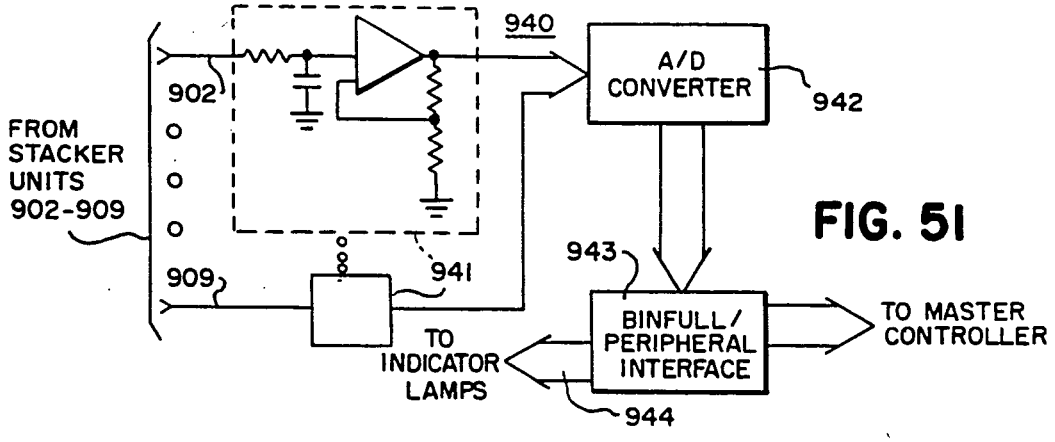
FIG. 51
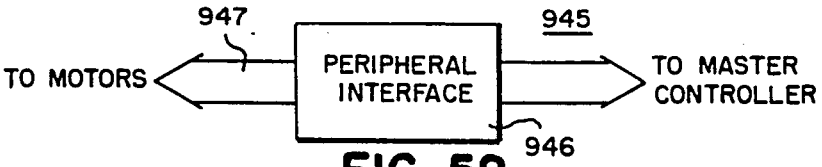
FIG. 52
FIG. 54
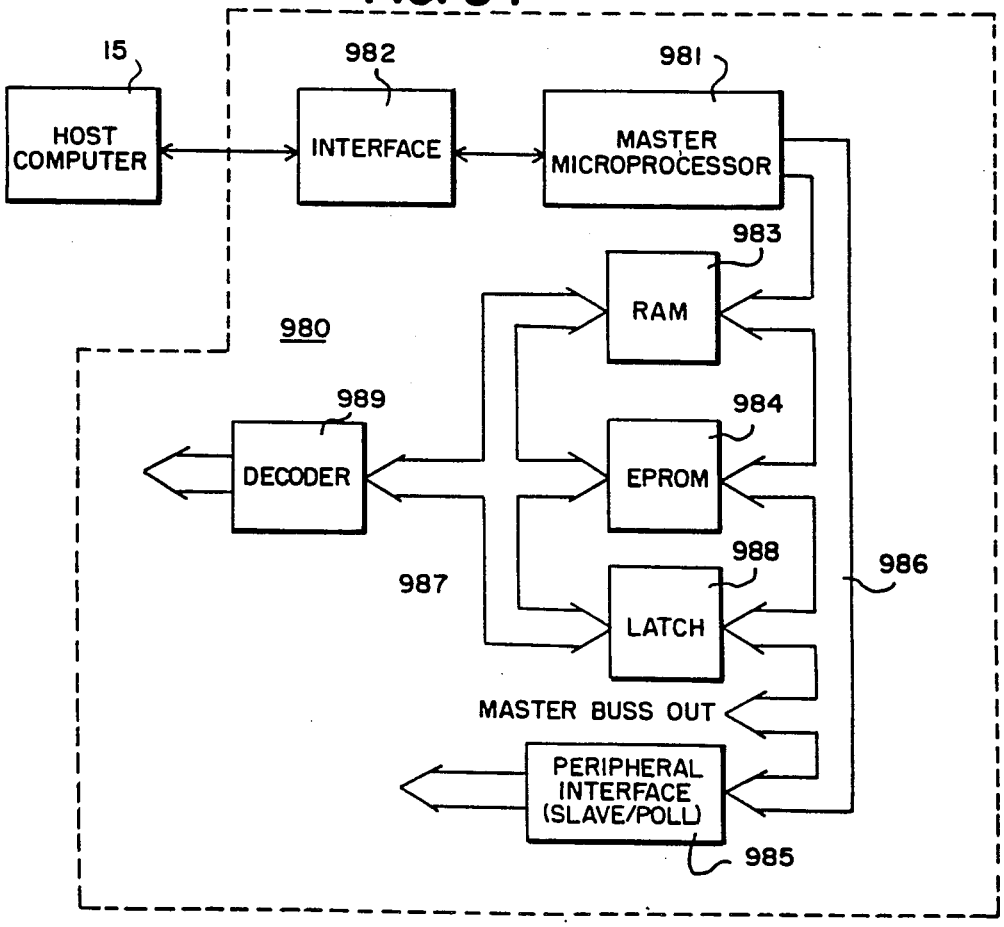

APPARATUS FOR THE AUTOMATED PROCESSING OF BULK MAIL AND THE LIKE

RELATED CASE

This is a divisional of U.S. patent application Ser. No. 06/904,966, filed Sept. 5, 1986, now U.S. Pat. No. 4,863,037.

MICROFICHE APPENDIX

A microfiche appendix containing a total of 4 sheets including 360 frames may be found in U.S. patent application Ser. No. 06/904,966, filed Sept. 5, 1986, and is incorporated by reference herein.

BACKGROUND OF THE INVENTION

The present invention relates generally to the bulk processing of mail and the like, and in particular, to the opening of bulk mail in automated fashion.

A variety of organizations customarily receive mail in large quantities and in bulk form. Accordingly, a number of devices have been developed to facilitate the handling of such mail so as to enhance productivity. To this end, a variety of different devices have been developed to facilitate the handling of mail at various stages of the mail room operation. Stackers have been developed to organize received envelopes for presentation to subsequent stages of the mail extraction process. Sorters have been developed to out-sort envelopes which do not conform to specified standards, or to identify envelopes which are particularly desirable for priority or expedited processing. Slitters have been developed to open the envelopes, generally along one or more edges. Extractors have been developed to operate upon the slit envelopes to separate the faces of the envelopes and expose their contents, for extraction by an operator. Candlers have been developed to scan the envelopes which have proceeded through the extraction process to verify that all have been developed to assist in the above-described operations, and to provide other functions which complement a complete mail room operation.

Such devices have greatly facilitated mail room operations, which were traditionally slow and laborious in nature, by significantly reducing the amount of time and labor required to extract contents from received mail. However, these improvements have been achieved at the expense of requiring numerous separate pieces of equipment to perform the various functions required to take received bulk mail, and remove its contents for subsequent processing. Although it has been possible to combine some of the above-described functions in a single apparatus, it has generally remained necessary to proceed through multiple, discrete mail extraction operations, as distinguished from a single automated procedure.

As a consequence of this, while labor requirements have been significantly reduced by such equipment, the mail extraction operation still remains relatively labor intensive in that numerous support personnel are required to service and operate the various devices used in the mail extraction operation, and to direct articles of mail between the various devices used for mail extraction once each device has completed its individual task. Also as a consequence of such multiple, discrete operations, the overall mail extraction operation must be routed in some manner, leading to the potential for inefficient routing in the event that the available devices or the available floor plan do not lend themselves to maximum efficiency, and leading to the potential for quantities of received mail to remain unopened for excessive periods of time while awaiting further processing on the next processing device.

The matter of efficiency becomes particularly important when it is desired to process bulk mail for the extraction of invoices and accompanying payments (checks), since delays in processing can cause resulting delays in the deposit of such payments, which is clearly undesirable.

It has therefore remained desirable to develop a fully automated extraction apparatus which is capable of removing the contents from bulk mail in a single operation, eliminating the need for separate handling and its attendant disadvantages.

SUMMARY OF THE INVENTION

It is therefore a primary object of the present invention to provide an apparatus for the automated processing of bulk mail and the like.

It is also an object of the present invention to provide an apparatus for the bulk processing of mail which requires a minimum of intervention by an operator.

It is also an object of the present invention to provide an automated mail processing apparatus which is sufficiently versatile to handle different envelope configurations, as well as differences in desired contents to be processed, or rejected.

It is also an object of the present invention to provide an automated mail processing apparatus which is compatible with conventional mail room operations, including processing steps which are subsequent to mail extraction.

It is also an object of the present invention to provide an automated mail processing apparatus which is straightforward in operation, and relatively simple to service and use.

These and other objects are achieved in accordance with the present invention by providing an apparatus for the automated processing of bulk mail such that mail may be transferred to the apparatus in bulk fashion from incoming mail trays, for delivery to an output location in sorted fashion, in a continuous and automatic procedure. To this end, a mail extraction device is provided which incorporates a number of operating stations which serve to accomplish the various aspects of mail extraction, and which are operatively associated with one another to serially process incoming mail in continuous fashion. These operating stations are additionally operatively associated with one another to accommodate irregularities in the mail being processed, such as irregular contents (staples, paper clips, oversized or undersized, etc.), as well as irregularities in the orientation of contents within the envelopes due to the random insertion of contents in the envelopes at their source of origination.

To this end, an apparatus is provided which includes an operative combination of processing stations including an input station for receiving incoming mail in bulk fashion and for separating (singulating) the pieces of mail for individual delivery to the remainder of the apparatus; a station for detecting irregularities in the contents of the envelopes, such as metal items, folded contents, or oversized items; a station for out-sorting envelopes rejected in accordance with the determinations made at the detection station; a station for slitting the envelopes, preferably along multiple edges; a station for removing the contents from the severed envelopes, for subsequent processing of the contents; and a series of stations for handling and orienting the contents for subsequent delivery to a plurality of output stackers. These latter stations for handling and orienting contents may relate to various processing steps such as the separation (singulation) of plural contents extracted from the envelopes; justification of the contents for subsequent processing; detection of the type and orientation of the contents; and orientation of the contents for delivery from the apparatus in uniform fashion, as described for a particular operation. These various stations are operated by a common drive system which is operatively connected to the various stations by means of appropriate clutches or the like to achieve interactive operation of the apparatus during normal operating conditions, while enabling decoupling of one or more of the several operations in the event that irregular operating conditions are encountered.

The various functions of the apparatus, and the various stations which comprise the apparatus, are centrally controlled by microprocessor means which receive signals from the various stations of the apparatus, and which develop signals for processing mail as previously described in accordance with desired, selected parameters. Centralized microprocessor control also enables the apparatus to be adjusted for the processing of different types of mail, and desired contents, in a simple and straightforward manner since the operational parameters for any of a number of different mail extraction operations may be stored and selected by an operator, depending upon the nature of the mail which is to be processed. Moreover, such centralized operation, as well as the convenient and appropriate placement of the input and output portions of the apparatus (including rejection operations), enables the apparatus to be operated by a significantly reduced number of personnel, generally only a single centrally positioned operator.

For further detail regarding a preferred embodiment apparatus in accordance with the present invention, reference is made to the detailed description which is provided below, in connection with the following illustrations.

BRIEF DESCRIPTION OF THE DRAWINGS

FIG. 29 is a partial, end elevational view of the drums of the separation device. FIGS. 30–32 are end elevational views showing alternative embodiment follower mechanisms for regulating positioning of the drums of the separation device.

FIG. 51 is a schematic diagram showing a circuit for controlling operation of the stacking station.

FIG. 52 is a schematic diagram showing a circuit for controlling the various motors which operate the several stations of the mail processing apparatus.

FIG. 54 is a schematic diagram showing a circuit for receiving signals from, and interfacing with the various circuits of the apparatus, for master control of the apparatus.

In the several views provided, like reference numerals denote similar structure.

DETAILED DESCRIPTION OF THE PREFERRED EMBODIMENT

Figure 1:
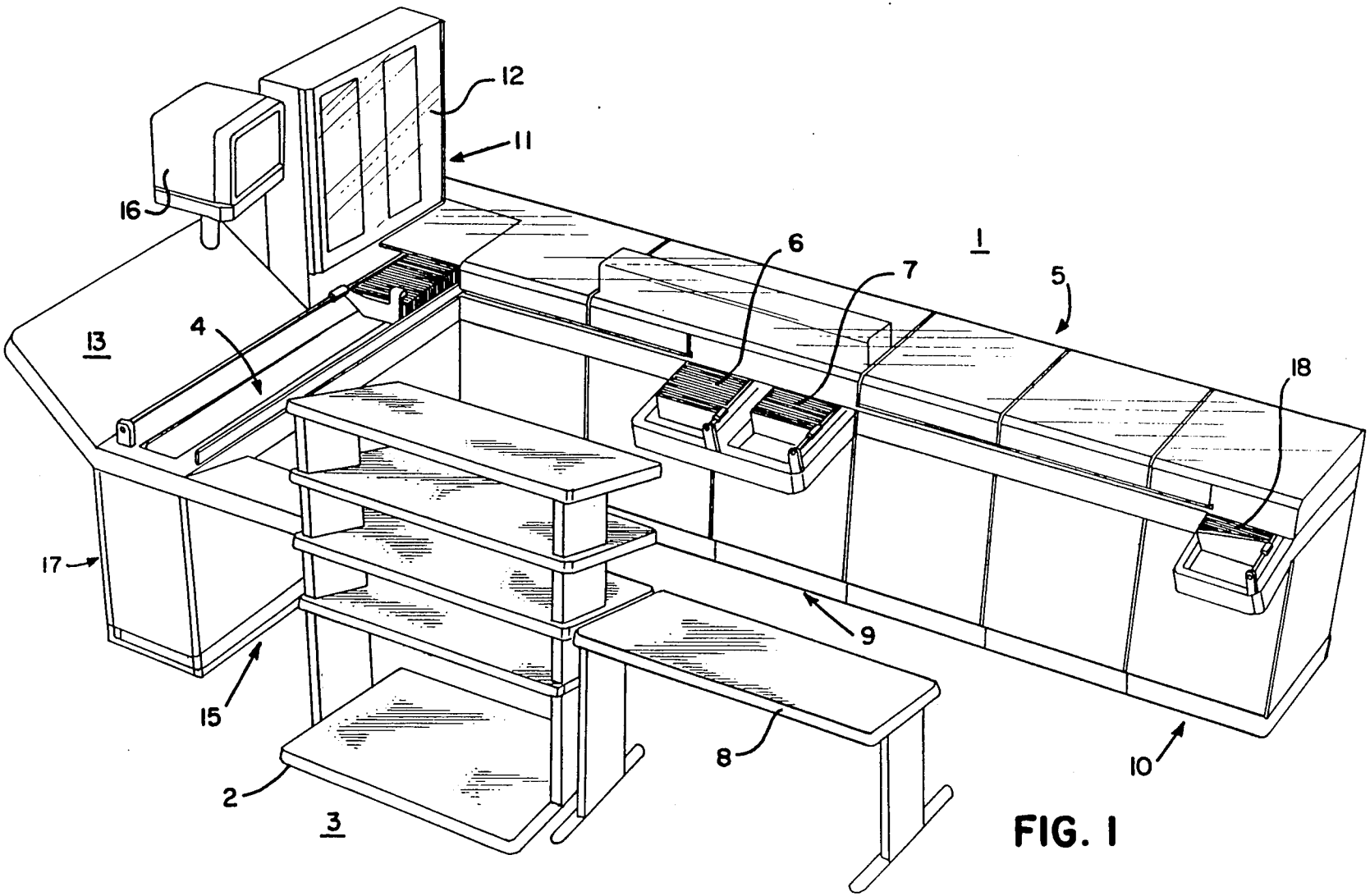
FIG. 1 is an isometric view of an automated mail processing apparatus in accordance with the present invention.

Although specific forms of the invention have been selected for illustration in the drawings, and the following description is drawn in specific terms for the purpose of describing these forms of the invention, this description is not intended to limit the scope of the invention which is defined in the appended claims.

Figure 2:
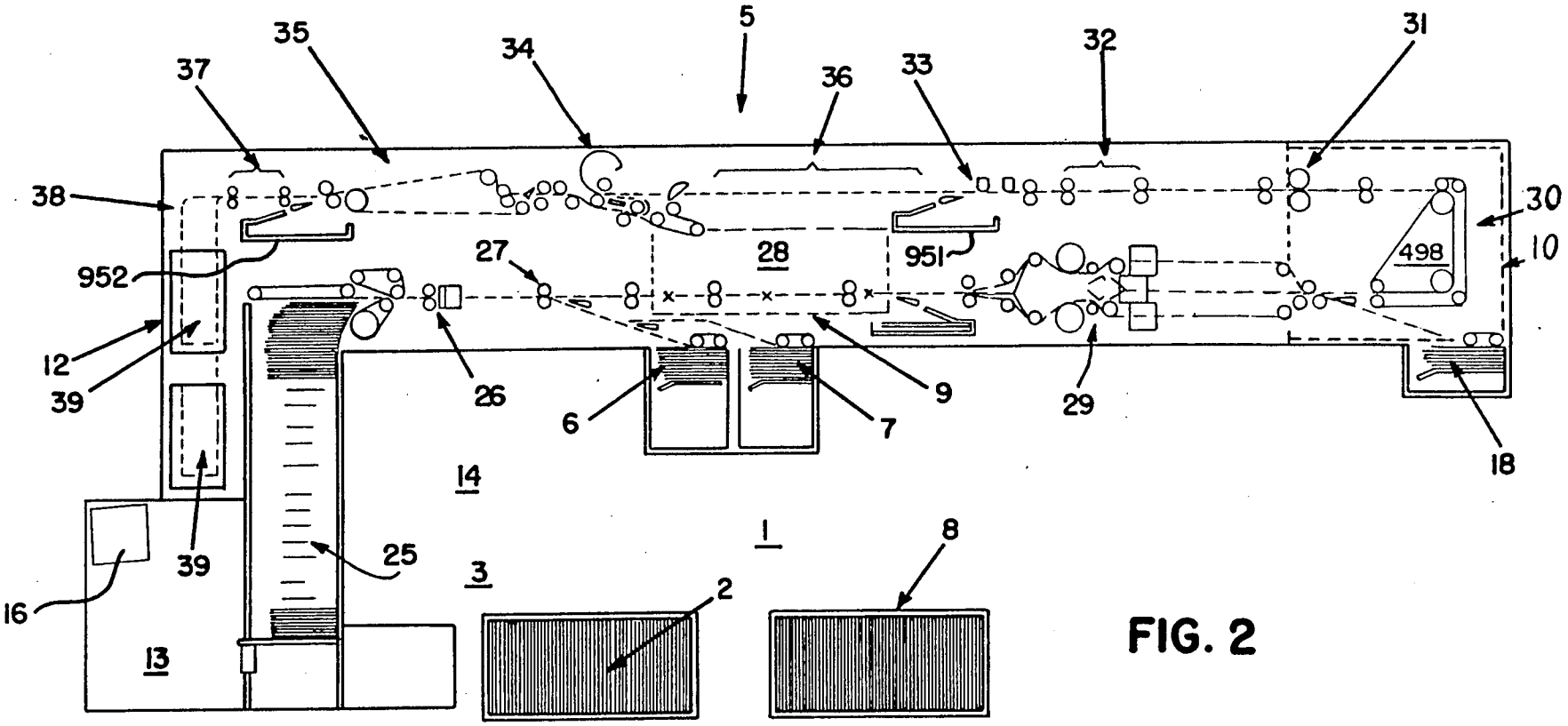
FIG. 2 is a schematic, plan view of the apparatus of FIG. 1, showing the general location of the various stations of the apparatus.

FIGS. 1 and 2 show an overview of a preferred embodiment automated mail processing apparatus 1 in accordance with the present invention. Transactionally, bulk mail to be processed is delivered to the apparatus 1 on carts 2 which are locatable, for example, at the off-load position 3 such that incoming mail is capable of being conveniently transferred to the apparatus 1 by an operator. Thus, bulk mail may be taken directly from mail bags or the like, as received in the mail room, and placed in mail trays on the carts 2 such as are conventionally used in the industry, for delivery to the apparatus 1. Envelopes are then taken from the trays, then located on the off-load cart 2, for delivery to an input conveyor 4 which delivers the received envelopes to the processing unit 5.

In the course of processing mail, it is to be expected that certain pieces of mail will have to be rejected for various reasons which will be described more fully below. Rejected envelopes are collectable within a pair of trays 6, 7. The trays 6, 7 are preferably positioned so that rejected mail is conveniently transferable from the trays 6, 7 to a second cart 8 for receiving out-sorted mail, for removal from the apparatus 1 for special processing. Also in the course of processing mail, certain refuse will be generated as a by-product of the extraction operation. For example, the edges of the envelopes which are removed during the envelope edge-severing operation must be collected. Also to be collected are the faces of the severed envelopes which result following the extraction of contents. Such refuse may be collected in one or more trash containers which are conveniently located within access areas 9, 10 positioned along the bottom of the processing unit 5.

Subsequent to the extraction operation as will be described more fully below, documents are serially delivered from the output 11 of the apparatus 1 to a stacking unit 12 which receives the various items extracted from the envelopes in organized fashion. Sorted groupings of extracted contents are then conveniently transferred from the stacking unit 12 to appropriate trays on a stand-by shelf 13, for subsequent pick-up and removal to subsequent operations associated with the particular business involved.

To be noted in connection with the above-described procedure is that all raw mail (both incoming and out-sorted) is handled at one centralized location, adjacent to the sorted output. As a consequence, the transfer of mail between the carts 2, 8 and the automated mail processing apparatus 1, as well as the transfer of extracted contents from the automated mail processing apparatus 1 to the stand-by shelf 13, can be accomplished from a single position, at 14. Accordingly, a single operator stationed at position 14 is capable of transferring incoming mail to the apparatus 1, and of removing both sorted and out-sorted mail from the apparatus 1 for subsequent handling. Moreover, from the position 14, it is even possible for this same operator to periodically empty the trash containers positioned at locations 9, 10, if desired.

Since all of these operations are controllable by a single operator stationed at position 14, a centralized microprocessor control unit 15 is preferably located immediately adjacent to the operator position 14, preferably just beneath the input conveyor 4. A display screen 16 is also positioned immediately adjacent to the operator position 14, preferably at eye level above the input conveyor 4. The display screen 16 is preferably operable responsive to touch, or to a light-pen, in accordance with available technology in the industry to enable communication with the central processing unit 15, which receives the information supplied by the operator and which is capable of processing the information to control the various operations of the mail processing apparatus 1 as will be described more fully below. Thus, the operator is capable of being advised of various status conditions of the apparatus 1 throughout the mail extraction operation, and of controlling the operation of the mail extraction apparatus accordingly. Auditing of the extraction operation is advantageously provided by means of a printer 17 which is operatively associated with the central processing unit 15, and which is locatable beneath the input conveyor 4, or some other appropriate location.

Accordingly, it is seen that the mail processing apparatus 1 is capable of being operated by a single operator, if desired, stationed at position 14. This single operator is capable of controlling the apparatus and monitoring its status conditions via the display screen 16, transferring incoming mail to the apparatus, and withdrawing sorted documents from the apparatus. This same operator is also able to remove out-sorted mail from the apparatus, for subsequent processing by separate means, and to empty the trash containers of refuse. To provide the operator with sufficient time to accomplish these various tasks, the input conveyor 4, the reject trays 6, 7 and the stacking unit 12 are configured to receive a significant quantity of documents, so as to lengthen the duty cycles required to service these stations, and sizable refuse containers are provided to maximize the time between emptying operations. Of course, multiple operators may also be used, if desired.

FIG. 2 schematically illustrates each of the plurality of stations which comprise an automated mail processing apparatus 1 having the above-described capabilities. Functionally speaking, these stations include the following. An input station 25 is provided to receive bulk mail, delivered from the incoming mail cart 2 as previously described. Thus, this station includes the input conveyor 4. This station also includes means for separating the envelopes which comprise this incoming mail, so that envelopes are delivered from the input station 25 in serial fashion, one at a time. The input station 25 communicates with a scanning station 26 which serves to check each of the envelopes which are delivered from the input station 25 for various conditions. Such conditions may include envelopes which contain metal objects such as staples or paper clips, envelopes of an inappropriate length, envelopes which contain folded items which are not appropriately handled in an automated operation, and envelopes which, by virtue of their thickness, are believed to contain items which are not to be processed through the remainder of the apparatus 1.

An important reason for subjecting the envelopes to this scanning operation is that it is often the goal of automated mail extraction operations to isolate and give priority to envelopes which contain invoices representing payments or other transfers of funds. The reason for this is that it is desirable to process such payments through the banking system as soon as possible, rather than waiting for such payments to be processed with other mail of lesser priority. Consequently, it is generally desirable to identify and isolate envelopes which contain only combined invoices and checks for payment. In identifying such envelopes, it is assumed that the configuration for such "desired" envelope contents will be two single sheets, an invoice and a check, and that all other transactions will be represented by contents of different thickness (e.g., other articles requiring special attention such as order forms, special notes, or even returned credit cards or the like).

Also to be considered is that even if an envelope contains an invoice and a check for payment, if these two items are attached together by a staple or a paper clip, such contents will require special handling (separation) and are therefore not appropriately processed through the apparatus 1. Moreover, even if such items were to be automatically separated, such spurious implements could be damaging to the apparatus itself, and therefore should not be processed in the normal course.

The scanning station 26 therefore operates to identify objectionable envelopes, so that a sorting station 27 can operate to out-sort objectionable items responsive to signals received from the scanning station 26. This out-sorted mail is then delivered to the reject trays 6, 7 for removal from the apparatus 1 as previously described. A pair of reject trays 6, 7 are preferably provided either to increase the capacity at this location, or depending upon the capabilities of the sorting station 27, to out-sort different types of objectionable mail to different collection points (e.g., oversized items to the tray 6, and metallic items to the tray 7).

To be noted is that while it is preferred to scan and sort envelopes as the envelopes are received from the input station 25, such functions may be performed at any time prior to the extraction procedure which will be described below. This would include the scanning and sorting of envelopes after edge-severing and prior to extraction, as well as pre-sorting prior to introducing envelopes to the input station 25, if desired for a particular application.

As a consequence of the foregoing operations, envelopes which have not been out-sorted are then presumed to contain only invoices and checks for payment. These items, which are to be immediately processed, are delivered from the sorting station 27 to an edge-severing station 28. Edge-severing station 28 serves to sever edges of the envelopes, preferable plural edges, to ready the envelopes for the extraction of contents. To this end, an extraction station 29 is provided to receive the edge-severed envelopes and to separate the faces of the envelopes from one another, to release the contents which lie between them. If the contents are successfully removed, the envelope faces are then simply discarded, and the contents are passed from the extraction station 29. Otherwise, as will be described more fully below, the envelope faces and contents are re-united, and diverted from the processing path for special attention, at 18.

After the successful extraction of contents, it then becomes necessary to determine the condition of such contents so that the contents may be uniformly operated upon, for delivery to the stacking unit 12 as previously described. To this end, a series of stations are provided for operating upon such contents subsequent to their extraction.

Since those operations prior to extraction, as well as those operations subsequent to extraction, proceed in serial fashion, a turnabout section 30 is preferably provided following the extraction station 29 to reduce the overall length of the processing unit 5. Particularly preferred in this regard is the use of a turnabout section 30 which provides a 180° turn in the envelope processing path so that the stations subsequent to extraction will be positioned adjacent to the stations up to extraction, and so that the output of the apparatus will be adjacent to the input of the apparatus, facilitating the processing of mail by a single operator. While a 180° turnabout following extraction is preferred for these reasons, it is to be understood that all of the operations of the automated mail processing apparatus 1 may proceed in serial fashion, if desired for a particular operation, or may proceed at angles other than 180° should this be desirable for a particular mail room configuration. If desired, the direction of the processing path may be changed at a location other than following extraction, or even at multiple locations. However, such configurations are considered less desirable due to the increased floor space which the automated mail processing apparatus 1 would require.

Prior to operating upon the contents which have been extracted from the envelopes at the extraction station 29, two conditions must first be accommodated. First, the contents which have been withdrawn from the envelopes at the extraction station 29 will presumably be comprised of an invoice and a check for payment, positioned side by side. For the purpose of sorting and stacking, it is desirable for these items to be separated, and for ease of handling, it is preferred that the items be separated so that one of the two items (e.g., the invoice) necessarily precedes the other item (e.g., the check) as such contents proceed along the remainder of the processing path. To this end, the separation station 31 serves to separate the parallel disposed items so that one precedes the other. As the result of such "singulation", the amount of space along the processing path which such contents will occupy essentially doubles. However, as previously described, the various operations of the mail processing apparatus 1 are to proceed continuously and in serial fashion. To account for this imbalance, the separation station 31 includes means for accelerating the extracted and singulated contents (velocity increased by a factor of about 2) to make sure that the singulated contents may be processed in synchronization with the extraction of such contents from their envelopes.

Yet another consideration is that the contents which have been withdrawn from the envelopes at the extraction station 29 will often be askew with respect to one another, and with respect to the surface of the processing unit 5. For example, the articles may be at different heights, or at different angles, due to their original insertion into the envelopes, and due to subsequent handling of the envelopes up to extraction. In further processing the contents, it is important for the contents to be uniformly oriented with respect to a known standard, preferably the surface of the processing unit 5. Accordingly, upon singulation, the extracted contents are delivered to a justification station 32 (at the increased rate), to uniformly orient the documents for subsequent processing.

Most mail processing operations involving the processing of invoices make use of windowed envelopes to assure that the envelopes are correctly addressed. As a result of this, it can be expected that the invoice will be placed in the envelope in a particular orientation. Consequently, upon extraction, the orientation of the invoice will be known. However, no such assurances are available regarding the orientation of the check which accompanies the invoice. The check may be in the same orientation as the invoice, or inverted from this orientation, either facing the invoice or facing away from the invoice. In the banking industry, common practice is to use automated endorsing equipment, which necessarily requires that the checks be uniformly oriented. Consequently, prior to stacking, it is important for the checks to be uniformly oriented, for appropriate presentation to the bank.

The automated mail processing apparatus 1 of the present invention therefore incorporates means for accomplishing such orientation, following the delivery of contents from the justification station 32. To this end, processed documents are first passed through a detection station 33 which is capable of distinguishing invoices from checks, and of determining the orientation of the processed checks. From detection station 33, the documents are then passed through a reversal station 34 and a twisting station 35. As previously indicated, it can be expected that the invoices will be in a known orientation, but that the checks will be randomly oriented and will often require re-orientation for uniform delivery from the apparatus 1. This is accomplished by selectively operating the reversal station 34 and the twisting station 35 in accordance with signals received from the detection station 33. This may include either a front-to-rear inversion of the document in the reversal station 34, a top-to-bottom inversion of the document in the twisting station 35, a combination of these procedures, or neither of these procedures, depending upon the operations which are necessary to pass an invoice through the remainder of the apparatus 1, and to transfer a check from its orientation in the detection station 33 to the orientation which is desired for output from the apparatus 1.

As previously indicated, for applications involving windowed envelopes, such considerations apply primarily to the processed checks, and not to their accompanying invoices. However, for other types of mailings, it may be possible for both the check and the invoice to be randomly oriented within the envelope. For ease of handling, it is equally important for the invoices to be uniformly oriented in their delivery from the apparatus 1. Consequently, a similar detection/re-orientation procedure would be called for in such cases. If so, an additional detection station for determining the orientation of an invoice is advantageously placed in the processing path at 36, following (or if desired preceeding) the detection station 33 which operates upon the checks which accompany such invoices. The reversal station 34 and the twisting station 35 would then serve the added function of re-orienting the invoices in accordance with signals received from the detection station 36, in addition to their functioning to re-orient checks as previously described.

As a result of the foregoing, documents including alternating invoices and checks are uniformly delivered from the twisting station 35, for subsequent collection in the stacking unit 12. Prior to this operation, a justification station 37 is preferably positioned downstream from the twisting station 35, to justify documents which may have become shifted as a result of their being operated upon by the reversal station 34 and the twisting station 35. After justification, a turnabout section 38 is preferably provided to redirect documents from their longitudinal transfer path through the processing unit 5 to a vertical transfer path which delivers such documents to the stacking unit 12, adjacent to the input station 25. Such contents are ultimately received in a stacking station 39, which is preferably positioned immediately adjacent to the input conveyor 4 of the input station 25. Of course, as with the turnabout section 30, the turnabout section 38 may be deleted, or the preferred 90° turning angle may be modified, to develop other processing paths in accordance with the needs of a particular mail room operation. However, as previously mentioned, the above-described turning angles are preferred so that the output of the apparatus 1 is essentially coincident with its input, to enable the apparatus 1 to be serviced by a single operator.

It will therefore be seen that an automated mail processing apparatus 1 comprising the various stations previously described serves to automatically process bulk mail for uniform delivery from the apparatus, so as to enable such contents to be stacked and sorted for subsequent processing. The various stations which comprise the automated mail processing apparatus 1 will now be described in further detail.

In describing the various stations of the automated mail processing apparatus 1, several general considerations have been taken into account. For example, many of the stations which comprise the apparatus 1 make use of driven belts to convey envelopes of extracted documents along a defined transport path. For convenience of description, groupings of belts and pulleys will be identified as "belt systems", which are taken to mean the operative combination of a continuous belt and the various rollers (either driven or passive) which are used to direct the identified belt along its desired path. In connection with such description, it is to be understood that one or more of the rollers which receive the identified belt may be a driven roller, with the remaining rollers constituting idler rollers for completing the desired path. It is further to be understood that the belts used will be flat belts, and may include either a single belt which extends between the identified rollers (either wide or narrow), or plural belts which traverse the rollers at different heights from the base of the processing unit 5. The type of belt system used at a particular location is dependent upon the type of belt system which will adequately support and convey an envelope or document without interfering with adjacent structures. Special considerations for ensuring the proper transport of envelopes or documents will be identified where appropriate.

Further regarding such belt systems, the mating of various belt systems will be described in either of two ways. Belt systems which are said to form a "nip" will involve opposing belt systems which come together to frictionally engage an envelope or a document proceeding along a defined transport path. Belt systems which are said to develop a "containment" will involve opposing belt systems which are slightly spaced from one another to develop a region for slidingly receiving an envelope or a document, while urging the envelope or document along a defined transport path without frictionally engaging the envelope or document.

The resulting nips and containments, as well as the belt systems which define them, are generally shown in the drawings as developing a vertical transport path for the envelopes and documents being conveyed. This orientation is preferred, and the remainder of the specification is drafted in terms of such vertical placements. However, it is to be understood that some, or all of the stations to be described may be positioned in other orientations, including horizontal and angular displacements, in the event that this is desired for a particular application.

INPUT STATION

Figure 3A:
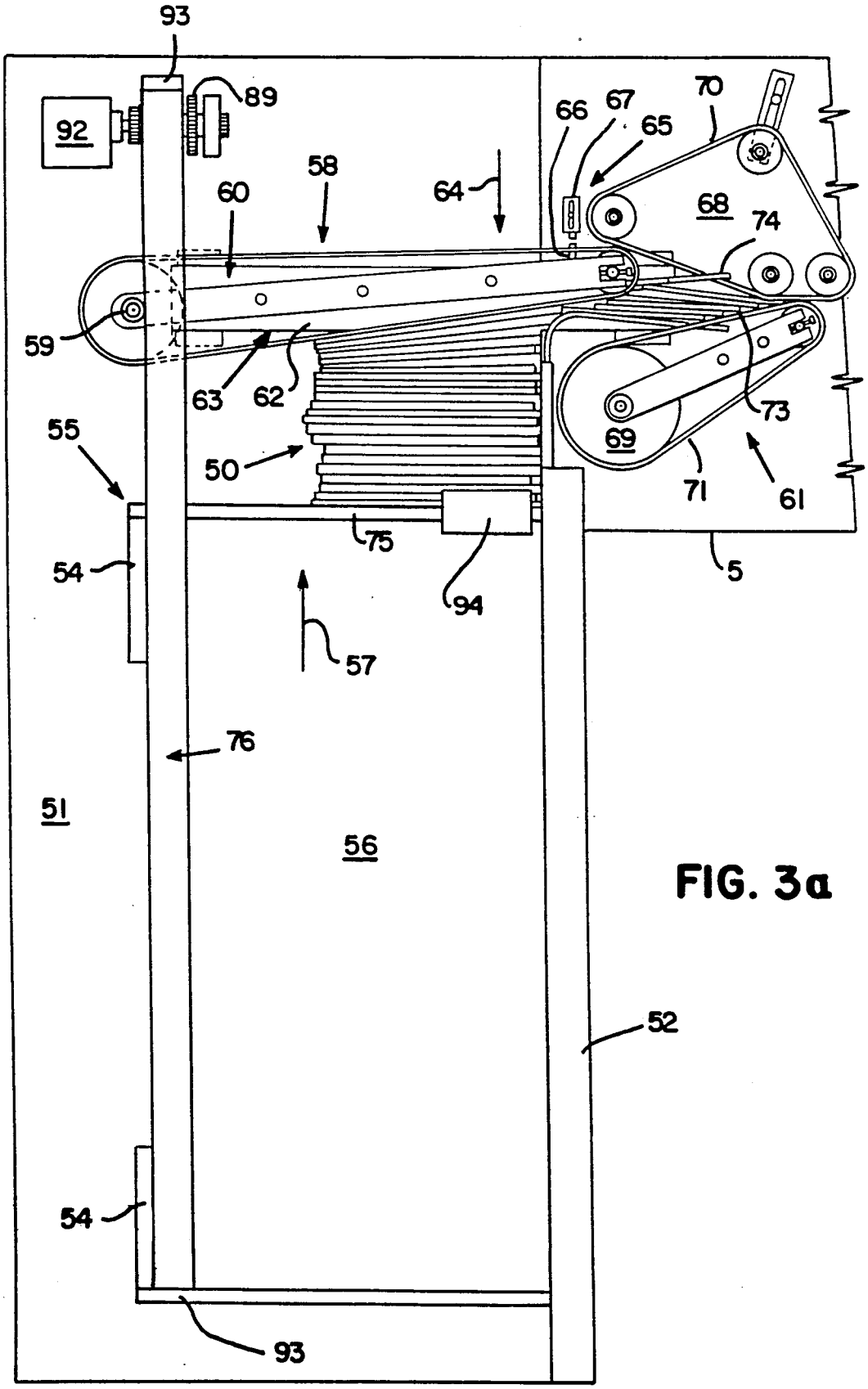
FIG. 3*a* is a top plan view of the input station of the apparatus.
Figure 3B:
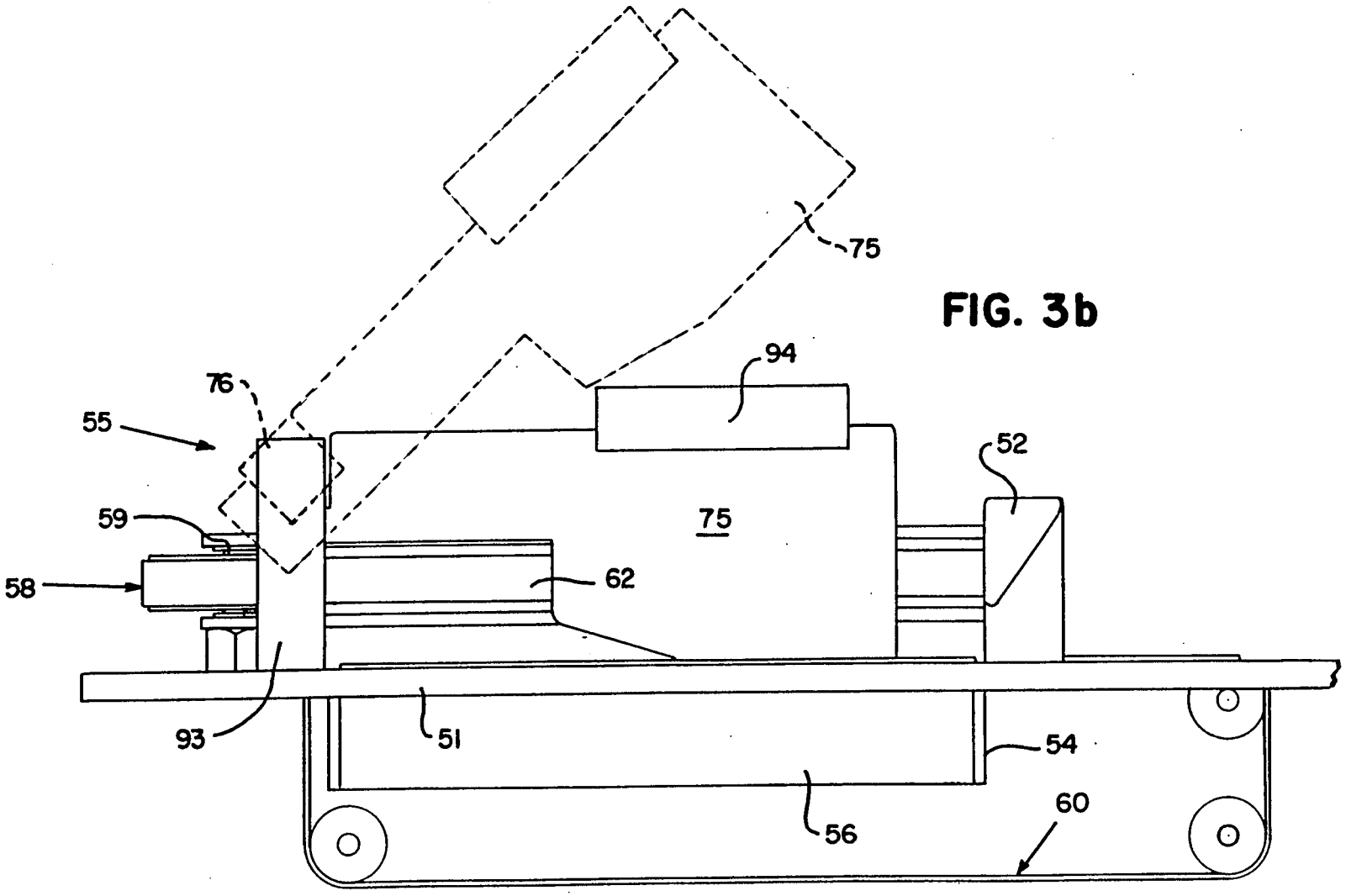
FIG. 3*b* is an end elevational view of the input station.

FIGS. 3*a* and 3*b* generally illustrate an input station 25 for receiving a plurality of envelopes 50, and for delivering the envelopes 50 to the processing unit 5 in organized fashion. Preferably, this involves the delivery of envelopes 50 to the processing unit 5 longitudinally and one at a time, with a side edge leading the way. To receive the envelopes 50, the input station 25 is provided with a working surface 51 having an outer edge (facing the operator position 14) which includes an upwardly projecting lip 52 for retaining the envelopes 50 over the working surface 51. The opposite edge of the working surface 51 is provided with a pusher assembly 55 for supporting the envelopes 50 over the working surface 51, and for urging [illegible] envelopes 50 toward the processing unit 5. Oper[illegible] combination with the pusher assembly 55 is a [illegible]yor belt 55 which, in essence, develops the function of the input conveyor 4. The ends of the conveyor belt 56 progress around opposed, horizontally disposed rollers 54 which are commonly driven with the pusher assembly 55 so that the pusher assembly 55 and the conveyor belt 56 are uniformly and simultaneously urged in the general direction of arrow 57, to urge the envelopes 50 toward the processing unit 5 as will be described more fully below.

Figure 4:
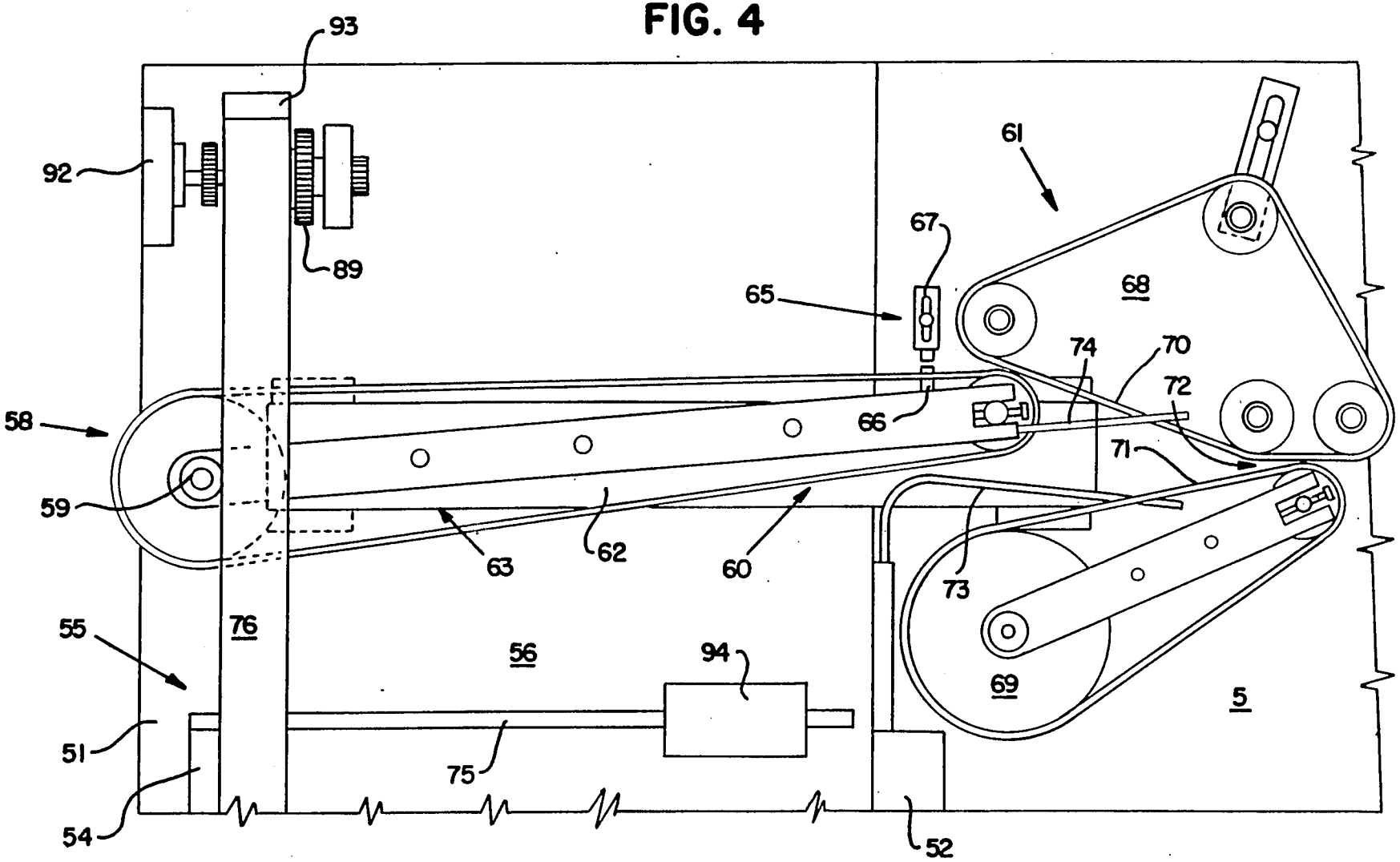
FIG. 4 is an enlarged, top plan view of the envelope feeding mechanism of the input station.

Referring to FIG. 4, the pusher assembly 55 and the conveyor belt 56 serve to urge the envelopes 50 toward a pre-feed belt system 58 which is pivotally associated with the working surface 51 is rotated in a counterclockwise direction, to direct envelopes 50 generally toward the right as viewed in FIG. 4, toward the remainder of the processing unit 5. A bottom-feed belt system 60 is located generally beneath the pre-feed belt system 58, and also serves to urge envelopes generally toward the right as viewed in FIG. 4. The bottom-feed belt system 60 is positioned immediately adjacent to the conveyor belt 56 so as to receive envelopes from the conveyor belt 56 as they are brought into contact with the pre-feed belt system 58. Thus, the pre-feed belt system 58 and the bottom-feed belt system 60 operate in combination to direct envelopes generally toward the right, to a friction separator unit 61. To be noted in this regard is that the belt 62 of the pre-feed belt system 58 is positioned so that it, in essence, cuts across the interface 63 between the conveyor belt 56 and the bottom-feed belt system 60. This configuration is preferred to assists the envelopes 50 in traversing the interface 63 by causing the bottom edges of the envelopes 50 to be gradually transferred to the bottom-feed belt system 60, thereby preventing the bottom edges of the envelopes 50 from jamming at the interface 63.

The pre-feed belt system 58 is spring loaded so as to urge the belt system 58 generally toward the series of envelopes 50, in the direction of arrow 64. This serves to maintain the envelopes 50 in a generally vertical orientation between the pusher assembly 55 and the pre-feed belt system 58. To ensure proper feeding of the envelopes 50, the pre-feed belt system 58 is dynamically balanced so as to apply an appropriate back pressure to the envelopes 59 on the working surface 51. To this end, as envelopes are delivered from the working surface 51 under the influence of the pusher assembly 55 and the conveyor belt 56, the envelopes 50 will tend to urge the pre-feed belt system 58, against its spring biasing, in a direction opposite to the arrow 64. To limit this back pressure, the pre-feed belt system 58 is provided with a sensor 65 for determining when a sufficient quantity of envelopes 50 has been placed against the pre-feed belt system 58, so that further envelope feeding may be temporarily discontinued by momentarily interrupting operation of the pusher assembly 55 and the conveyor belt 56. Although a variety of electrical implementations may be used to provide this function, the preferred implementation is an opto-coupler assembly which makes use of a blade 66 which is fixed to the frame which supports the pre-feed belt system 58, and which is disposed so as to be brought into and out of a region developed between the emitter (light) and receptor of the body 67 of the opto-coupler. The resulting change in state is used to control the common drive mechanism which operates the pusher assembly 55 and the conveyor belt 56, to dynamically limit the quantity of envelopes 50 delivered to the pre-feed belt system 58.

The friction separator unit 61 is generally comprised of opposing belt systems 68, 69 which come together to form a nip 72 for receiving envelopes delivered from the pre-feed belt system 58. Belt system 68 includes a feed belt 70 which rotates in a generally counter-clockwise direction and which is formed of a material having a relatively high coefficient of friction. Belt system 69 includes a retard belt 71 which also rotates in a generally counter-clockwise direction and which is formed of a material having a moderate (medium) coefficient of friction. As a result of this, as envelopes 50 are delivered to the nip 72 developed between the belt systems 68, 69, the envelope which is closest to the feed belt system 68 will be urged in a generally forward direction, while the remaining envelopes (adjacent to the retard belt system 69) will be urged in a generally rearward direction. The net effect of this is to permit only a single envelope (the envelope adjacent to the feed belt system 68) to pass through the nip 72. All other envelopes are urged generally rearwardly, to await their turn for delivery through the nip 72. to assist in supporting the envelopes 50 in position as they await passage through the nip 72, a pair of wire guides 73, 74 are associated with the surface of the processing unit 5, and the free end of the pre-feed belt system 58, respectively. As a result of the foregoing operations, envelopes are longitudinally delivered one at a time from the nip 72 toward the next station in the series.

As previously indicated, the pusher assembly 55 and the conveyor belt 56 cooperate to urge the series of envelopes 50 toward the pre-feed belt system 58, for eventual separation (so-called singulation). As the envelopes 50 are delivered to the processing unit 5, it will eventually be necessary to place additional envelopes on the input conveyor 4 to replenish the supply of envelopes being fed to the processing unit 5. Preferably, this is to be accomplished on a continuous basis, without interrupting operation of the processing apparatus 1, including the input station 25. Consequently, it is important to provide appropriate means for enabling the cleaver 75 of the pusher assembly 55 to be retracted by the operator, to enable additional envelopes to be placed behind the series of envelopes 50 which are in the process of being fed to the processing unit 5 without interrupting the feed of envelopes 50 to the friction separator unit 61. In providing this function, a number of considerations are presented. First, it is important for the cleaver 75 to be maintained in such a fashion that the pressure of the stack of envelopes 50 provided on the working surface 51 will not cause the cleaver 75 to be forced back along the working surface 51. Nevertheless, the cleaver 75 should preferably be capable of free forward motion so that the cleaver 75 may be quickly brought into contact with the envelopes then being placed on the input conveyor 4. Lastly, appropriate means must be provided to enable retraction of the cleaver 75 along the working surface 51 when adding envelopes to the input conveyor 4, to make room for the new envelopes.

Figure 5:
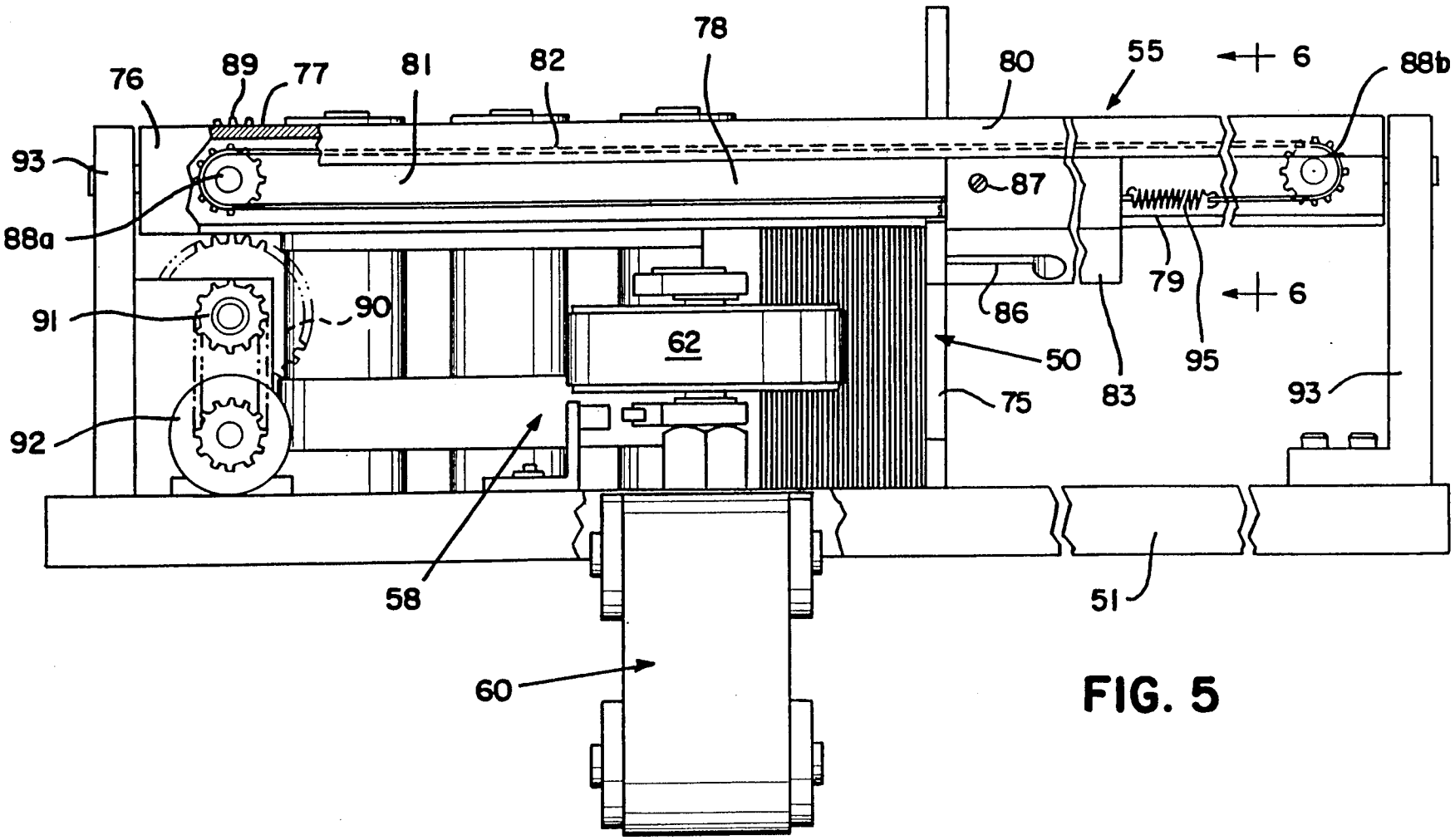
FIG. 5 is a side elevational view of the feeding mechanism of the input station, also showing the pusher assembly.
Figure 6:
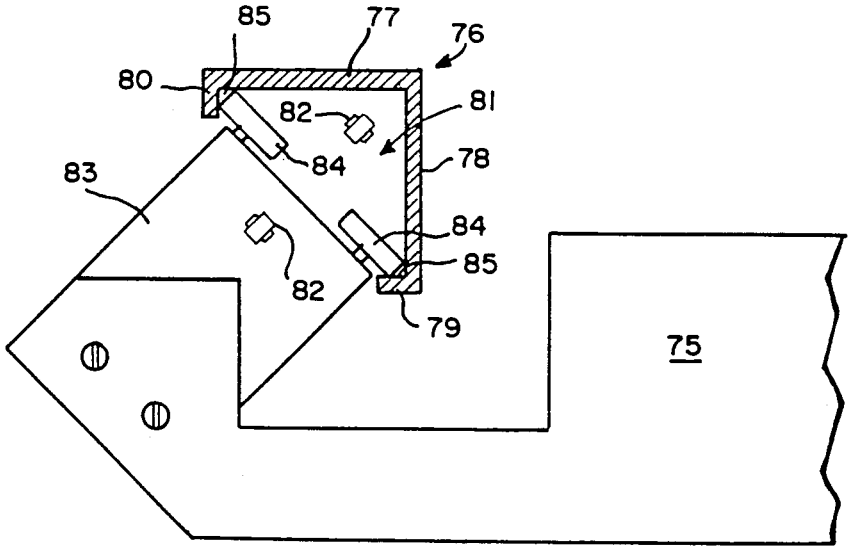
FIG. 6 is a partial, sectional view of the pusher assembly, taken along line 6—6 of FIG. 5.
Figure 7:
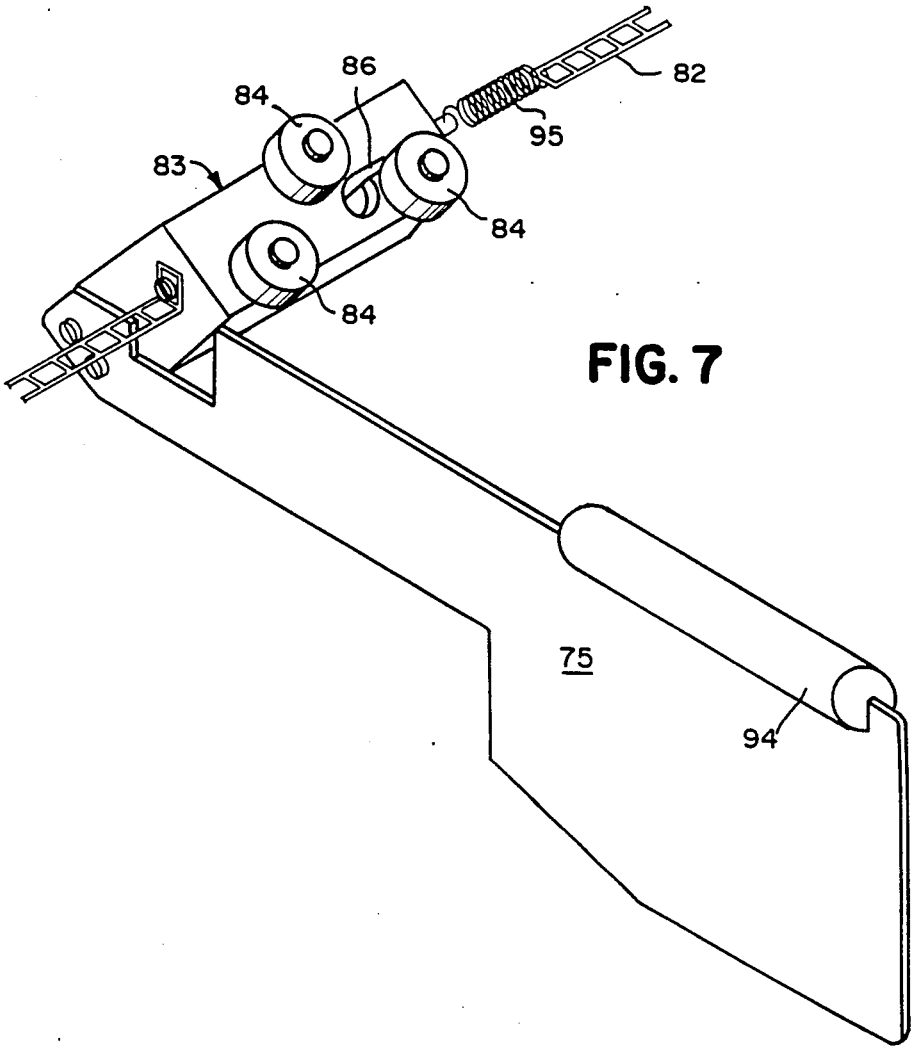
FIG. 7 is an isometric view of the cleaver and carriage mechanism of the pusher assembly.

With reference to FIGS. 5–7, the pusher assembly 55 of the present invention is capable of providing these functions by operatively connecting the cleaver 75 to a carriage 76 which extends along the side edge of the working surface 51 which opposes the lip 52 used to confine the envelopes to the working surface 51. Referring to FIG. 6, the carriage 76 has a generally square cross-section with an enclosed top edge 77 and side edge 78, to avoid contact with the envelopes placed upon the working surface 51. The bottom edge 79 and side edge 80 are each open to develop an exposed channel 81 which extends fully along the length of the carriage 76.

Referring to FIGS. 5 and 7, the channel 81 serves to receive a chain 82 which progresses about sprockets **88*a*, 88*b* provided at opposite ends of the carriage 76, and a roller assembly 83 which receives opposite ends of the chain 82 (preferably by means of a spring 95 for tension control). The roller assembly 83 is connected to the cleaver 75 so that the cleaver 75 is maintained perpendicular to the carriage 76, and the working surface 51, and includes a series of three roller bearings 84 which are positioned in opposed spaced relation to one another to engage opposing inner corners 85 of the carriage 76. The roller assembly 83 is further provided with a split, at 86, and a screw 87 for regulating the width of the roller assembly 83 at the resulting clevis, to adjust the manner of engagement between the roller assembly 83 and the carriage 76 which contains it. In this fashion, the roller assembly 83, and the associated cleaver 75, are permitted to freely progress along the carriage 76 responsive to rotation of one of the sprockets engaging the chain 82**.

The driven sprocket **88*a* extends from the carriage 76, preferably at the end of the carriage 76 which is adjacent to the pre-feed belt system 58, and receives a drive gear 89 (FIG. 4). Drive gear 89 cooperates with a drive gear 90 which, through the intervention of a one-way clutch 91, is operatively connected to a drive motor 92. Furthermore, the entire carriage 76 is journalled for rotation within a pair of bearing blocks 93 provided at opposite ends of the carriage 76, so that the carriage 76 may be rotated about its longitudinal axis responsive to raising and lowering of the cleaver 75 (See FIG. 3*b*), making use of the handle 94, or otherwise. As a consequence of this, the gears 89, 90 are selectively engaged in accordance with raising and lowering of the cleaver 75**.

As a result of the foregoing construction, the drive motor 92 serves to direct the cleaver 75 (in its lowered position) in a generally forward direction when envelope feeding is to occur. In this lowered position, retraction of the cleaver 75 is resisted by the one-way clutch 91 which operatively connects the drive motor 92 and the remainder of the pusher assembly 55, while forward motion of the cleaver 75 is permitted to enable an operator to bring the cleaver into immediate contact with a series of envelopes which are being placed upon the working surface 51. Retraction of the cleaver 75, for the addition of envelopes to the series 50, is accomplished by simply lifting the cleaver 75, using the handle 94, and retracting the cleaver 75 as the gears 89, 90 are brought out of contact with one another. As the cleaver 75 is returned to its operative position, the gears 89, 90 are again caused to engage one another, resuming normal (forward) operation of the cleaver 75. Accordingly, an operator is able to add envelopes to the series 50 without interrupting operation of the input station 25, enabling a working supply of envelopes 50 to be continuously maintained on the input conveyor 4 in a simple and straightforward manner.

SCANNING STATION

From the input station 25, envelopes are delivered one at a time to the scanning station 26, which is generally comprised of two portions including a thickness monitoring device 100 and a metal detection device 130.

Due to the manner in which the belt systems 68, 69 operate to singulate envelopes as they are delivered from the input station 25, the envelopes will tend to be delivered from the input station 25 with the leading edge of each envelope immediately following the trailing edge of a preceeding envelope, leaving essentially no gap between the two envelopes. This would result irrespective of the length of the envelopes being processed, and whether the envelopes being processed were all of the same length, or of different lengths. While it is possible for the remainder of the processing unit 5 to accommodate this, such a condition is undesirable since it tends to introduce a potential for error, and since it tends to introduce certain irregularities into the system which result in an irregular throughput for the envelopes being processed. This latter consideration is important since, although such a condition is not essential to operation of the apparatus 1, it has been determined that to interface the apparatus 1 with the remainder of an existing mailroom operation in the most efficient way, a relatively constant throughput of envelopes is particularly desirable. For this reason, it is preferred to separate the envelopes exiting the input station 25 by a specified gap.

To accomplish this, the operative rollers of the thickness monitoring device 100 which first receive the envelopes being discharged from the input station 25 are rotated at a speed in excess of that of the feed belt system 68 of the input station 25. A speed increase of approximately 2.5 to 1 is preferred in this regard (e.g., a 20 IPS output rate versus a 50 IPS input rate). In any event, the resulting gap imparted to the envelopes delivered from the input station 25 will depend upon the differential in feed rates between the input station 25 an the scanning station 26, and the distance between the output (the nip 72) of the input station 25 and the input (the operative rollers of the thickness monitoring device 100) of the scanning station 26. By varying these parameters, the gap between envelopes may be freely adjusted according to need. It has further been found that by using the driven rollers of the thickness monitoring device 100 to withdraw the envelopes from the input station 25, the envelopes are caused to be spaced apart in a manner which yields a relatively constant throughput in the remainder of the apparatus 1, essentially irrespective of envelope size.

Figure 8:
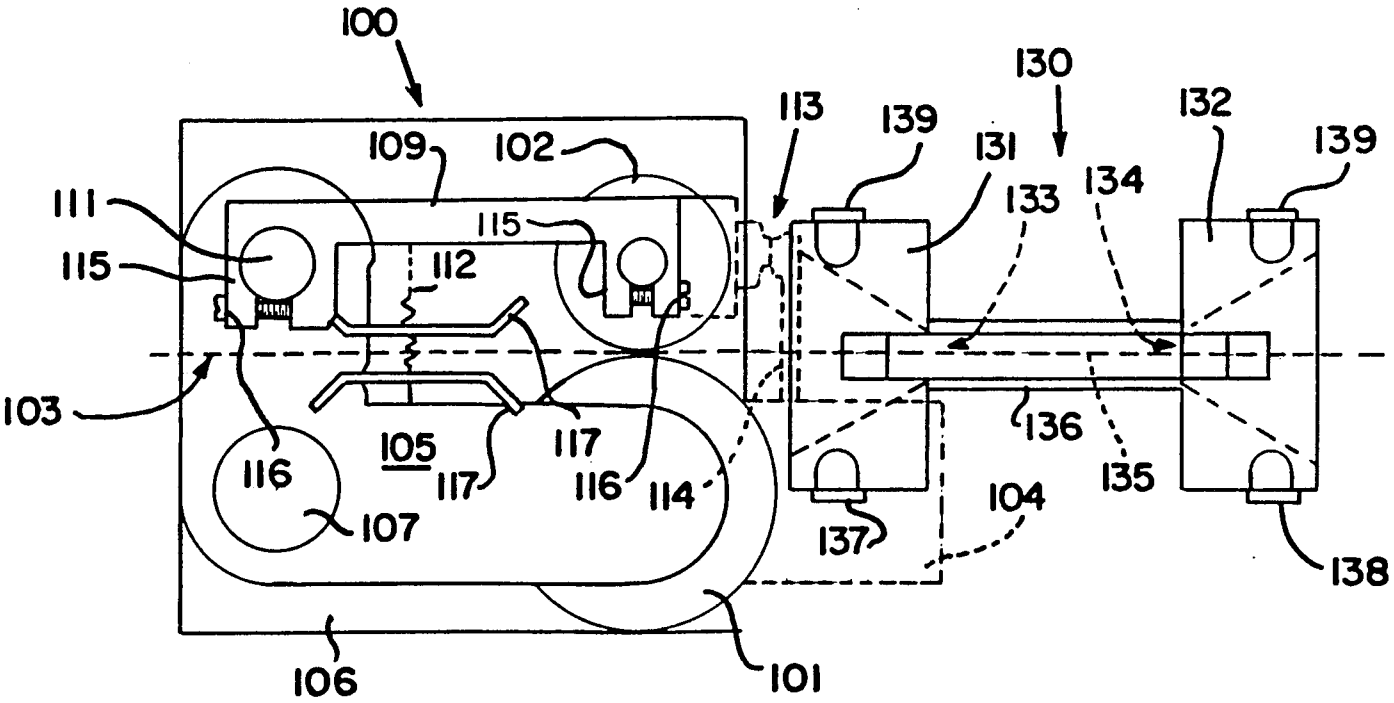
FIG. 8 is a top plan view of the scanning station of the apparatus.
Figure 9:
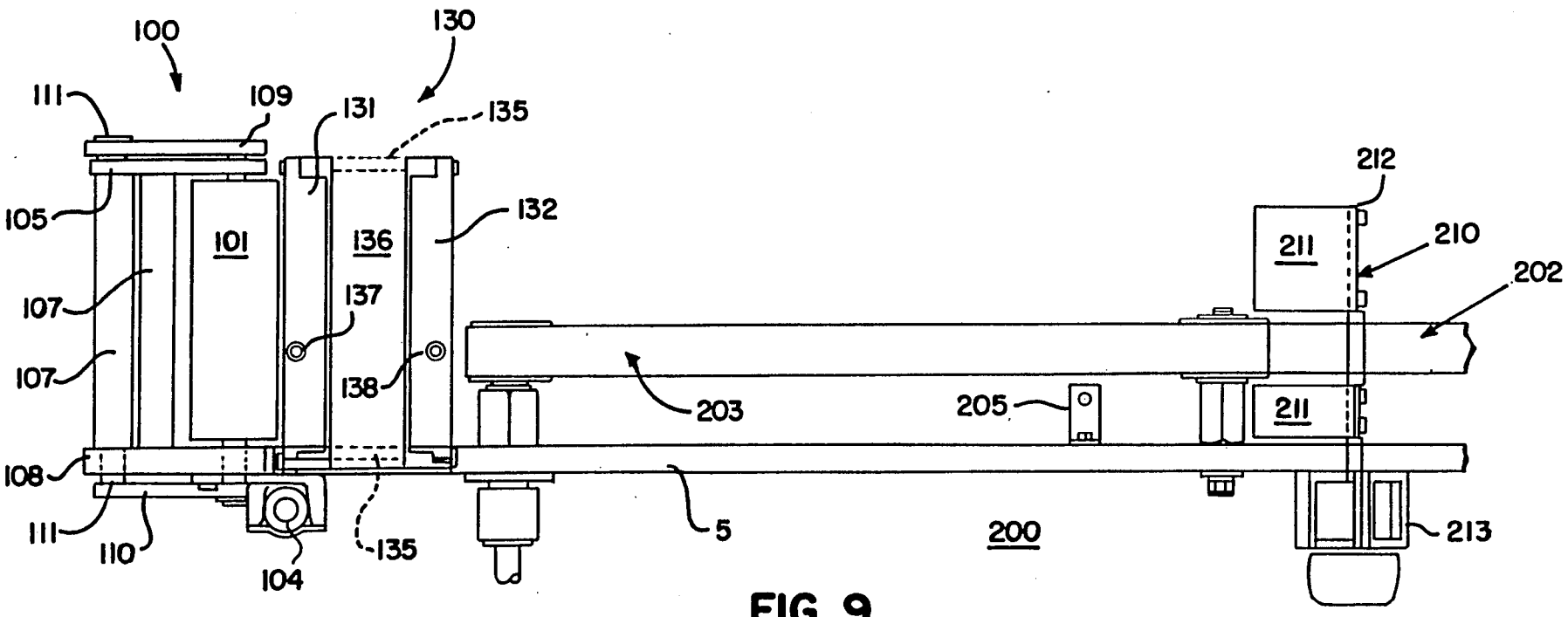
FIG. 9 is a side elevational view of the scanning station, also showing portions of the sorting station of the apparatus.

Referring now to FIGS. 8 and 9, the thickness monitoring device 100 is essentially modular in construction (for reasons which will become apparent in describing the structure of the extraction station 29), and is generally comprised of a pair of rollers 101, 102 which develop a nip which is in general alignment with the transport path 103 developed for the series of envelopes being processed. The rollers 101, 102 are operatively combined with a linear variable differential transformer (LVDT) device 104 to enable the thickness of the envelopes being conveyed along the transport path 103 to be measured in a manner which is described in prior co-pending U.S. patent application Ser. No. 802,690, entitled "Apparatus for Monitoring the Thickness of an Object", and which is commonly assigned with the subject matter of the present application. The subject matter of this co-pending patent application, and the thickness monitoring device which it describes, is incorporated by reference as if fully set forth herein.

The roller 101 is a fixed roller which is positioned on the outboard side of the transport path 103 and which is journalled for driven rotation between an upper mounting plate 105 and a lower mounting plate 106. The mounting plates 105, 106 are separated from one another by a pair of supports 107, and the lower mounting plate 106 is capable of being affixed to the base 108 of the processing unit 5 in appropriate fashion. The roller 102 is movable with respect to the fixed roller 101 so that envelopes traversing the transport path 103 will develop a separation between the rollers 101, 102 which varies in accordance with changes in their thickness. To this end, the roller 102 is journalled for rotation within a pair of idler arms 109, 110 which are in turn pivoted for rotation with respect to the mounting plates 105, 106, at the pivots 111. A spring 112 is connected between one of the idler arms, preferably the lowermost idler arm 110, and its nearest adjacent mounting plate, in this case the lower mounting plate 106. This serves to bias the rollers 101, 102 toward one another, to ensure an appropriate thickness measurement.

The lower idler arm 110 is provided with a ball and socket combination 113 which operatively connects the movable roller 102 with the shaft 114 of the LVDT device 104, which is mounted perpendicular to the transport path 103 at a position just beneath the lower mounting plate 106. As a consequence of this, movement of the roller 102 with respect to the fixed roller 101 will cause reciprocation of the shaft 114 within the LVDT device 104, producing electrical signals which may be processed as will be described more fully below to yield a thickness measurement pertaining to the envelope which is passing through the thickness monitoring device 100.

To accomplish an accurate thickness measurement, it is important for the rollers 101, 102 to be maintained in parallel relation to one another along their entire length. This is to make sure that each envelope is accurately scanned for thickness irrespective of the location of articles within the envelope. This is accomplished by providing each end of each of the idler arms 109, 110 with a clevis 115 for respectively engaging the movable roller 102 and the pivots 111 of the mounting plates 105, 106. Parallel alignment between the roller 101, 102 may then be developed by loosening the screws 116 associated with each clevis mounting 115 until the connecting arms 109, 110 release the roller 102 and the pivots 111. The spring 112 then serves to urge the roller 102 into intimate contact with the roller 101, whereupon the screws 116 may be tightened to maintain this positioning. As a consequence of this, the rollers 101, 102 are maintained in appropriate alignment with respect to one another without the need for complicated adjustment procedures.

In this regard, it is to be noted that while it is important for the rollers 101, 102 to be maintained precisely parallel with one another, it is not necessary for precise alignment to be maintained between the rollers 101, 102 and the transport path 103. Slight variations at this interface will not adversely affect thickness measuring since the envelopes are free to bend somewhat as they proceed between the rollers 101, 102. However, to effectively receive the envelopes, and to maintain the envelopes in a generally vertical orientation as they proceed through the thickness monitoring device 100, a pair of guides 117 are preferably provided on opposite sides of the transport path 103 along central portions of the thickness monitoring device 100.

Figure 10:
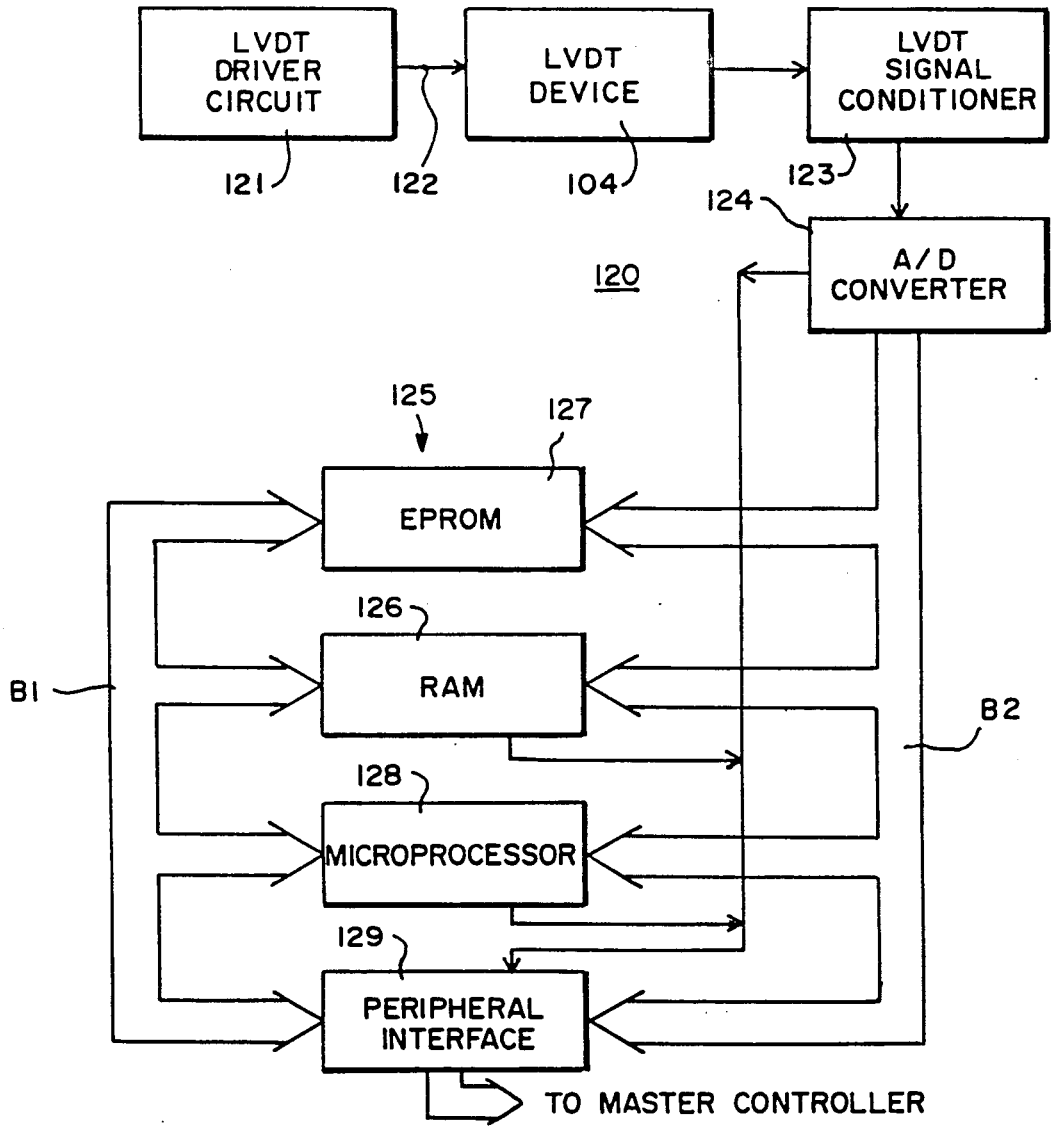
FIG. 10 is a schematic diagram showing a circuit for receiving and processing signals from the thickness monitoring device shown in FIGS. 8 and 9.

Referring to FIG. 10, signals received from the LVDT device 104 are provided to an electrical circuit 120 which is capable of converting the resulting signals into a dynamic indication of measured thickness along the length of the envelopes being processed through the thickness monitoring device 100. To this end, the LVDT device 104 receives a reference input from an LVDT driver circuit 121 which is appropriate for converting reciprocation of the shaft 114 into an electrical signal at 122. This signal 122 is then introduced to an LVDT signal conditioning circuit 123, which essentially amplifies the signal received from the LVDT device 104. Thereafter, the conditioned signal is applied to an analog-to-digital converter 124, for subsequent application to a microcontroller 125. Generally, microcontroller 125 incorporates means for enabling the digitally encoded signals received from the LVDT device 104 to be stored (RAM 126), analyzed and converted (EPROM 127, Microprocessor 128) either to a thickness measurement or to an indication of the number of contents in the envelope being scanned. This information is then used to control subsequent handling of the envelope as it proceeds through the sorting station 27, in accordance with the derived thickness measurement (Peripheral Interface 129). The microcontroller 125 operates to receive digitally encoded information from the LVDT device 104, and to make decisions regarding the further processing of envelopes passing through the thickness monitoring device 100, as follows.

As previously indicated, whether or not an envelope is to be processed through the remainder of the apparatus 1 depends upon whether or not the envelope contains an invoice and an accompanying check. The thickness monitoring device 100 and the microcontroller 125 cooperate to make this determination based upon the measured profile of each envelope as it passes between the opposed rollers 101, 102. To this end, samplings are taken at an appropriate rate (e.g., 10 samplings per inch) as each envelope passes through the thickness monitoring device 100, and the resulting profile is stored RAM 126. Entry and exit of the envelope is capable of being determined either responsive to a sensor associated with the thickness monitoring device 100, or responsive to measured thicknesses above a selected threshold (e.g., 2 mils) which are received by microcontroller 125.

Initially, two determinations are made before the received data is further processed. First, a zero base line is measured for the envelope then passing through the thickness monitoring device 100, as the envelope enters the device 100. To be noted is that a zero base line is measured for each envelope being processed to minimize the potential for error due to drift and the like. This zero base line is subtracted from the raw data which is received from the LVDT device 104, for storage within RAM 126, to develop a relative thickness which is representative only of the contents and not the envelope which contains them. Second, the received data is checked for gross violations; based upon measured thicknesses which greatly exceed the anticipated thickness of an envelope, invoice and check (e.g., 30 mils). Since such an event signifies that the monitored envelope contains an item which is not to be processed through the apparatus 1 (a paper clip, a credit card, a coin, etc.), a violation is immediately declared and further processing becomes unnecessary.

Figure 11:
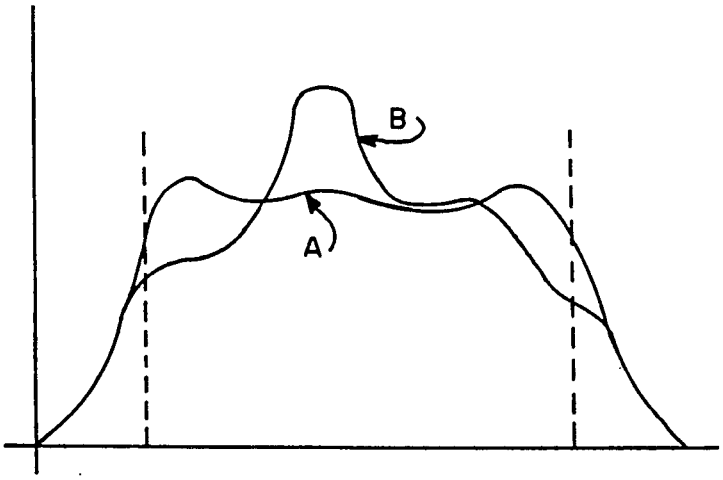
FIG. 11 is a graph showing curves representative of envelope characteristics, for processing within the circuit of FIG. 10.

If further processing is indicated, the data stored in RAM 126 is then interpreted. Referring to FIG. 11, which shows a characteristic (exemplary) curve A representive of a typical envelope profile, it is seen that the leading and trailing edges of the curve (representing the side edges of the envelope) vary widely while the center of the curve (representing passage across the face of the envelope) is relatively flat. To avoid anomalies at the edges, an offset (shown by dotted lines) is added to the zero base line for the envelope, and values falling outside this offset are ignored. The remaining data is then interpreted by averaging the measured thicknesses across the face of the envelope. Because of the sensitivity which is necessary to interpret irregularities in the contents of the envelope, such as folds and the like, and to increase accuracy, the averaging used in interpreting the data is preferably a windowed average; and average of a given number of points surrounding the point to be analyzed (e.g. 2 or 3 points on either side of the reference point). This has the advantage of filtering undersirable perturbations while maintaining desired variations in profile, such as those shown in curve B of FIG. 11, which is characteristic of a folded document (edges rounded due to filtering effect).

Each measured point is then compared to upper and lower threshold values which are representative of a band of thicknesses which are characteristic of a combined invoice and check, and which are generally empirically determined according to the forms (invoices) used by a given organization (the checks are printed on relatively standard papers), with an allowance for error (tolerance). To be noted is that this empirical value can also be used to account for minor envelope variations (hysteresis), if desirable for a particular application.

If an averaged value ever exceeds the upper threshold value, a violation is immediately declared. If an averaged value is ever detected which is less than the lower threshold value, a potential violation is declared since such an event can signify either folded contents (which will eventually be rejected as exceeding the upper threshold value), or possible a check which is shorter than the accompanying invoice (and which for a brief period will exhibit a decreased total thickness). Upon declaring a potential violation, a count of consecutive averaged values below the lower threshold is initiated. If this count exceeds a selected value (selected to correspond to one-half of the length of the envelope being processed), a violation is declared since this signifies that the envelope does not contain a pair of documents within the specified band of thicknesses, i.e., an invoice and check. If this count fails to reach the selected value before the averaged thicknesses return to the accepted band of threshold values, the count is discontinued (reset) and subsequent averaged values are processed as previously described. If, at the end of this procedure, a violation has not been declared, then the envelope is marked for further processing (via Peripheral Interface 129). If a violation has been declared, then the envelope is marked for outsorting as will be described more fully below.

A circuit for providing the above-described functions may be developed by making use of the computer program disclosed in the microfiche appendix incorporated by reference, in a circuit comprised of the following components.

| | |
|---|---|
| LVDT Device 104 | Schaevitz 50 HR |
| LVDT Driver Circuit 121 | NE552IN |
| LVDT Signal Conditioner 123 | " |

-continued

| | |
|---|---|
| A/D Converter 124 | AD7576 |
| RAM 126 | HM6116 P-3 |
| EPROM 127 | HN482764 |
| Microprocessor 128 | 8751H |
| Peripheral Interface 129 | 8255A |

To correctly interface the foregoing elements, a decoder (P3205) operatively couples the control buss B1 (FIG. 10) with the Peripheral Interface 129, and a latch (8282) operatively couples the control buss B1 with the data buss B2 (FIG. 10).

After exiting the thickness monitoring device 100, the envelope is then introduced into the metal detection device 130. The purpose of the metal detection device 130 is to locate envelopes having contents which may have been joined together by staples, paper clips or other metal objects. To be noted is that such object (with the possible exception of some staples ) will most probably have already been marginally detected by the thickness monitoring device 100, since the thickness of such objects will generally significantly exceed the thickness for the desired contents, that being a single invoice and check. Nevertheless, thickness measurement is preferably followed by a metal detection operation to locate metallic objects which may not have been detected during thickness monitoring, and to distinguish oversized (thick) contents such as credit cards from metallic contents such as staples and paper clips in the event that it is desired to separately out-sort these items as will be described more fully below. To be noted in this regard is that the plastic paper clips which are presently available for use, and which would not be detected by the metal detection device 130, will previously have been detected by the thickness monitoring device 100, serving as a back-up for isolating such undesirable implements.

Structurally, referring again to FIGS. 8 and 9, the metal detection device 130 is comprised of a pair of vertically disposed mounting blocks 131, 132 which converge to apertures 133, 134 for passing envelopes as they traverse the transport path 103, and a pair of cross-members 135 which extend between the mounting blocks 131, 132, in general alignment with the apertures 133, 134. The cross-members 135 combine with the mounting blocks 131, 132 to receive a toroidal winding 136, through which envelopes may pass as they progress between the convergent apertures 133, 134 of the mounting blocks 131, 132.

Each of the mounting blocks 131, 132 are additionally provided with photoreceptors 137, 138. Photoreceptor 137 is associated with the mounting block 131 to indicate when an envelope is entering the metal detection device 130, while photoreceptor 138 is associated with the mounting block 132 to indicate when the envelope is leaving the metal detection device 130. In each case, such signals are developed by an operative combination of a light source 139 which opposes each of the photoreceptors 137, 138 (e.g., a photodiode or a phototransistor) so as to develop varying signals as the envelopes traverse the transport path 103.

Figure 12:
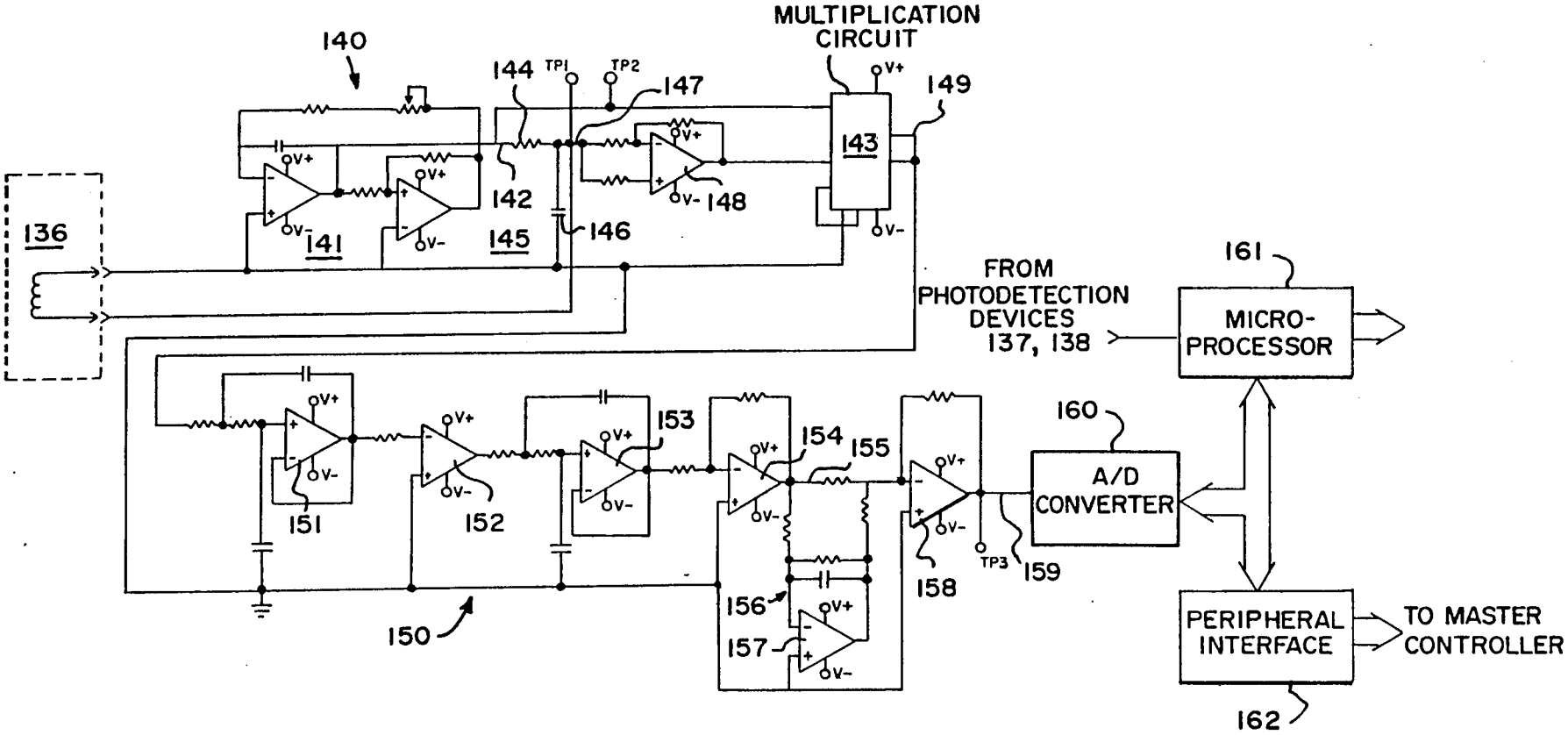
FIG. 12 is a schematic diagram showing a circuit for receiving and processing signals from the metal detection device illustrated in FIGS. 8 and 9.

To accomplish metal detection, the toroidal winding 136 is operatively connected to a metal detection circuit 140, which is illustrated in FIG. 12. The theory of operation behind the metal detection circuit 140 essentially involves the comparison of a reference signal with a phase-shifted reference signal. To this end, the basic reference signal is simultaneously applied to an appropriate toroidal winding, and to a circuit for developing a shifted reference signal of known phase (generally a 90° shift). The resulting signals are then compared in a multiplication circuit. The resulting product includes a component which, for small angles, is essentially linear and proportional to the phase shift which is produced by the passage of a metal object through the toroidal winding, and other complex high frequency components. By filtering the high frequency components, the resulting linear component may be used to develop an indication of phase shift in accordance with variations in voltage. Although this linear behavior is exhibited only for relatively small angles, the resulting approximation has been found to be sufficient for measuring phase shifts corresponding to the detection of metallic objects.

This theory of operation is implemented in the metal detection circuit 140 by providing an oscillator 141, preferably a quadrature oscillator, which develops a saw-tooth waveform of known frequency and amplitude. The output 142 of oscillator 141 is applied to one input of a multiplication circuit 143, and to a resistor 144 which serves to decouple the oscillator 141 from the circuitry which follows.

the second input for the multiplication circuit 143 is derived by applying the output 142 of oscillator 141 to a phase detection circuit 145. Phase detection circuit 145 is a tuned LC circuit which is comprised of a capacitor 146 and the toroidal winding 136. As a consequence of this architecture, the signal developed at 147 will be shifted in phase from the reference signal (output 142) responsive to the passage of a metallic object through the center of the toroidal winding 136. This signal is then introduced to an amplification circuit 148 which is configured to additionally introduce an intentional phase shift of 90° to the signal developed at 147.

The multiplication circuit 143 accordingly develops an output, at 149, having a low frequency signal component, the amplitude of which is proportional to the phase shift experienced as the result of a metallic object having passed through the toroidal winding 136 of the metal detection device 130, and having high frequency components resulting from the multiplication process. The resulting signal (output 149) is applied to a signal conditioning circuit 150 which preferably includes a first two-pole filter 151 for removing the high frequency components, and a first amplifier 152 for improving the resulting signal, followed by a second two-pole filter 153 and a second amplifier 154 to reliably filter the undesirable high frequency components and thereby isolate the desired signal, at output 155.

Output 155 is, in turn, applied to a drift compensation circuit 156 which is provided to account for possible drift resulting primarily from the development of the original reference signal by the oscillator 141. Compensation is accomplished by summing the output signal 155 with an inverted, integrated version of the output signal which is developed by integrator circuit 157. Summation is accomplished within an operational amplifier 158. As a result of this summation, slow drift, such as that resulting from oscillator drift, will be cancelled so that no signal will appear at the final output 159. However, transient responses resulting from measured phase shifts will be passed through the drift compensation circuit 156, to the final output 159. Such drift compensation is preferred for us in connection with the presently described embodiment to account for drift inherent in the oscillator circuit 141. However, it is possible to eliminate the drift compensation circuit 156 in the event that a more precise oscillator is used, which does not exhibit widely varying drift characteristics.

In any event, the final output 159 is applied to an analog-to-digital converter 160, for presentation to a microprocessor 161. Microprocessor 161 operates to periodically sample the digitized output of the metal detection circuit 140, and to compare this sampled output with a measured reference signal (base line) which is produced each time the leading edge of an envelope passes into the metal detection device 130 (to further reduce the potential for error due to drift). Detected outputs which exceed this reference signal by a prescribed threshold value are deemed to indicate the presence of a metallic object, and are used to control subsequent handling of the envelope as it proceeds through the sorting station 27 (Peripheral Interface 162).

A circuit for providing the above-described functions may be developed by making use of the computer program disclosed in the microfiche appendix incorporated by reference, in a circuit comprised of the following components.

| | |
|---|---|
| Multiplication Circuit 143 | AD534 |
| A/D Converter 16 | AD7576 |
| Microprocessor 161 | 8751 |
| Peripheral Interface 162 | 8255 |

Appropriate operational amplifiers may be selected to provide the remaining circuit functions.

From the foregoing, it is seen that as an envelope passes through the thickness monitoring device 100 and the metal detection device 130, a series of three signals will be developed which are descriptive of the envelope and its contents. First, an indication will be provided as to the thickness of the envelope and its contents. Second, an indication will be provided as to whether or not the envelope contains any metal objects. Third, an indication will be provided as to the length of the envelope, by monitoring the condition of the photoreceptors 137, 138 associated with the metal detection device 130. For example, envelope length may be determined by monitoring when the photoreceptor 137 (or the photoreceptor 138) is deactivated (encountering the leading edge of an envelope) and when the photoreceptor 137 is again activated (indicating passage of the trailing edge of the envelope). Other detection schemes are also possible.

Based upon these three indications, a decision is made as to whether the envelope is appropriate for subsequent processing (i.e. the envelope is believed to contain only an invoice and check, and contains no metal objects or other fasteners), or whether the envelope includes contents which are not appropriate for further processing either because the envelope is believed to contain items of lesser priority, or because the envelope contains physical objects which are not appropriately processed through the remainder of the apparatus 1. Based upon these decisions, signals are provided to the sorting station 27, to operate upon the envelopes as they pass from the scanning station 26.

SORTING STATION

Figure 13:
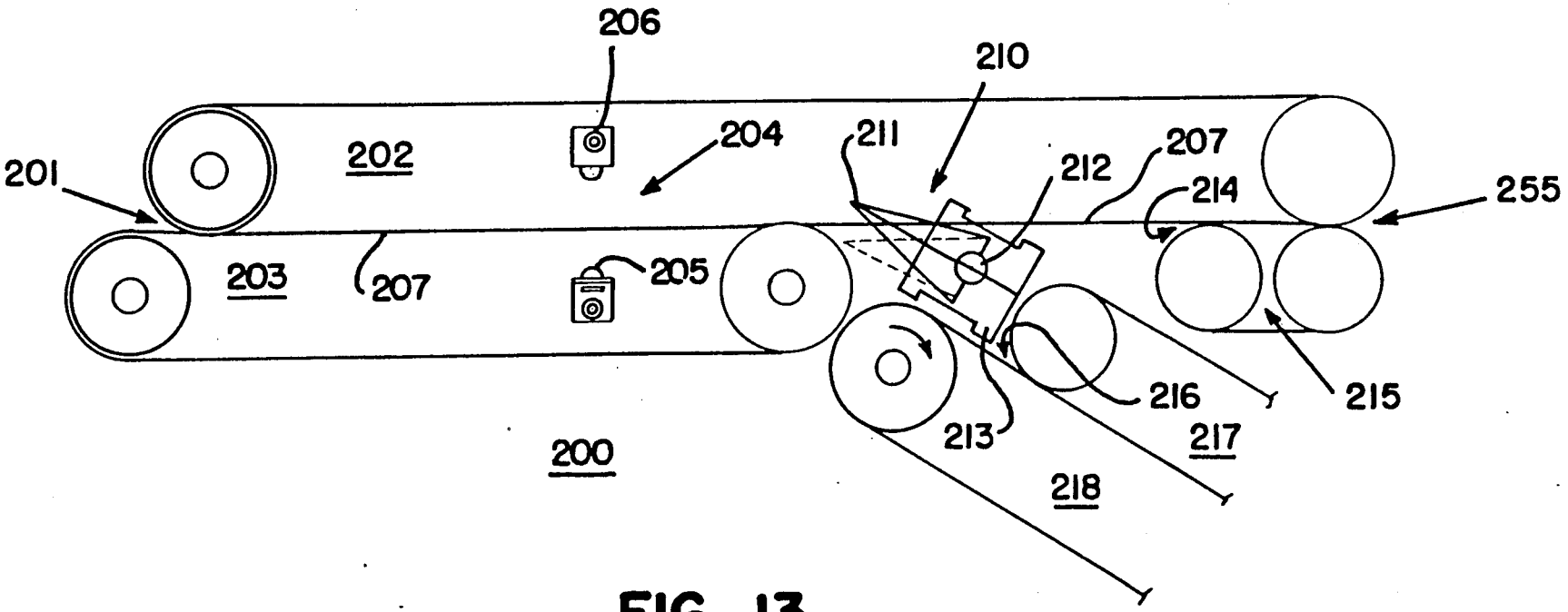
FIG. 13 is a partial, top plan view of the sorting station of the apparatus.

Referring to FIGS. 9 and 13, the out-sort device 200 of the sorting station 27 receives the envelopes delivered from the scanning station 26 within a nip 201 which is defined between an opposing pair of belt systems 202, 203. Envelopes are transported between the belt systems 202, 203, eventually encountering a photodetection device 204. Photodetection device 204 generally includes an emitter 205 and a receptor 206 positioned on opposite sides of the envelope transport path 207, and is used to indicate when an envelope has reached an appropriate point for a decision to be made as to whether or not the particular envelope is to proceed through the remainder of the apparatus, or is to be diverted from subsequent processing. To be noted is that the photodetection device 204 is spaced at a significant distance from the nip 201 which initially receives the envelopes from the metal detection circuit 130. This is to make sure that, irrespective of length, the envelope which is to be operated upon has been fully withdrawn from the metal detection device 130, and is fully contained within the out-sort device 200, prior to subsequent operations. Consequently, the distance between the exit from the metal detection device 130 and the photodetection device 204 should slightly exceed the length of the longest envelope which can be processed through the apparatus 1.

The decision as to whether an envelope is to be processed or rejected is ultimately carried out by a pivotable deflector 210. The deflector 210 essentially comprises a pair of vanes 211 which are connected to a pivotable shaft 212, which extends downwardly through the base of the processing unit 5 to an appropriate actuator device 213, such as a solenoid or air cylinder. The actuator 213 is operated in accordance with the signals which are received from the scanning station 26 as previously described, depending upon the characteristics of the envelope being processed, and its contents. In the event that the envelope is to be further processed, the deflector 210 assumes the position which is shown in phantom in FIG. 13. This causes the envelope to be directed toward a nip 214 which is developed between the belt system 202 and yet another belt system 215 positioned on the opposite side of the active transport path 207. It is determined that the envelope is to be diverted from the processing path 207, the pivotable deflector 210 is caused to assume the position which is shown in solid lines in FIG. 13, diverting the envelope toward a nip 216 developed between an opposing pair of belt systems 217, 218.

As a result, the foregoing provides a means for outsorting or diverting envelopes which are not appropriately processed, while passing appropriate envelopes along the active transport path 207 for subsequent processing. At this point, all that is required is to appropriately collect the rejected envelopes for separate processing, either by the operator of the processing apparatus 1, or at another location. In either case, this can be achieved by simply during the envelopes into a collection bin.

However, to enhance efficiency, such rejected envelopes are preferably stacked so that they may removed from the apparatus 1 in a form which is convenient for transfer to the mail trays which are conventionally used to handle envelopes within a mailroom environment (located on the out-sort cart 8). For this reason, upon exiting from between the belt systems 217, 218, the envelopes are preferably introduced to one or more stackers 220, 221, which serve to neatly stack rejected envelopes for subsequent removal from the apparatus 1. In the preferred embodiment, two stackers 220, 221 are provided since it can be expected that at least for some mail room operations, a significant number of envelopes will be rejected, and accordingly, a significant capacity will be required to collect such envelopes until such time as the operator has an opportunity to remove the out-sorted envelopes from the apparatus. To this end, the stackers 220, 221 may operate in parallel, to alternatingly receive the envelopes which are deflected from the processing path 207, or may be filled one at a time, so that the remaining stacker unit serves as a back-up for the stacker unit which is then being filled. Yet another available function is to separate contents which have been rejected due to thickness from contents which have been rejected due to their including a metallic implement. This latter feature is particularly useful if it is desired to subsequently handle these different groupings of envelopes at different stations or locations.

Figure 14:
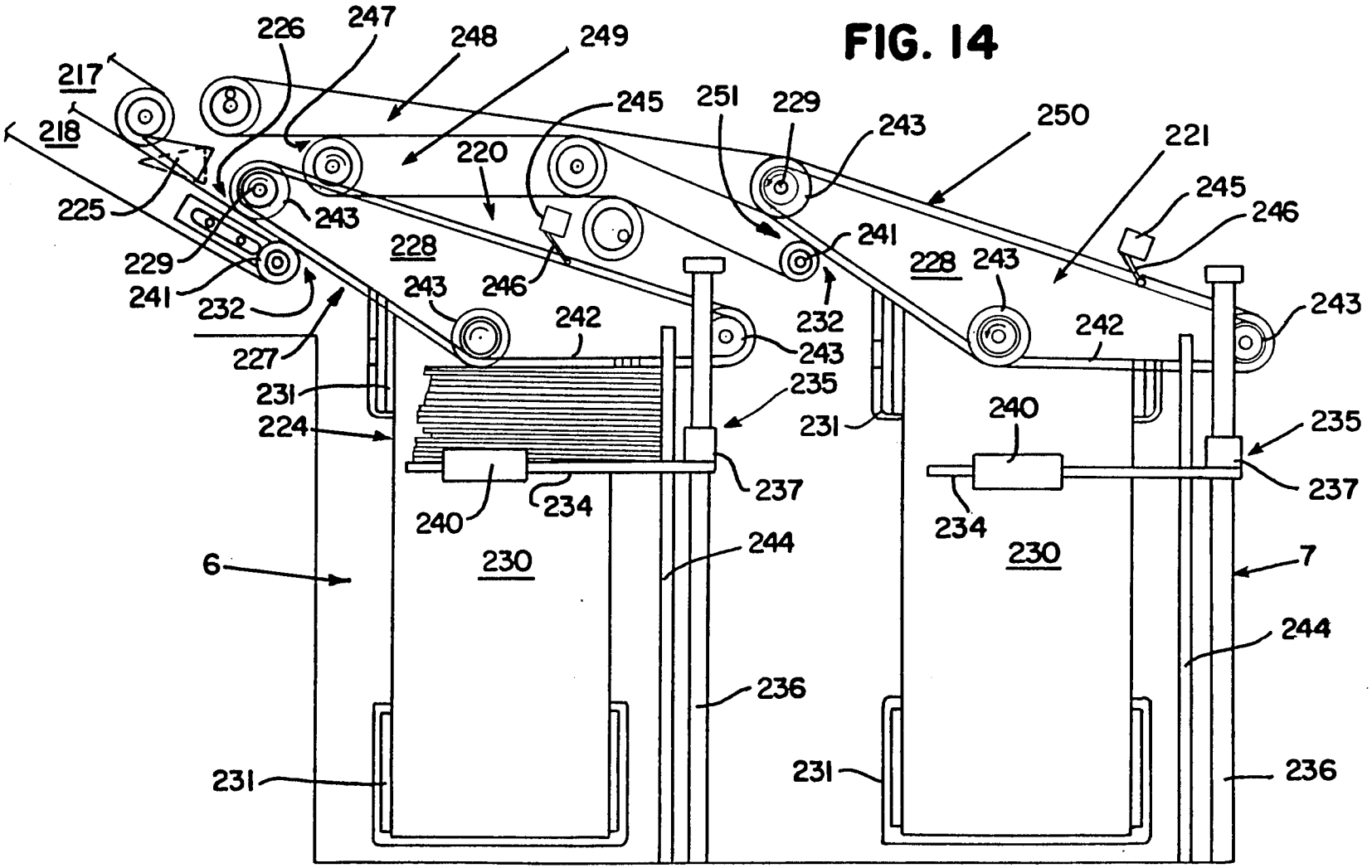
FIG. 14 is a partial, top plan view of the reject trays associated with the sorting station.

In either event, referring to FIG. 14, a pivotable deflector 225 is provided at the point of exit from between the belt systems 217, 218 to selectively direct rejected envelopes between the pair of stackers 220, 221. Pivotable deflector 225 is structurally identical to the pivotable deflector 210, and again operates responsive to signals applied to a corresponding actuator device. These signals are applied according to the stacking scheme which is to be developed; namely, either consistently in one direction, alternatingly between the pair of stackers, or responsive to signals received from the thickness monitoring device 100 and the metal detection device 130. In any event, operation of the deflector 225 causes the rejected envelopes to proceed to their designated stacker 220, 221.

Figure 15:
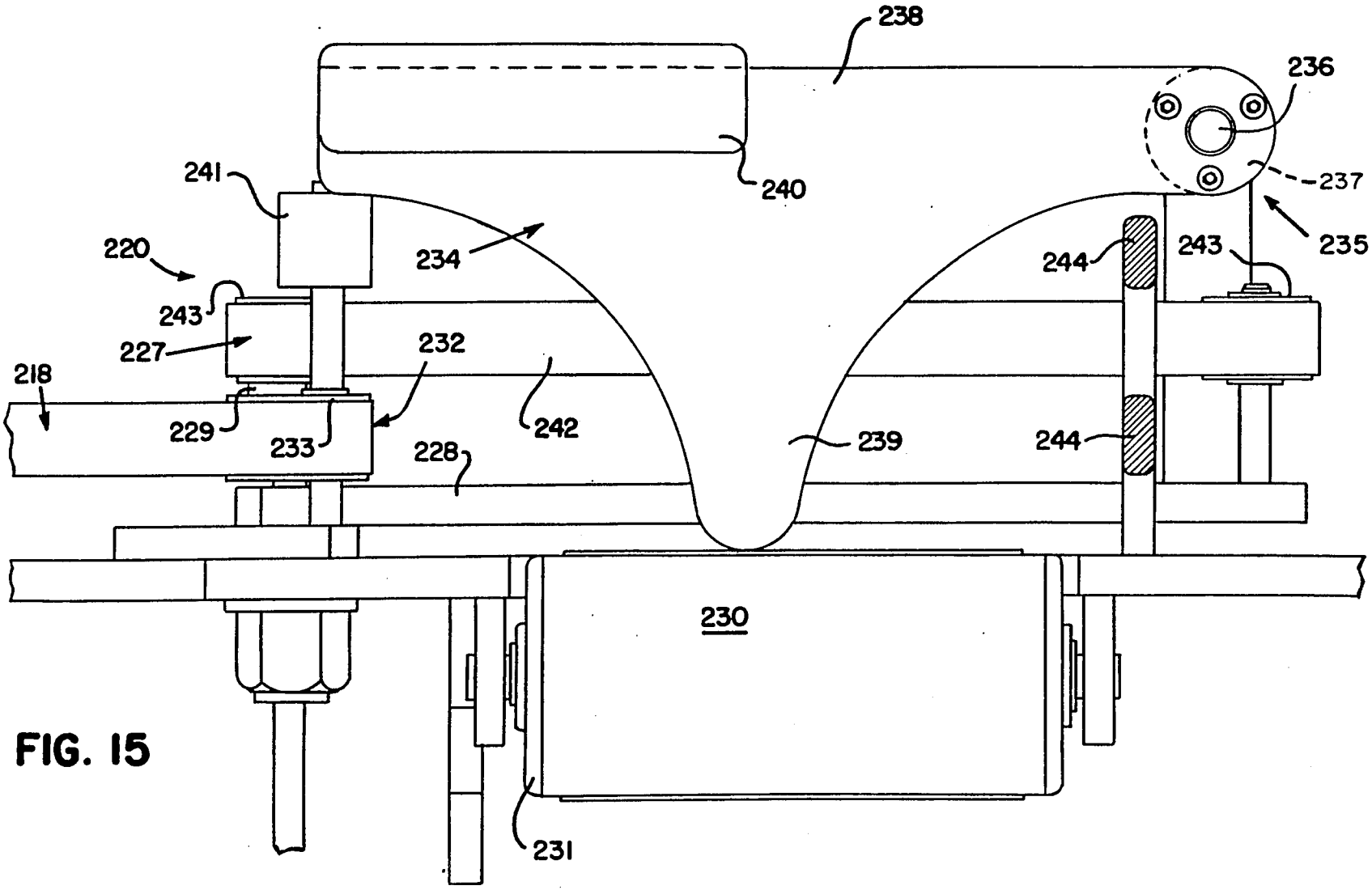
FIG. 15 is an end elevational view of the stacking mechanism of the reject trays.
Figure 16:
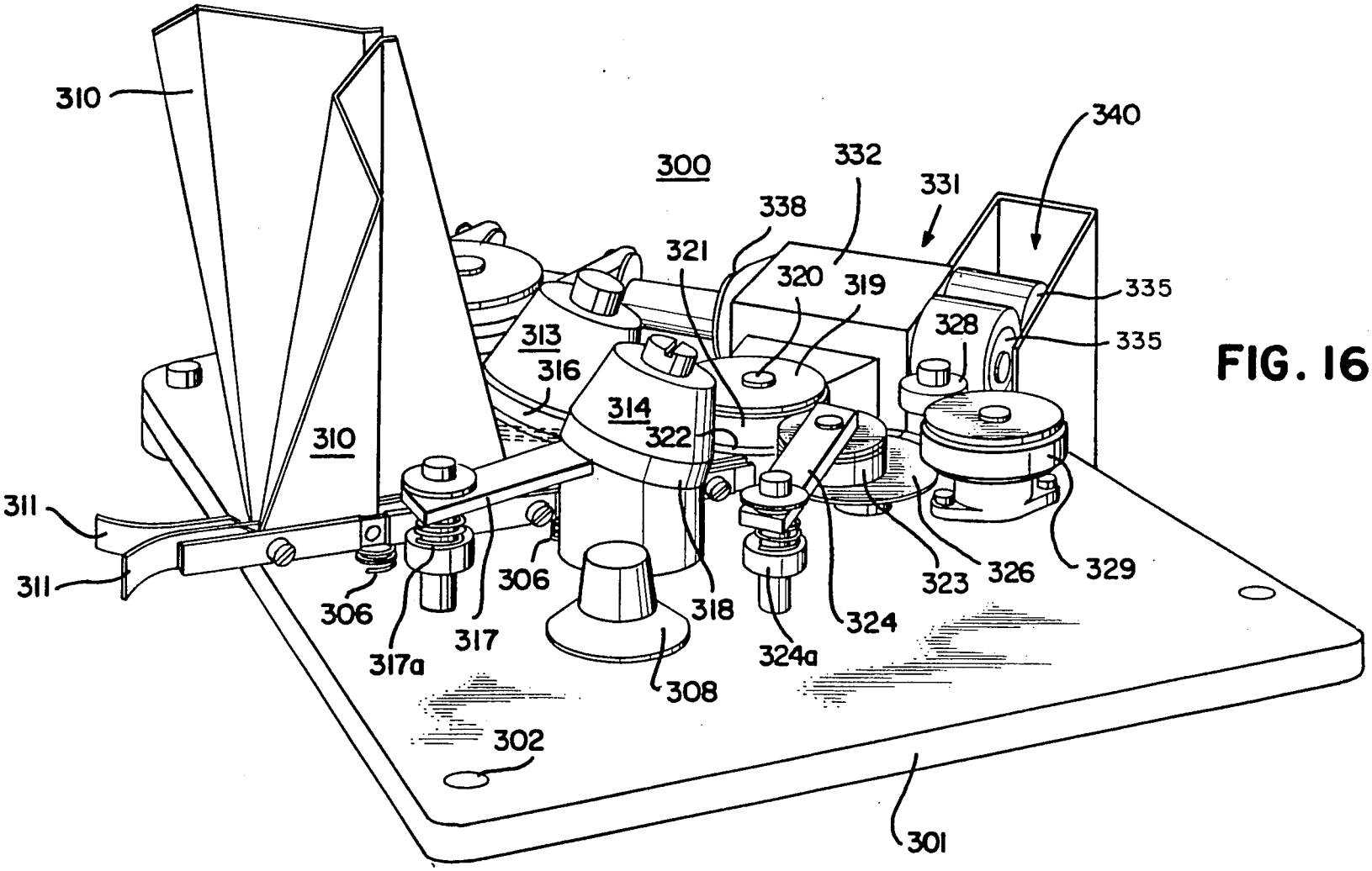
FIG. 16 is a perspective view of a cutting head for use in the cutting station of the apparatus.
Figure 17:
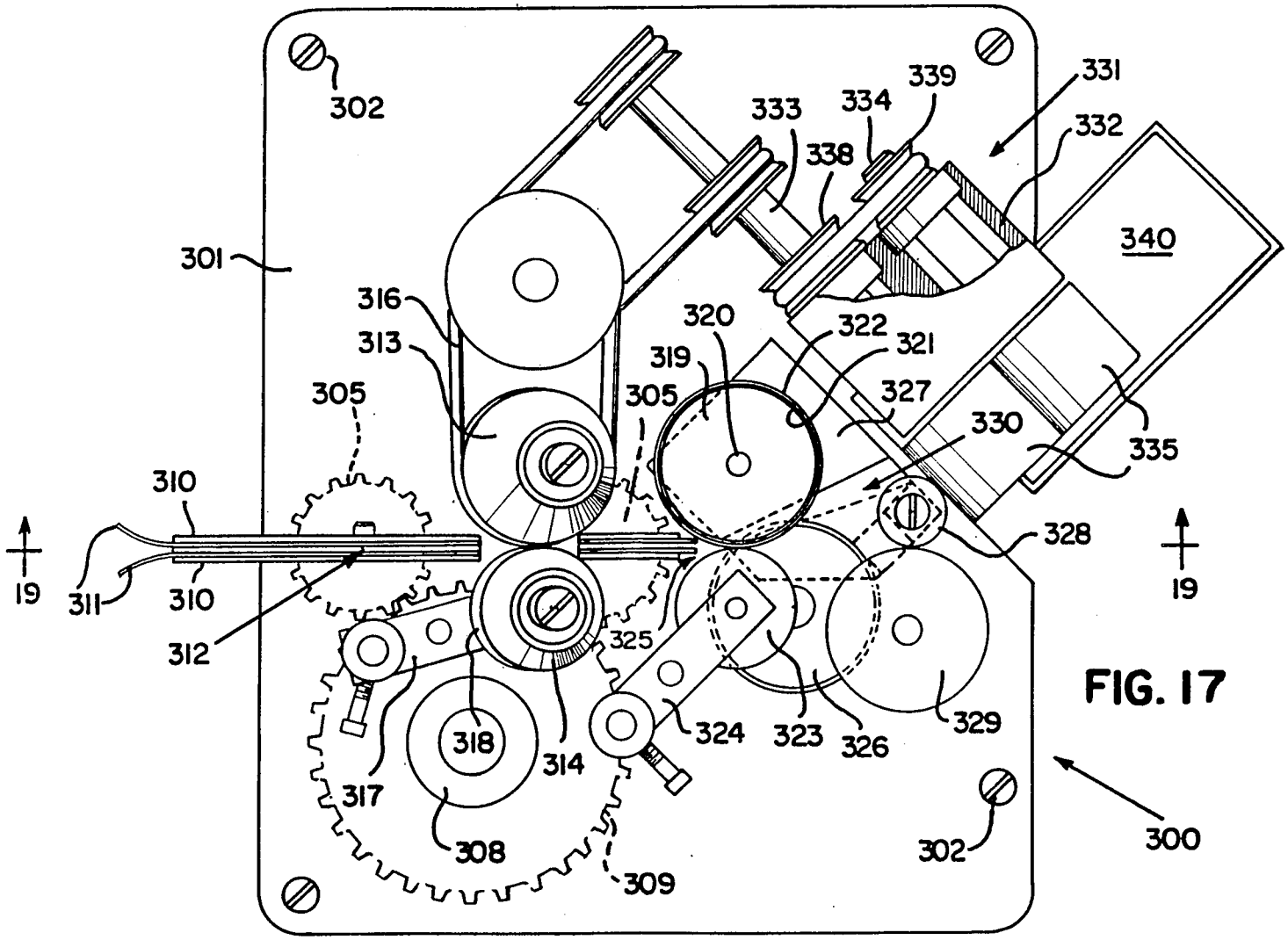
FIG. 17 is a top plan view of the cutting head.

Envelopes directed to the stacker 220 will be received in a nip 226 developed between the belt system 218 and an opposing belt system 227. Referring to FIGS. 14 and 15, the belt system 227 is dynamically mounted to a frame 228 which is adapted to rotate about a pivot 229, and which extends over a receiving conveyor 230 disposed upon a pair of rollers 231 journalled for rotation within the reject tray 6. Accordingly, envelopes received from the belt systems 217, 218 are capable of being transferred to the conveyor 230 as the envelopes exit from between the belt systems 218, 227, at 232. An adjustable idler roller 233 defines the exit 232 from between the belt systems 218, 227, to make sure that the rejected envelope is positively driven toward the conveyor 230 as will be described more fully below.

Envelopes passed from between the belt systems 218, 227, at 232, are transferred to the conveyor 230 so that the resulting stack of envelopes 224 are retained in an essentially vertical orientation between the belt system 227 and the stacker bar 234 of a stacker carriage assembly 235. Carriage assembly 235 generally includes a carriage 236 which is fixed in position just beyond the side edge of the reject tray 6, and a guide block 237 for slidingly engaging the carriage 236 and for receiving the stacker bar 234.

As best shown in FIG. 15, the stacker bar 234 includes a face portion 238 for receiving envelopes and a depending lug 239 which is adapted to rest upon the conveyor 230. The lug 239 serves to retain the stacker bar 234 in position to support the envelopes in their desired vertical orientation, and to drive the stacker bar rearwardly in synchronization with rearward movement of the conveyor 230. Accordingly, the carriage assembly 235 is a passive unit which is capable of reliably receiving envelopes transferred to the conveyor 230 (held in position by contact between the lug 239 and the surface of the conveyor 230), while facilitating the removal of stacked envelopes from the conveyor 230 in a simple, straightforward procedure. To this end, the stacker bar 234 includes a handle 240 which enables the sacker bar 234 to be lifted in the course of removing envelopes from the stacker 230, moved forward along the carriage 236, and placed back into the stack of envelopes so that the stacker bar 234 is placed behind the stack of envelopes then being developed. At this point, contact between the lug 239 of the stacker bar 234 and the face of the conveyor 230 again secures the stacker bar 234 in proper position for receiving additional envelopes, and readies the segregated envelopes for removal from the stacker 230.

To make sure that the received envelopes are stacked reliably and in an organized fashion, special steps are preferably taken to interface the belt system 227 with the remainder of the stacker 220, as follows. For example, to make sure that the received envelopes are reliably passed from the exit 232 to the stack of envelopes 224 then being developed against the stacker bar 234, steps are preferably taken to pass the envelopes from the exit 232 and between the belt system 227 and the stack of envelopes 224 along a straight line which generally conforms to the belt 242 of the belt system 227. To this end, the envelopes are preferably temporarily corrugated (curled) as they make this transition, which is advantageously accomplished by providing an additional idler roller 241 (FIG. 15) above the terminating idler roller 233 of the belt system 218, so that adjustment of the idler rollers 233, 241 which respect to the belt 242 of belt system 227 develops an overlap at this interface, produced the desired corrugation effect.

To further assist in providing a reliable, organized stack of envelopes, belt system 227 includes a pair of rollers 243 which cause the belt 242 to progress generally parallel with the stacker bar 234 and between a pair of guide bars 244, for an extended distance along the envelope stack 234. Preferably, this distance exceeds the distance between the envelope edges which contact the guide bars 244, and the so-called "spine" of the envelope stack (the point of greatest envelope thickness). This, along with the passive configuration of the carriage assembly 235 which receives the stacker bar 234, has been found to provide an aligned stack of uniform density irrespective of the length of the stack developed. The extended, parallel disposition of the belt 242 of the belt system 227 and the stacker bar 234 of the carriage assembly 235 serves to positively drive the received envelopes into registration with the conveyor belt 230 and the edge guiding bars 244, without deformation at the leading envelope edges, or fanning at the trailing envelope edges. The corrugating rollers 233, 241 serve to make sure that subsequent envelope does not get passed behind a proceeding envelope before the trailing edge of the leading envelope is moved out of the way as he envelope is received between the belt 242 of the belt system 227 and the envelope stack 224.

Uniform stack density is further assured by dynamically balancing movement of the belt system 227 and retraction of the conveyor 230 (along with the passively responsive stacker bar), to allow careful control of the pressure developed by the envelope stack 224 against the belt system 227 and the stacker bar 234 which contain it. To this end, a microswitch 245 is positioned so that the wiper 246 of the microswitch 245 will contact the frame 228 of the belt system 227 in accordance with rearward movement of the belt system 227 against the biasing forces of an appropriate spring, as envelopes are received upon the conveyor 230. By operating the conveyor 230 responsive to signals received from the microswitch 245, retraction of the conveyor 230 and the associated stacker bar 234 is dynamically controlled to provide a uniformly stacked series of envelopes, as is preferred.

Stacker 221 is essentially identical in structure and operation to the stacker 220. Accordingly, envelopes directed to the stacker 221 will first be received in a nip 247 developed between an opposing pair of belt system 248, 249, whereupon the envelopes exiting from between the belt systems 248, 249 will be delivered to a nip 251 developed between the belt system 249 and a dynamically operated belt system 250 similar to the belt system 227 of the stacker 220. From this point, the envelopes will proceed to the reject tray 7, for removal as desired.

As a result of the foregoing, envelopes which are not to be processed through the apparatus will be received and retained within the reject trays 6, 7, for eventual removal to other stations which are appropriate for the handling of oversized contents or contents which have been joined by staples or paper clips. Envelopes which have been determined to contain invoices and checks for payment will be delivered from the sorting station 27 at the output 225.

EDGE-SEVERING STATION

Envelopes received from the output 255 of the sorting station 27 are then ready for processing for the extraction of their contents. The first step toward extraction is to sever one or more edges of the envelope, to expose the contents lying between the envelope's faces. Although a variety of severing schemes may be devised in accordance with the present invention, it is preferred to sever the envelopes along three edges such that the top and bottom (longitudinal) edges are both severed, and so that the leading side edge is also severed. This leaves the contents sandwiched between separated envelope faces, which are maintained in spaced relation to one another by the remaining, intact trailing edge of the envelope being processed. To accomplish this, the edge-severing station 28 makes use of a series of three essentially separate severing operations which cooperate to serially sever the desired edges and orient the envelope for subsequent extraction operations to proceed. Details of the edge-severing station 28 will be described more fully below.

In developing the edge-severing station 28, it has been found to be particularly useful to provide a system wherein each of the three severing operations may be accomplished by a universal edge-cutting head which is configured for interchangeable placement at each of the three edge-severing locations. Such a cutting head 300 is illustrated in FIGS. 16–19.

The cutting head 300 is generally constructed upon a mounting plate 301 having a series of apertures 302 which enable the cutting head to be mounted at various locations along the edge-severing station 28, and in various different orientations as will become apparent from the description which follows. Extending over leading portions of the mounting plate 301 is a reference surface 303 which is used to receive the lowermost edge of an envelope to be processed, and to guide the lower edge through the cutting head 300 and to the means which are provided to sever the guided edge from the body of the envelope.

Reference surface 303 is operatively connected to the mounting plate 301 by a pair of threaded studs 304 which are fixedly connected to the reference surface 303, and which slidingly extend through the mounting plate 301. A gear 305 threadingly engages each of the studs 304, just beneath the mounting plate 301. A spring 306 surrounds each of the studs 304 and extends between the reference surface 303 and the mounting plate 301 so that the reference surface 303 is biased away from the mounting plate 301. As a consequence of this, separate rotation of the gears 305 serves to trim the reference surface 303, preferably so that it is parallel with the mounting plate 301 and the complementary structures of the edge-severing station 28.

Also extending through the mounting plate 301 is a shaft 307 which receives an adjustment knob 308 positioned over the mounting plate 301 and a gear 309 positioned below the mounting plate 301 and engaging each of the gears 305. As a consequence of this, rotation of the adjustment knob 308 causes rotation of the gear 309, in turn causing uniform rotation of each of the gears 305. This serves to uniformly raise and lower the reference surface 303 in accordance with rotation of the adjustment knob 308, providing an adjustment feature. The gear 309 is preferably relatively large in relation to the gears 305 so that only a single turn of the adjustment knob will be sufficient to cause a significant adjustment of the reference surface 303. By marking the mounting plate 301 with an appropriate scale, calibrated adjustment of the cutting head 300 is permitted, to adapt the cutting head 300 to its location within the edge-severing station 28, and to regulate the amount of material which is to be severed from the envelope's edges.

Extending upwardly from the reference surface 303 are a pair of guides 310 which converge from extended ends 311 to a containment 312 which proceeds along the reference surface 303. Positioned along the containment 312 are an opposing pair of conical rollers 313, 314 which progress generally downwardly toward the reference surface 303 of the cutting head 300. Conical roller 313 is journalled for fixed rotation responsive to a drive belt 316 which additionally develops a frictional surface at the periphery of the roller 313. Conical roller 314 is movable with respect to the roller 313, and is pivotally connected to the reference surface 303 by an idler are 317 which is biased into contact with the roller 313 by an appropriate spring 317*a*. The periphery of the roller 314 may additionally be provided with a frictional band 318. Accordingly, rotation of the roller 313 by the drive belt 316 causes an envelope to progress through the containment 312 so that, in cooperation with the roller 314, the envelope is frictionally engaged by the bands 316, 318 and urge in a generally downward direction, into contact with the reference surface 303. This serves to justify the lowermost edge of the envelope for subsequent edge severing. To be noted is that the rollers 313, 314 operate to develop a point contact with the envelope passing through the containment 312, allowing the envelope to rotate slightly as it passes through the containment. This serves to avoid crushing of the leading edge of the envelope during this transition.

To accomplish edge severing, a roller 319 is journalled for rotation upon a fixed shaft 320 so that its peripheral surface 321 provides a frictional surface for engaging the envelope which is exiting the containment 312. A cutting wheel 322 is coaxially and horizontally disposed beneath the roller 319, in general alignment (slightly raised) with the reference surface 303. A frictional roller 323 is pivoted for rotation at 324, and is biased into engagement with the frictional surface 321 of the roller 319 under the influence of spring 324*a*. Consequently, rotation of the roller 319 causes an envelope to be drawn through the nip 325 which is developed between the rollers 319, 323. Extending just beneath the roller 323 and the cutting wheel 322 is a second, freely rotating cutting wheel 326 which is vertically spring biased into contact with the cutting wheel 322 such that an envelope edge which is being drawn between the cutting wheels 322, 326 is severed from the envelope. Consequently, as the envelope is drawn between the rollers 319, 323, the edge of the envelope is severed between the cutting wheels 322, 326 in accordance with the penetration which is established by the adjusted distance ("d" in FIG. 19) between the reference surface 303 and the nip of the cutting wheels 322, 326. To be noted is that this adjustment mechanism eliminates the need for adjustable cutting wheels, greatly simplifying the resulting structures.

The resulting edge severing removes a desired edge from the envelope being processed, and produces an edge sliver. To accommodate these items, a guide block 327 is positioned immediately beneath the cutting wheel 322 associated with the roller 319, so that the guide block 327 is pivotable about the shaft 320. To prevent the entrainment of edge slivers between the guide block 327 and the cutting wheel 322, essentially no space is left between the guide block 327 and the adjacent cutting wheel 322. The guide block 327 extends outwardly, and then upwardly to receive an idler roller 328 which is placed in alignment with a driven roller 329 positioned on the opposite side of the envelope transport path. The guide block 327 is spring biased so that the idler roller 328 is urged into contact with the driven roller 329, serving to pull the edge-severed envelope through the cutting head 300, and serving to keep the envelope level as it progresses through and exits the cutting head 300 (particularly after it exits the conical justification rollers 313, 314), for improved stability. The guide block 327 is additionally provided with a chip guiding channel 330 which serves to receive the sliver severed from the envelope and direct the sliver outwardly and away from the envelope transport path.

After removal, the severed sliver may simply be disposed of in an appropriate container. However, it has been found that such slivers (particularly those produced from the longitudinal edges of the envelopes) tend to accumulate rather quickly, in a "hay stack" fashion. To eliminate this problem and significantly increase the amount of time between waste emptying procedures, the cutting head 300 is additionally provided with a chip breaking device 331 which serves to break the severed slivers into smaller pieces which are more appropriate for waste handling purposes.

Figure 18B:
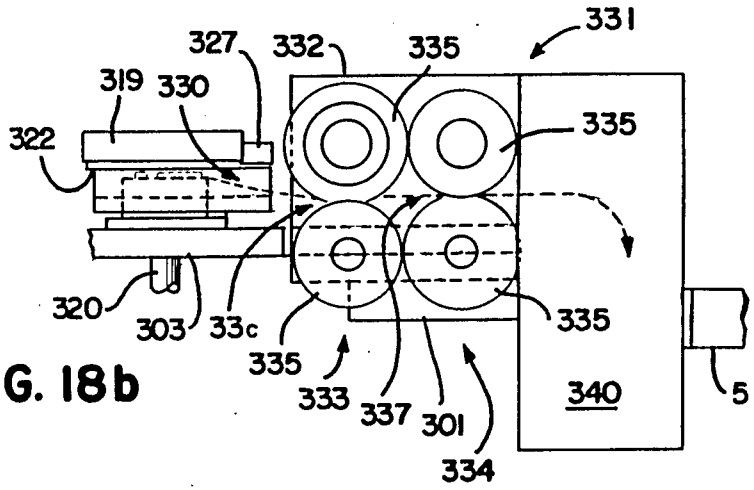
FIG. 18*b* is a partial, side elevational view of a chip breaking device for the cutting head.
Figure 18A:
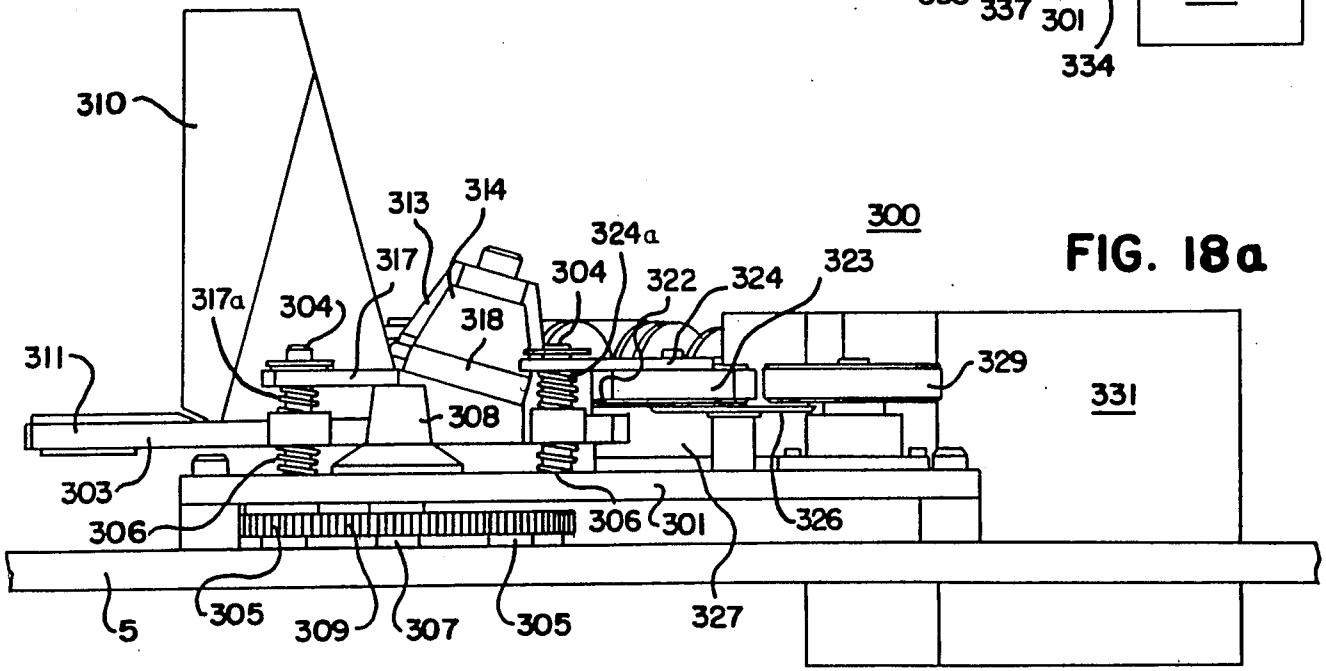
FIG. 18*a* is a side elevational view of the cutting head.

The chip breaking device 331 generally comprises a fixture 332 which is positionable upon the mounting plate 301 adjacent to the chip guiding channel 330. Referring specifically to FIG. 18*b*, the fixture 332 includes a series of shaft pairs 333, 334 which are journalled for rotation about axes which are generally parallel to the mounting plate 301, and the ends of the shaft pairs 333, 334 which are in general alignment with the chip guiding channel 330 are provided with frictional rollers 335 which develop a pair of nips 336, 337 for receiving severed slivers (dotted lines) from the chip guiding channel 330. The opposite ends of the shaft pairs 333, 334 are provided with pulleys 338, 339 which are commonly driven from one of the shafts of the leading shaft pair 333. The pulleys 338 associated with the leading shaft pair 333 are larger in diameter than the pulleys 339 associated with the trailing shaft pair 334 so that the rollers 335 associated with the shaft pair 334 will rotate at a greater speed than the rollers 335 associated with the shaft pair 333. Consequently, slivers severed from the envelopes will be directed through the series of frictional rollers 335 so that the faster moving rollers associated with the shaft pair 334 will, in essence, tear the slivers apart as they exit from the slower moving rollers 335 of the shaft pair 333. This produces significantly smaller chips, which are then appropriately discarded at 340.

As previously mentioned, edge-severing station 28 incorporates a series of three such cutting heads 300 to sever three separate edges of the envelopes being processed. The manner in which this is accomplished will now be discussed in further detail, with reference to FIGS. 20–23.

Figure 20A:
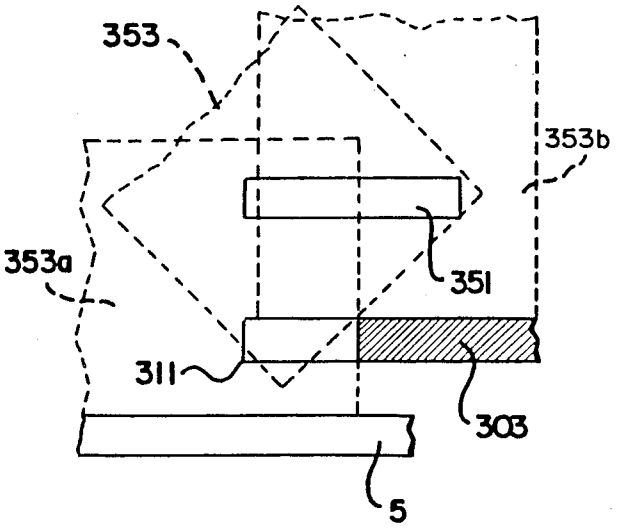
FIG. 20*a* is a schematic sectional view showing movement of an envelope within the edge-severing station.
Figure 19:
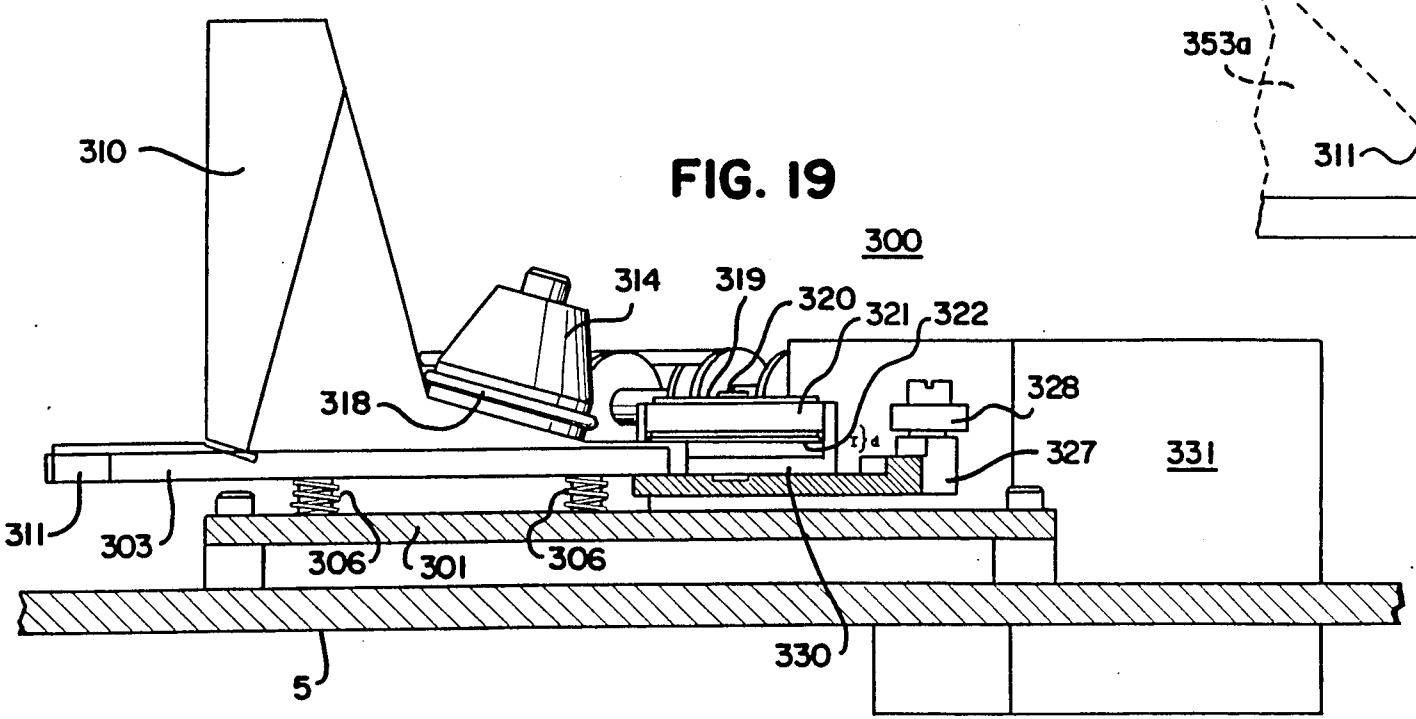
FIG. 19 is a sectional view of the cutting head, taken along line 19—19 of FIG. 17.
Figure 20:
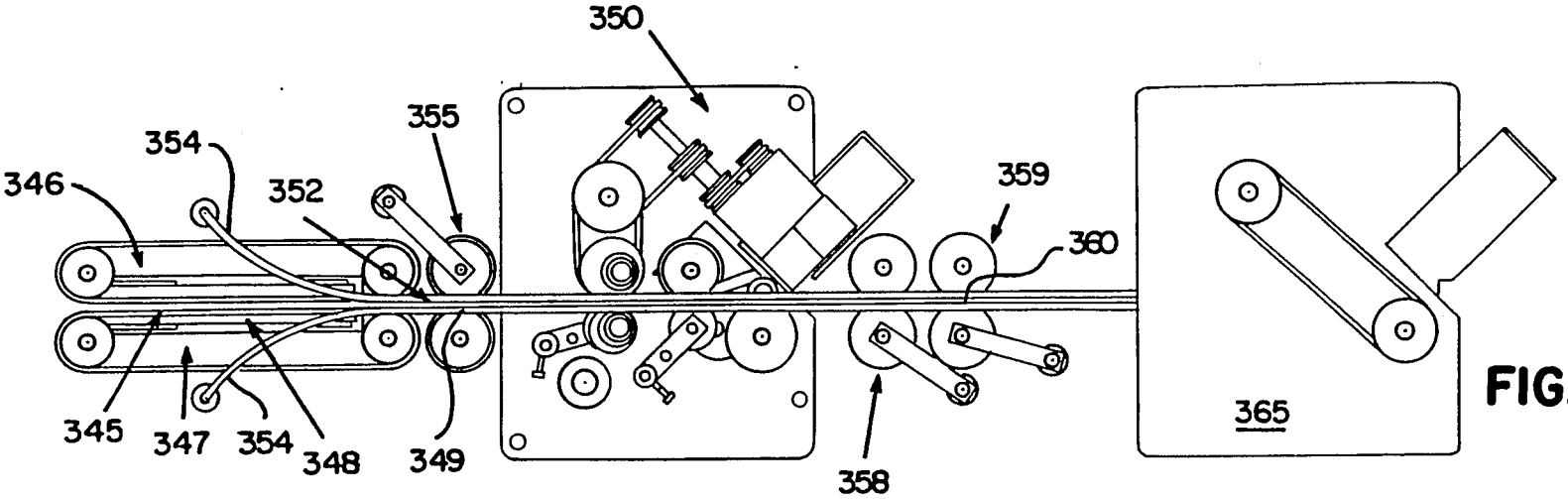
FIG. 20 is a top plan view of portions of the edge-severing station of the apparatus.
Figure 21:
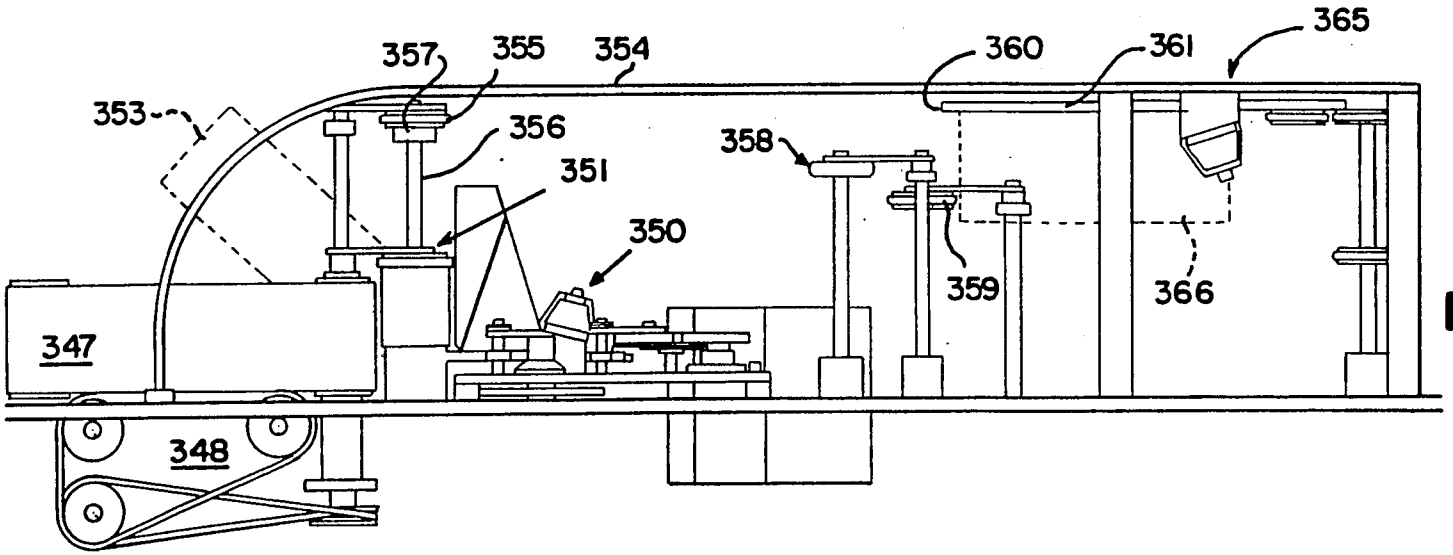
FIG. 21 is a side elevational view of the portions of the edge-severing station shown in FIG. 20.
Figure 22:
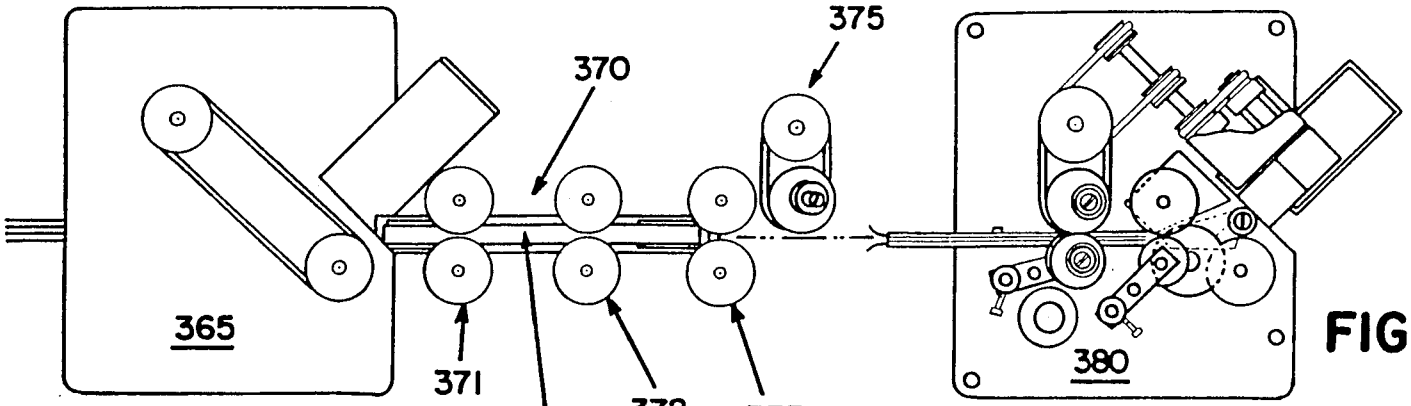
FIG. 22 is a top plan view of the remaining portions of the edge-severing station.
Figure 23:
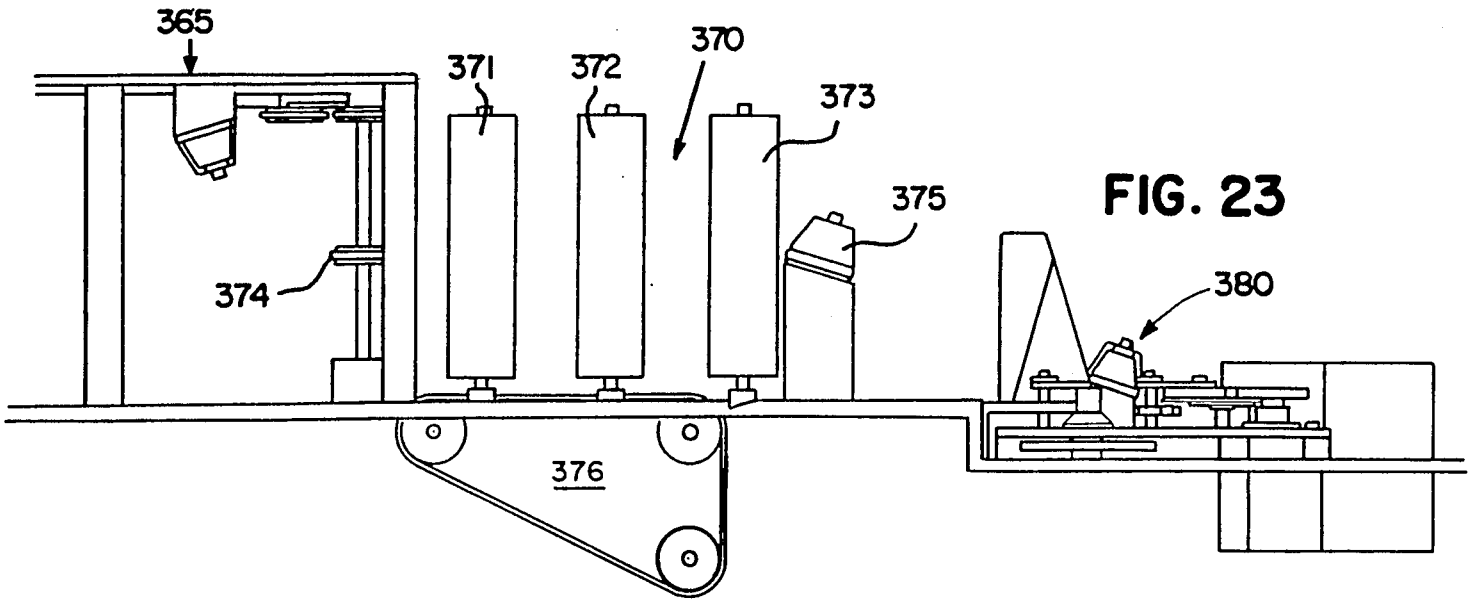
FIG. 23 is a side elevational view of the portions of the edge-severing station shown in FIG. 22.

Referring to FIGS. 20 and 21, envelopes exiting the sorting station 27, at 255, are first delivered to a containment 345 which is defined between an opposed, vertically disposed pair of belt systems 346, 347 and over a horizontally disposed belt system 348. As a consequence of this, envelopes are received within the edge-severing station 28 in a manner which urges the envelopes generally forward through the edge-severing station 28, without frictionally engaging the envelopes. This continues until the envelopes are brought into contact with an abutment surface 349 which is defined by the leading edge of the reference surface 303 of a first cutting head 350 which is raised somewhat from the base of the processing unit 5, as is best shown in FIG. 21.

Also positioned in advance of the first cutting head 350 are a pair of rollers 351 which develop a nip 352 which is in general alignment with the ends 311 of the guides 310 of the cutting head 350. One of the rollers 351 is a fixed, driven roller which cooperates with a movable, idler roller (on the opposite side of the transport path) to engage an envelope as it enters the guides 310 and contacts the abutment surface 349. As a consequence of such structure, as an envelope progresses through the containment 345, the leading edge of the envelope contacts the abutment surface 349 and is simultaneously engaged by the rollers 351. Beause the rollers 351 are off-set from the abuttment surface 349, the envelope is caused to rotate about the corner of the abutment surface 349, raising the envelope as shown in phantom in FIG. 21, at 353. As shown in FIG. 20*a*, this serves to raise a generally horizontally disposed envelope 353*a* to a generally vertical position 353*b*.

As the envelope is raised to this generally vertical position, two structures cooperate to assist the envelope in achieving and remaining in this orientation. First, a pair of wire guides 354 develop a containment to support upper portions of the envelope in its movement through the edge-severing station 28. Additionally, a second pair of rollers 355 are placed in general vertical alignment with the rollers 351. One of the rollers 355 is a fixed roller, driven on a common shaft 356 with the driven roller of the roller pair 351, and operating in cooperation with an opposing, movable idler roller. Thus, the rollers 355 additionally serve to retain the envelope in its desired vertical orientation, and to urge the vertically disposed envelope toward the cutting head 350. To be noted is that the driven roller of roller pair 355 is associated with the common shaft 356 by a one way clutch 357 which may be overdriven only in the forward direction. Thus, the clutch 357 enables the envelope to push forward through the rollers 355 as the envelope is rotated about the abutment surface 349, while preventing rearward movement of the envelope.

It has been found that as processing rates increase, the envelopes tend to "bounce" off the abutment surface 349, within the containment 345, in the course of being rotated to their vertical orientation. By preventing rearward movement of an envelope, the roller pair 355 serves to ameliorate the effects of such bouncing since the envelope will be drawn horizontally forward, back into contact with the abutment surface 349, as the envelope proceeds through the rotation procedure.

Upon achieving its desired vertical orientation, the envelope is then delivered to the first cutting head 350, in turn severing the leading side edge of the envelope. Again, the wire guides 354 serve to support the envelope in its desired position during this severing procedure. The roller pair 355 serves to assist in horizontal transport of the envelope as the envelope progresses through the cutting head 350, against the justification surface 303.

The vertically disposed, edge-severed envelopes are then delivered to a series of roller pairs 358, 359, each having a driven roller and an idler roller in operative combination with one another. Roller pair 359 develops a nip which is in general alignment with an abutment surface 360 which is developed by an extension 361 of the reference surface 303 of a second cutting head 365. Cutting head 365 is mounted so that its mounting plate 301 is spaced from the base of the processing unit 5, with the operating mechanism of the cutting head 365 being inverted with respect to the operating mechanism of the cutting head 350. As a consequence of interaction between the roller pair 359 and the abutment surface 360, the generally vertically disposed envelope is caused to rotate about the corner of the abutment surface 360 so that the top edge of the envelope is brought into contact with the reference surface 303 of the cutting head 365, as shown in phantom at 366.

Care must be taken to make sure that envelopes of different sizes will be properly passed between the cutting head 350 and the cutting head 365. To this end, roller pair 358 is provided. Unlike other rollers in the system, the rollers of roller pair 358 are formed of a hard, relatively low-friction (smooth plastic or metal) material. As a result of this, although the roller pair 358 is configured to develop a nip for engaging envelopes, the resulting nip is a relatively low-friction one, enabling sliding movement as the envelopes rotate about the corner of the abutment surface 360. Consequently, relatively small envelopes which are delivered from the cutting head 350 will be assisted in their movement toward the primary roller pair 359 by the roller pair 358, readying such envelopes for rotation toward the cutting head 365. Moreover, while not sufficient to hinder rotation of the envelopes, the slight retention forces developed by roller pair 358 will serve to retain the envelopes in proper position as the envelopes are raised to the cutting head 365.

To take advantage of the foregoing structure, the distance between the cutting head 350 and the cutting head 365 is adjusted to accept the largest (longest) envelope which the apparatus 1 is to handle. The larger envelopes are rotated under the influence of roller pair 359, after being released by the cutting head 350. Smaller envelopes are maintained vertically and passes to the roller pair 359 by the roller pair 358, for similar rotation under the influence of roller pairs 358, 359. Cooperating roller pairs are used to provide these functions since bottom guides would be ineffective at this interface, due to the rotation which is required to bring the envelopes into position for delivery through the second cutting head 365. To be noted is that the vertical positioning of the roller pair 358 is important in that this distance should be selected so as to accommodate all types of envelopes being processed through the apparatus, while minimizing the potential for gravitational rotation. Accordingly, the roller pair 358 is preferably positioned at a height which is approximately midway between the center of gravity of the largest and smallest envelopes which can be expected to be processed through the apparatus.

Upon being rotated (lifted) to the reference surface 303 of the second cutting head 365, the envelope is drawn through the cutting head 365 as previously described, severing the top edge from the body of the envelope. Following this operation, and with reference to FIGS. 22 and 23, the twice-edge-severed envelope is discharged from the second cutting head 365 and delivered to a containment 370 which is defined by a series of opposing, fixed roller pairs 371, 372, 373. The purpose of the containment 370 is to allow the envelope to drop from the level at which it exits the second cutting head 365 to the level at which it is to enter a third cutting head 380. A number of considerations are noteworthy in traversing this containment.

First, to assist in a smooth transition from the cutting head 365 to the cutting head 380, it is desirable for the envelopes to gradually and uniformly (horizontally level) drop within the containment 370 so that the envelopes will be positioned upon the reference surface 303 of the cutting head 380 with their bottom edges approximately parallel to the reference surface. To this end, a roller pair 374 (including a driven roller and an idler roller) is positioned in general alignment with the output of the second cutting head 365, to cooperate with the rollers 328, 329 to generally horizontally direct envelopes from the cutting head 365. Roller pair 374 also serves to assure that the top edge is uniformly severed from the envelope, by avoiding possible drooping of the envelope as it traverses and eventually exits from the inverted cutting head 365.

Second, to actively drop the envelopes from the output of the cutting head 365 to the input of the cutting head 380, a pair of conical rollers 375 are provided. Conical rollers 375 (which include a driven roller and an idler roller) are positioned downstream from the containment 370, at a distance which will normally result in a hand-off of the relatively larger envelopes from the roller pair 374 to the roller pair 375. However, the shorter envelopes will be released from the roller pair 374 before engaging the roller pair 375, and it is therefore expected that such envelopes will tend to drop slightly as they proceed through the containment 370 to eventually encounter the pair of conical rollers 375. This drop does not adversely affect the hand-off of envelopes to the roller pair 375, since the roller pair 374 serves to maintain the envelopes in a generally horizontal orientation even in such cases. In the event that an envelope drops more quickly than is expected, a belt system 376 is provided to urge the dropped envelope forward within the containment 370 until such time as the conical rollers 375 are engaged. In any event, the conical rollers 375 serve to draw the received envelope downwardly, to place the bottom edge of the envelope in general alignment with the reference surface 303 of the third cutting head 380.

Third, because of the distance between the reference surface 303 of the cutting head 365 and the reference surface 303 of the cutting head 380, the height of the roller pairs 371, 372, 373 will exceed the height of the envelopes being processed. It is for this reason that roller pairs are used to develop the containment 370, rather than opposing belt systems, to allow envelopes within the containment 370 to be accessed in the event that their manual removal from the apparatus become necessary.

In traversing the third cutting head 380, the bottom edge of the envelope is severed so that what is discharged from the edge-severing station 28 is an envelope having three severed edges, and including contents which are positioned between two free envelope faces, but for the trailing edge of the envelope which remains intact. This serves to ready the contents for subsequent extraction without yet destroying the integrity of the envelope, which could result in the undesirable shifting of contents or envelope parts prior to their being received within the extraction station 29.

In describing the foregoing operations, it is seen that the edge-severing procedure involves a sequence of three separate operations including a first operation which severs the leading side edge of the envelope, a second operation which severs the top edge of the envelope, and a third operation which severs the bottom edge of the envelope. Three edge-severing operations are preferred since it has been found that the automated extraction process works best in connection with the severing of three envelope edges. Moreover, the particular sequence of severing operations described is preferred since it has been found that this sequence of operations serves to efficiently and reliably sever three edges of the envelope while making sure that the contents remain within the confines of the envelope throughout the edge-severing procedure. These aspects become particularly important in view of the automated nature of the apparatus of the present invention, and the significant rates at which envelopes may be processed through such an apparatus. However, it will be understood that different edge-severing devices, and sequences, could be developed if desired for a particular operation.

Figure 24:
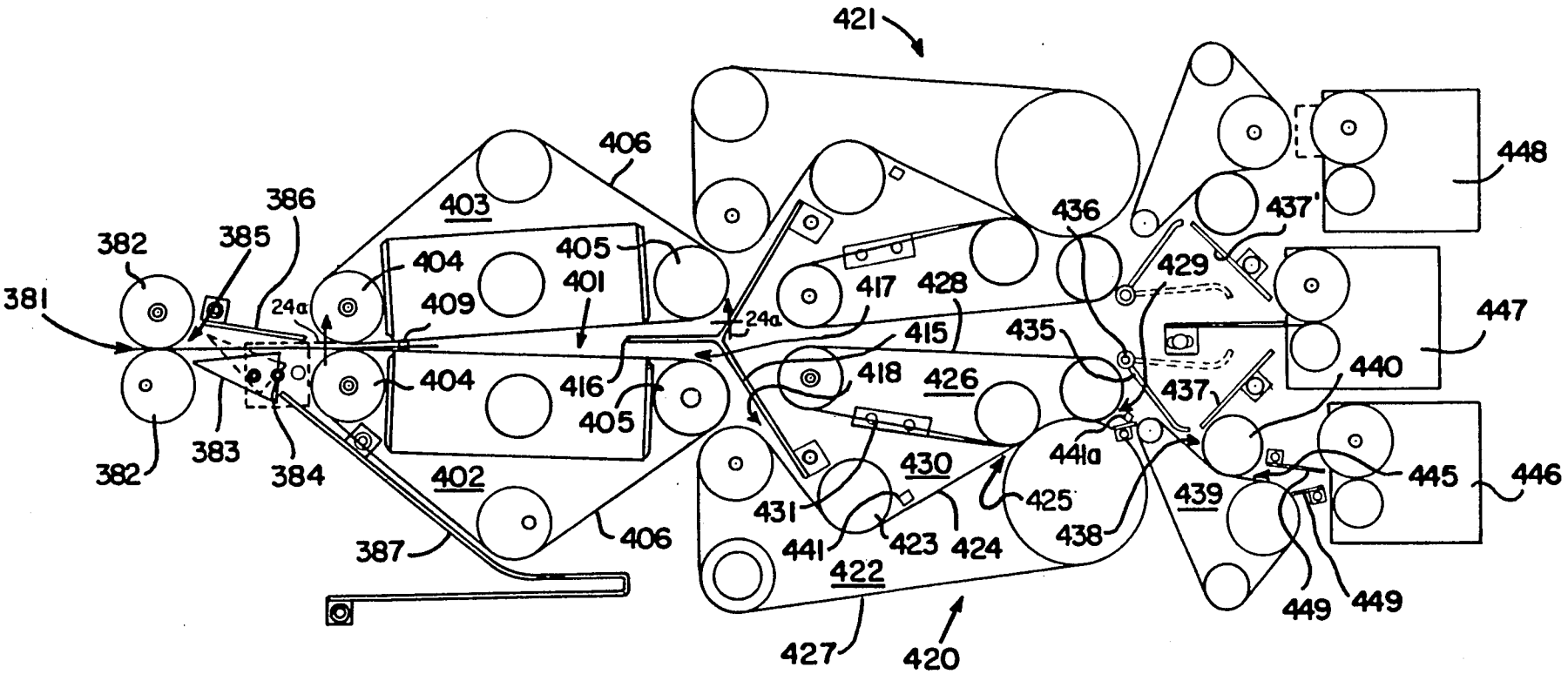
FIG. 24 is a top plan view of the extractor of the extraction station of the apparatus.

With reference to FIG. 24 of the drawings, the envelopes which are passed from the third cutting head 380 are received within a nip 381 defined between a pair of rollers 382 positioned just beyond the cutting head 380. Downstream from the rollers 382 is a deflector 383 which is pivotable at 384. When the deflector 383 assumes the position which is shown in solid lines, the encountered envelope is passed from the edge-severing station 28, at 385, with the assistance of a paper guide 386. When the deflector 383 assumes the position which is shown in phantom, the encountered envelope is diverted from the output 385, to a collector 387. Collector 387 serves to receive envelopes which are to be discharged from the edge-severing station 28, primarily for the clearing of jams which have occurred in the processing of envelopes as will be discussed more fully below.

EXTRACTION STATION

Figure 24A:
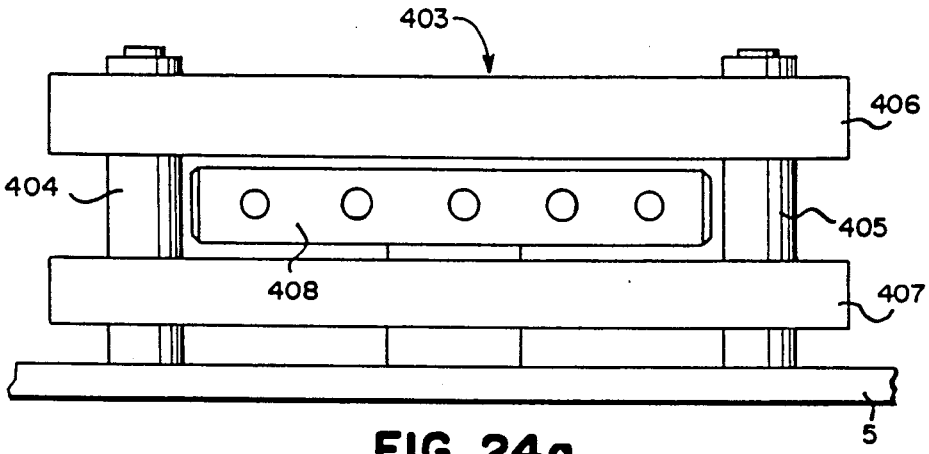
FIG. 24*a* is a partial, side elevational view of the vacuum shoe of the extractor, taken along line 24*a*—24*a* of FIG. 24.

Envelopes delivered from the output 385 of the edge-severing station 28 are then introduced to the extraction station 29 for the removal of contents. Referring to FIG. 24, the envelopes are delivered to a containment 401 which is developed between an opposing pair of belt systems 402, 403. Unlike previous containments, the containment 401 is configured to diverge from the rollers 404 which, in essence, develop the input to the extraction station 29, toward the rollers 405 which are located at the exit from the region 401. As shown in FIG. 24*a*, each of the belt systems 402, 403 includes paired belts 406, 407 which are disposed upon the rollers 404, 405 so that a space is developed between the upper belts 406 and the lower belts 407. This space receives a pair of vacuum shoes 408 which extend between the end most rollers 404, 405 of the belt systems 402, 403.

As previously indicated, the envelopes which are introduced to the containment 401 defined by the belt systems 402, 403 will have three severed edges, such that the envelope's faces and the contents sandwiched between them will progress from between the rollers 404 with all edges severed and free for separation. Consequently, as an envelope is passed between the vacuum shoes 408, the opposing faces of the envelope are capable of being drawn apart under the influence of a supplied vacuum. Preferably such separation is initially assisted by an air-jet, at 409. This results in the entrainment of one of the envelope's faces by the belt system 402, and the entrainment of the other of the envelope's faces by the belt system 403. The contents which are disposed between the envelope's faces will tend to collect against the envelope's faces in an essentially random fashion, either so that one of the documents contacts one of the envelope's faces while the other document contacts the other of the envelope's faces, or so that both documents contact the same envelope face, as the envelope is drawn through the containment 401. For reasons which will become apparent from the description which follows, it is not important that the contents necessarily be separated from one another at this interface.

In addition to causing separation of the envelope's faces, the vacuum shoes 408 also serve to draw the separated faces and any accompanying documents into contact with the belts 406, 407 of the belt systems 402, 403. This serves to draw the envelope portions and associated documents through the containment 401, toward a configured guide 41 which is centrally positioned within, and which extends from, the exit from the region 401. The leading edge 416 of the guide 415 is a beaded edge which proceeds at an incline from the base of the processing unit 5. Such structure is preferred for two reasons. First, as the envelope's faces, and eventually its contents, come into contact with the guide 415, it is important for such items to be reliably directed either in one direction or the other. What is to be avoided is the possibility of the leading edges of the envelope faces or contents hanging up on the leading edge 416 of the guide 415. This is particularly so with respect to the contents of the envelope, which may not be fully entrained by the vacuum developed by the vacuum shoes 408. A sloped, beaded leading edge has been found to assist in making sure that such items do not jam at the guide 415, even if the items which traverse the belt systems, 402, 403 are curved (curled) or bent (crimped). Second, as the opposing belt systems 402, 403 operate to draw the envelope and its contents through the containment 401, the remaining intact trailing edge of the envelope will eventually be caused to contact the guide 415 as the envelope leaves the region 401. The sloping, beaded leading edge 416 has been found to be useful in assuring that this intact trailing edge is reliably severed as it is drawn across the guide 415, to completely separate the envelope faces from one another.

Upon exiting the containment 401, the separated envelope faces and any entrained documents are passed from between the guide 415 and the opposing belt systems 402, 403 toward a pair of symmetrical, yet otherwise identical separation devices 420, 421 which serve to separate the documents (contents) from the envelope face or faces which entrain them. Since the separation devices 420, 421 are essentially the mirror image of one another, only the separation device 420 will now be described in further detail. The remaining separation device 421 would be essentially similar in both structure and operation.

The separated envelope face and any entrained contents are passed from between the guide 415 and the belt system 402, at 417, entering a corridor 418 defined between the guide 415 and a belt system 422. Items progressing through the corridor 418 are eventually received between the belt system 422 and a roller 423 which serves to draw the items along a defined transport path 424. These items are then delivered to an extended nip 425 which is developed between the belt system 422 and an opposing belt system 426 which is disposed on the opposite side of the transport path 424.

Figure 25:
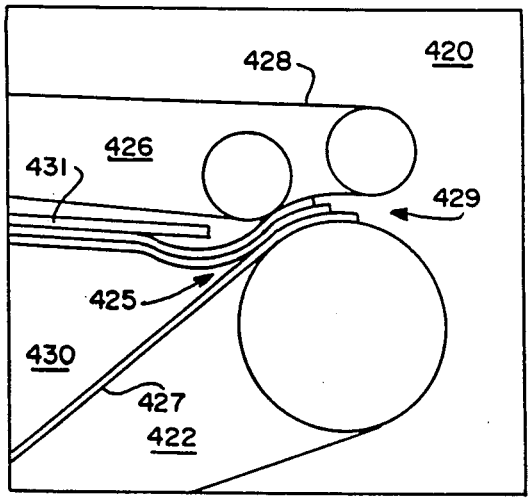
FIG. 25 is a partial, enlarged, top plan view of the separation device of the extractor, illustrating the separation function.

The belt 427 of the belt system 422 has a relatively high coefficient of friction, and is caused to operate in a generally clockwise fashion. The belt 428 of the belt system 426 has a somewhat lesser coefficient of friction than the belt 427, and is ordinarily driven in clockwise fashion by the belt 427, thus approximating the speed of the belt 427. However, the belt system 426 is connected to a mechanism which is capable of stopping (braking) the belt system 426 at desired intervals. As a consequence of this, and with reference to FIG. 25, as the separated envelope face, and any entrained documents which are disposed adjacent to the separated envelope face, are received within the nip 425, braking of the retard belt system 426 may be used to stop the entrained contents as the envelope face progresses forward under the influence of the drive belt 427 of the belt system 422. To make sure that the envelope face is urged ahead of any associated contents, irrespective of the number and orientation of such contents, an extended nip 425 is developed between the belt systems 422, 426 to provide sufficient surface contact for the items being processed to assume their desired orientations.

In the course of shifting documents rearwardly with respect to the envelope face, which is moving with the belt 427, the stopped document (or documents) will tend to buckle (bunch up) in the region 430 which preceeds the nip 425 as the trailing end of the document continues to be driven by the roller 423. Thus, the region 430 serves to temporarily receive the excess portions of any documents which are being retarded within the nip 425. A guide 431 is provided to direct such items toward the nip 425 for entrainment while providing a containment area for the buckled document.

This procedure continues until a sufficient offset is developed between the envelope face and any entrained documents as they exit from between the belt systems 422, 426, at 429. As a consequence of the above-described procedure, the severed face of the envelope is caused to be the first item to exit from between the belt systems 422, 426, with any associated documents trailing behind. Referring again to FIG. 24, this is used to separate the envelope face from any contents which may be traversing the transport path 424, making use of a deflector 435 which is positioned just beyond the exit 429 from between the belt systems 422, 426. The deflector 435 is pivoted at 436 so that items exiting from between the belt systems 422, 426 are either passed from the exit 429 to a guide 437, when the deflector 435 assumes the position shown in phantom in FIG. 24, or to a nip 438 which is developed between a belt system 439 and a roller 440, when the deflector 435 assumes the position shown in solid lines in FIG. 24. As a consequence, by properly operating the deflector 435 in accordance with the passage of items through the separation device 420, it becomes possible to separate envelope faces from envelope contents, as follows.

Items entering the belt system 422 are sensed by a photodetection device 441. Since the belt system 422 and the roller 423 operate at known speeds, delayed signals received from the photodetection device 441 may be used to indicate when the leading edge of the items received will be entering the nip 425, to brake the belt system 426 to achieve friction separation as previously described, and when the sensed leading edge will be exiting from between the belt systems 422, 426, for presentation to the deflector 435. In the alternative, a photodetection device 441*a* may be placed just beyond the exit 429 to determine this latter event. In either case, the deflector 435 is initially caused to assume the position shown in solid lines in FIG. 24, so that the first item to be passed from the exit 429 is directed toward the belt system 439 and the roller 440. As a result of friction separation, this first item will be the severed face of the envelope. Responding to timing signals received from the photodetection device 441 (or the photodetection device 441*a*), the deflector 435 is then moved to the position shown in phantom in FIG. 24, so that any subsequent documents will be passed to the guide 437. As a consequence of this, the isolated envelope face will proceed from between the belt system 439 and the roller 440, at 445, while any envelope contents will be passed along the guide 437.

Figure 26:
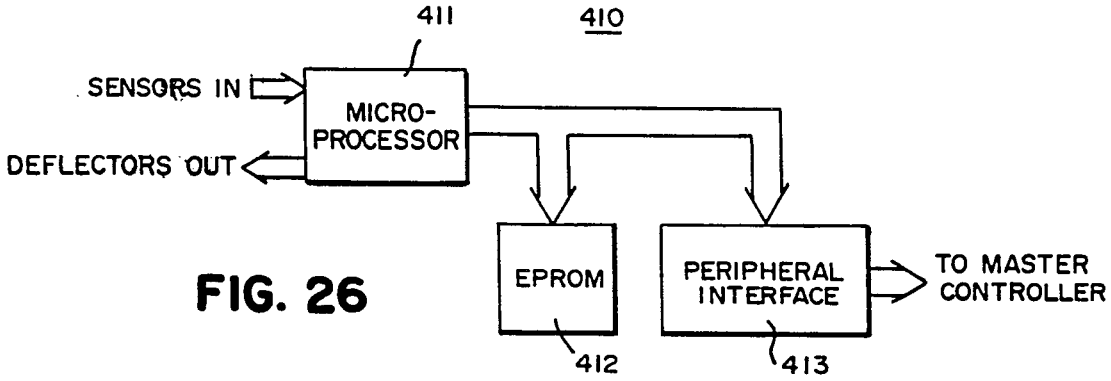
FIG. 26 is a schematic diagram showing a circuit for receiving and processing signals from the extractor, to achieve document separation.

A circuit for providing the above-described functions may be developed making use of the computer program disclosed in the microfiche appendix incorporated by reference, in the circuit 410 which is shown in FIG. 26. Circuit 410 includes a microprocessor 411 for receiving, processing and delivering signals in accordance with the previously described operational scheme, as embodied in EPROM 412, and a peripheral interface 413 for communicating with the remainder of the processing apparatus 1, and is preferably comprised of the following components.

| | |
|---|---|
| Microprocessor 411 | 8751H |
| EPROM 412 | HN482764 |
| Peripheral Interface 413 | 8255A |

To correctly interface the foregoing elements, a latch (8282) operatively couples the microprocessor 411 with EPROM 412.

The various items which have been processed by the separation devices 420, 421 as previously described are then introduced to a series of three thickness measuring devices 446, 447, 448. Preferably, the thickness measuring devices 446, 447, 448 are modular in construction, and are essentially identical to one another, and to the thickness monitoring device 100 of the scanning section 26. The thickness measuring device 446 is used to receive what is expected to be a separated envelope face from the separation device 420, which exits from between the belt system 439 and the roller 440. A pair of guides 449 are provided to assist this envelope face in passing from the exit 445 of the separation device 420 to the operative rollers of the thickness measuring device 446. The thickness measuring device 447 is positioned to receive documents passed along either the guide 437 of the separation device 420, or the guide 437' of the corresponding separation device 421. Thus, all separated documents are united and delivered to the operative rollers of the thickness measuring device 447, irrespective of the envelope face or faces which originally entrained them, completing the extraction process. Lastly, the thickness measuring device 448 is positioned similarly to the thickness measuring device 446, to receive what is expected to be the separated envelope face from the separation device 421.

The series of thickness measuring devices 446, 447, 448 operate to verify that the faces of the envelope, and its contents, have been effectively separated by the separation devices 420, 421, for further processing. Accordingly, thickness measuring device 446 operates to detect the thickness of what is expected to be a severed envelope face, as does the thickness measuring device 448. The thickness measuring device 447 operates to detect the thickness of what is expected to be the paired contents of the severed envelope, an invoice and an accompanying check.

These measurements are made by operatively connecting each of the thickness measuring devices 446, 447, 448 to electrical circuits similar to the circuit 120 shown in FIG. 10, which proceed in similar fashion to separately measure the thicknesses of the items being passed through the thickness measuring devices 446, 447, 448. However, because of certain differences in the parameters being analyzed, operation of the electrical circuits associated with the thickness measuring devices 446, 447, 448 is preferably modified in two ways.

First, regarding measurement of the envelope's faces, rather than comparing the assembled data to an empirically determined band of threshold values, the assembled data is preferably compared to an actual range of values determined according to the physical characteristics of the particular envelopes being processed through the extraction station 29, which can vary widely. To this end, a set number of envelopes (e.g. five envelopes) with known contents (test mail) are run through the extraction station 29, and the measured thicknesses for the items passed through the thickness measuring devices 446, 448 are averaged and retained. These retained averages are then used in the subsequent measurement of actual envelopes (live mail). Measurement of the envelope's contents is preferably accomplished based upon empirically determined values, for reasons of accuracy, although measured (dynamically determined) values could also be used for this purpose, if desired.

Second, although the manner in which the basic (point) data is initially tabulated remains unchanged, the tabulated data is preferably assembled by a straight average of all measured points, rather than a windowed average. Although windowed averaging techniques could be used if desired, such techniques are inherently slower, and are unnecessary to detect the relatively constant paper thicknesses to be measured (as distinguished from the transitions in thickness which must be detected by the thickness monitoring device 100).

Initially, the thicknesses which have been separately measured by the thickness measuring devices 446, 447, 448 are summed, to determine if all of the pieces of the envelope (and its contents) have successfully passed through the separation devices 420, 421. If not, this indicates that one or more items remains jammed in the separation devices 420, 421, and a violation is declared. Otherwise, the separately measured thicknesses are then analyzed, as follows.

If it is determined that nothing more than a single envelope face has passed through each of the thickness measuring devices 446, 448, and that two documents have passed through the thickness measuring device 447, the decision is made that an effective extraction has occurred, and the documents are passed on for further processing. If either of the thickness measuring devices 446, 448 measures a thickness which is less than the anticipated thickness of a severed envelope face (and an assigned tolerance), this indicates a lost envelope face and a violation is immediately declared. If either of the thickness measuring devices 446, 448 measures a thickness which exceeds the sum of the anticipated thickness of a severed envelope face and the average thickness of a sheet of paper (a document), it is possible that either of two conditions prevail. First, it is possible that the severed envelope face has become crimped or folded over itself, which is not deleterious to the contents of the envelope. Second, it is possible that envelope contents have not been effectively separated from the envelope face, and continue to pass along with it. For this reason, in such cases the thickness measuring devices 446, 448 essentially defer to the thickness measuring device 447. If the thickness measuring device 447 measures a thickness which is indicative of properly extracted contents, a decision is made that all contents have been effectively extracted and the various portions are then passed on for further processing. If an incorrect thickness is measured by the thickness measuring device 447, a decision is made that the extraction procedure was ineffective, and a violation is declared.

The above-described functions may be developed of making use of the computer program disclosed in the Appendix which accompanies this application, in a circuit (or circuits) similar to the electrical circuit 120 illustrated in FIG. 10.

If it is decided that the extraction procedure was successful, the contents are delivered from the extraction station 29 and the envelope faces are discarded. If it is decided that the extraction procedure was unsuccessful, the extraction station 29 operates to re-unite the contents with the severed envelope faces, preferably in the same orientation as such items had before the envelope was severed, and to divert the re-oriented envelope from further processing. This is accomplished as follows.

Figure 27:
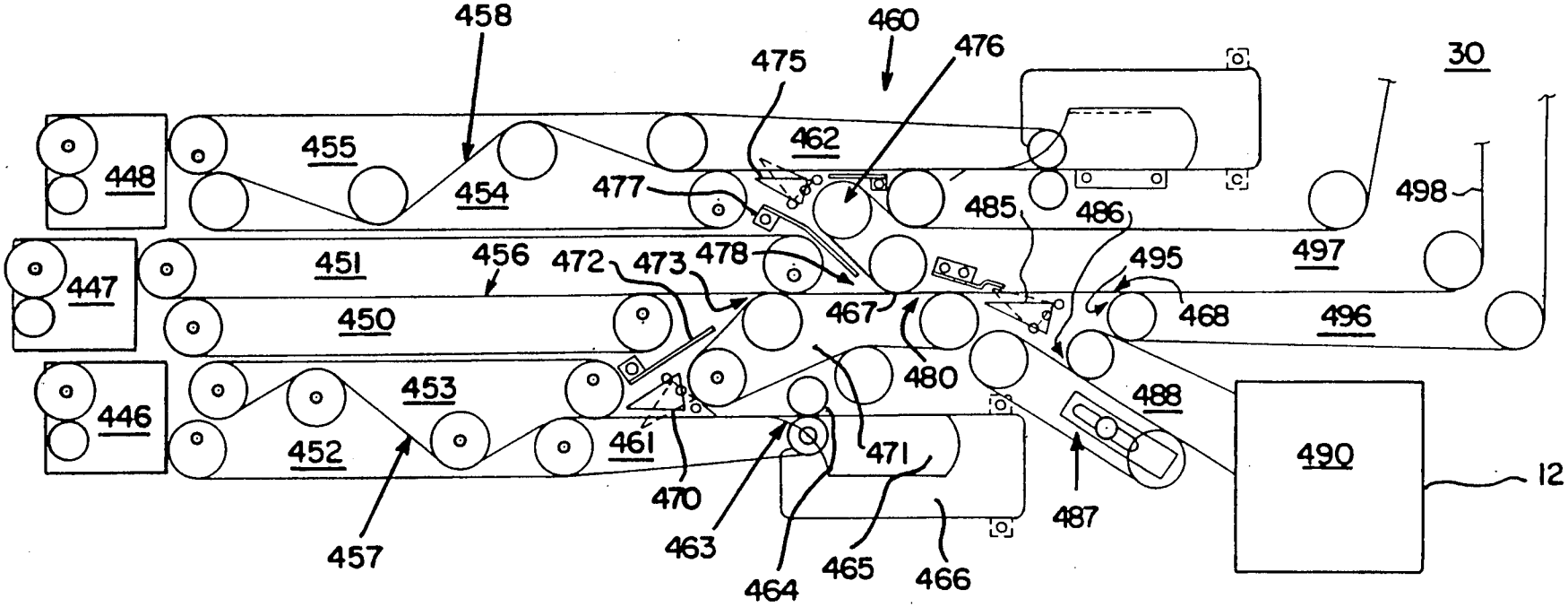
FIG. 27 is a top plan view of remaining portions of the extraction station, including the reuniter mechanism.

Referring to FIG. 27, items (presumably contents) exiting from the thickness measuring device 447 are received between an opposing pair of belt systems 450, 451 which serve to direct such contents forward through the extraction station 29. Items (presumably envelope faces) exiting from the thickness measuring devices 446, 448 are received between corresponding pairs of belt systems 452, 453 and 454, 455, respectively. Unlike the transport path 456 which is defined by the paired belt systems 450, 451 each of the paired belts systems 452, 453 and 454, 455 are configured to respectively develop contorted paths 457, 458. In traversing the contorted transport paths 457, 458, an item will progress along a transport path which is longer (in terms of time and distance) than the transport path 456, causing the items which are traversing the transport paths 457, 458 to shift rearwardly with respect to the items which are traversing the transport path 456. The resulting rearward shift is designed to compensate for the forward shift imparted to the envelope faces by operation of the nips 425 of the separation devices 420, 421. As a consequence of this operation, the various items being transported will be caused to assume the same general alignment as originally presented prior to severing and extraction. Accordingly, if there is a need to re-unite the various items, the items will be re-united in the same general orientation as they possessed before the envelope was severed. If there is no need to re-unite, the extracted contents will simply progress along the transport path 456, essentially transparent to the shifted envelope faces conveyed along the transport paths 457, 458.

A reuniter unit 460 communicates with the transport paths 456, 457, 458 to receive the various items resulting from the extraction process, and to operate upon the items received in accordance with the decision made as these various items were passed through the thickness measuring devices 446, 447, 448. Thus, the reuniter unit 460 operates either to deliver extracted contents from the extraction station 29, while discarding the separated envelope faces, or to re-unite the various items and divert the re-united envelope from further processing as the result of a determination that the extraction procedure was unsuccessful.

It if has been determined that the extraction procedure was successful, each of the separated envelope faces are passed from the belt systems 452, 453 and 454, 455 to separate belt systems 461, 462, respectively, eventually encountering a pair of nips 463 defined by rollers 464 positioned against each of the belt systems 461, 462. A curved guide shoe 465 is positioned beyond each of the nips 463 to receive a separated envelope face and to redirect the envelope face downwardly through an aperture 466 provided in the base of the processing unit 5. As a consequence of this, the separated enveloped faces are delivered to the trash container which is provided in the access area 10, for collection and eventual removal. The extracted contents are passed from between the opposed belt systems 450, 451, progressing along a transport path 467 for delivery from the output 468 of the extraction station 29, and subsequent processing as will be described more fully below.

If it has been determined that the extraction procedure was unsuccessful, reuniter unit 460 operates to re-unite the various separated items so that the re-united documents may be diverted from the transport path 467 for separate processing.

To this end, items delivered from between the opposing belt systems 452, 453 are first re-united with items delivered from between the opposing belt systems 450, 451. This is accomplished by positioning a deflector 470 just beyond the exit from between the opposed belt systems 452, 453 so that when the deflector 470 is positioned as shown in solid lines in FIG. 27, separated envelope faces are passed along the belt system 461, for discarding, and so that when the deflector 470 is positioned as shown in phantom in FIG. 27, documents delivered from between the opposing belt systems 452, 453 are deflected toward a belt system 471. With the assistance of a guide 472, the belt system 471 operates to pass the items received to a nip 473 which is developed with the belt system 452, thereby re-uniting contents delivered from between the opposing belt systems 452, 453 with items delivered from between the opposing belt systems 450, 451.

A second deflector 475 is positioned just beyond the exit from between the opposed belt systems 454, 455 so that when the deflector 475 is positioned as shown in solid lines in FIG. 27, separated envelope faces are passed along the belt system 462, for discarding, and so that when the deflector 475 is positioned as shown in phantom in FIG. 27, documents delivered from between the opposing belt systems 454, 455 are deflected toward a belt system 476. With the assistance of a guide 477, the belt system 476 operates to pass the items received to a nip 478 which is developed between the belt system 476 and the opposing belt system 471. As a consequence of this, all of the items delivered from between the opposing belt systems 450, 451, the opposing belt systems 452, 453, and the opposing belt systems 454, 455, respectively, will be re-united at 480. Moreover, as previously described, these items will be re-united in the same general orientation as originally received from the edge-severing station 28, prior to the attempted extraction.

A deflector 485 is positioned just beyond the merge point 480, and is used to carry out the ultimate decision as to whether the items being passed along the transfer path 467 are contents which have been effectively extracted from their respective envelopes, or re-united envelopes (and contents) which are to be diverted from further processing. This decision, made in accordance with the decision made by means of the thickness measuring devices 446, 447 448, is carried out by moving the deflector 485 between the position which is shown in solid lines in FIG. 27, to pass extracted contents from the extraction station 29, or the position which is shown in phantom in FIG. 27, to divert a re-united envelope (and contents) from further processing.

Re-united envelopes are delivered to a nip 486 which is developed between a pair of opposing belt system 487, 488, for eventual delivery to the stacking unit 12 which is provided to receive rejected envelopes for special processing. The configuration of the stacking unit 12 is essentially identical in structure and operation to the reject trays 6, 7 of the sorting station 27. Since it is expected that only a relatively small number of envelopes will have to be diverted from the extraction station 29, only a single stacking unit 490 is provided to receive such re-united envelopes.

As a consequence of the foregoing operations, paired documents representing the contents of the envelopes being processed will be delivered from the extraction station 29. As previously indicated, the turnabout section 30 is preferably positioned just beyond the extraction station 29 to promote the compactness of the automated mail processing apparatus 1, and to position the output 11 of the apparatus adjacent to its corresponding input 4. Consequently, documents received from the output 468 of the extraction station 29 are introduced to a nip 495 developed between an opposing pair of belt systems 496, 497 which are configured to develop a generally U-shaped transfer path 498 (FIG. 2) which serves to deliver documents received from the extraction station 29 to the separation station 31 in a direction which is generally opposite to the direction in which envelopes and contents are transported prior to and during the extraction process.

SEPARATION STATION

Figure 28:
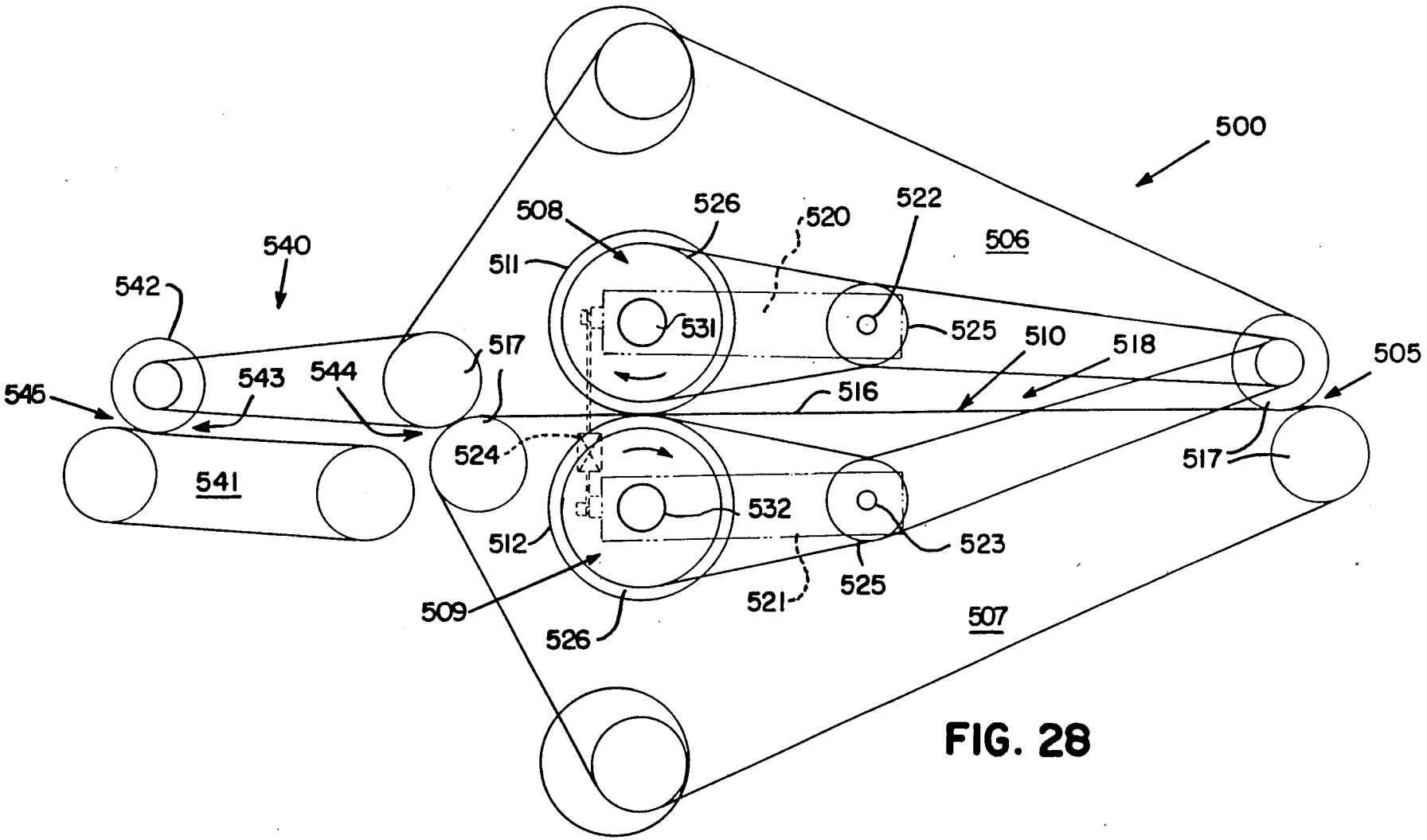
FIG. 28 is a top plan view of the separation station of the apparatus.

The paired contents received from the extraction station 29 are then delivered to the separation station 31 for further processing. At the separation station 31, such contents are received within a singulation unit 500, as shown in FIG. 28. The paired documents enter a nip 505 which is developed between an opposing pair of belt systems 506, 507, which cooperate to provide the primary means for supporting and conveying documents through the singulation unit 500. Actual separation (singulation) of the paired documents is accomplished by an opposing pair of drums 508, 509 which are disposed on opposite sides of the transport path 510 which is developed as a result of interaction between the cooperating belt systems 506, 507. Accordingly, contents (documents) are received within the singulation unit 500, entering the nip 505, and are initially conveyed through the singulation unit 500 under the influence of the cooperating belt systems 506, 507. However, the primary function of the singulation unit 500, which is to separate the paired documents so that one of the two documents leads the other, is accomplished by the drums 508, 509.

The drums 508, 509 are generally cylindrical in construction, with configured surfaces such as are best illustrated in FIG. 29. To this end, the surfaces 511, 512 of the drums 508, 509 are provided with series of protrusions 513, 514 which enable the surfaces 511, 512 of the drums 508, 509 to interact with one another to process documents, and to interact with the belt systems 506, 507, as will be described more fully below.

Generally, singulation is accomplished by providing the drum 508 with a surface 511 having a relatively high coefficient of friction, while providing the drum 509 with a surface 512 having a moderate coefficient of friction. By rotating the friction drum 508 in a generally clockwise direction, while rotating the retard drum 509 in a generally counter-clockwise direction, the document which is closest to the surface 511 of the drum 508 is caused to advanced while the other document is retarded, and even pushed backward, by the surface 512 of the drum 509.

Thus, in operation, documents being conveyed along the transport path 510 are introduced to the drums 508, 509, and are acted upon so that the document closest to the drum 508 is passed from between the drums 508, 509, while the remaining document is held back. After the first document exits from between the drums 508, 509, the second document is then caused to pass from between the drums 508, 509 as the surface 511 takes precedence over the surface 512. Thus, the documents are converted from a parallel configuration to a series configuration.

In the course of performing this singulation process, two factors must be taken into consideration. First, care must be taken to assure that the belts of the belt systems 506, 507 properly interact with the drums 508, 509 at the junction of these structures. Second, since the drums 508, 509 are caused to rotate in opposite directions, care must be taken to assure that this motion neither wears the surfaces 511, 512 at an unacceptable rate, nor interferes with the belt systems 506, 507.

To avoid interference between the drums 508, 509 and the belts of the belt systems 506, 507, the surfaces 511, 512 are spaced from one another so that a region is developed, at 515 (See FIG. 29), to receive both of the belts 516 of the belt systems 506, 507. To avoid interference between the motion which would ordinarily be imparted to the documents by the belt systems 506, 507, and the motion which needs to be imparted to the documents by the drums 508, 509 to cause singulation, the rollers 517 which support the belts 516 of the belt systems 506, 507 are spaced at a significant distance so that in the region 518, the belt systems 506, 507 provide sufficient driving forces to the documents being conveyed, but so that only light driving forces are applied to the documents as they progress between the drums 508, 509, so that operation of the drums 508, 509 will be allowed to cause singulation of the documents as previously described.

Next to be considered is the potential for wear at the interface of the drums 508, 509. In describing the input station 25, frictional techniques are used to singulate the envelopes being delivered to the processing unit 5. However, since a constant supply of envelopes is maintained between the belt systems 68, 69 which are used to cause such friction separation, belt-to-belt contact is avoided and the need for special measures to ameliorate the effects of friction is eliminated by the relatively slippery and more fragile envelope surfaces which are positioned against the belts 70, 71 of the belt systems 68, 69. Frictional techniques are also used to shift documents within the separation devices 420, 421 of the extraction station 29. However, since the retard belt system 426 is only braked for a very short period of time, to achieve only a small offset between the envelope face and the contents positioned against it, the amount of wear resulting from such frictional techniques is only minimal.

In the separation station 30, the drums 508, 509 will rotate with respect to one another for significant periods of time without there being any interposed documents to ameliorate the effects of friction. Accordingly, a significantly greater potential for wear is presented at this interface. To accommodate this potential for wear without compromising the performance of the singulation unit 500, the surfaces 511, 512 of the drums 508, 509 are configured so that the surface protrusions 513, 514 cooperate to develop sufficient normal (frictional) forces to cause singulation of the documents being processed, without directly contacting one another. To this end, and with reference to FIG. 29, it is seen that the surfaces 511, 512 of the drums 508, 509 are not only spaced from one another by a distance which exceeds the thickness of the belts 516 of the belt systems 506, 507, to permit the drums 508, 509 to operate essentially independently of the belt systems 506, 507, but also so that the protrusions 513 of the surface 511 of the drum 508 are offset from the protrusions 514 of the surface 512 of the drum 509. As a result, the protrusions 513 fall between the protrusions 514, and vice-versa.

To achieve effective operation of the singulation unit 500, the tips of the protrusions 513, 514 are generally aligned with the plane of contact 519 developed between the belts 516 of the belt systems 506, 507. As a consequence, the documents being processed through the singulation unit 500 are lightly urged forward by the belt systems 506, 507, but are primarily operated upon by the opposing drums 508, 509, for purposes of singulation. To enhance the reliability of the singulation process, it has been found to be preferable for the protrusions 513, 514 to actually nest within one another for a small distance, so as to temporarily (non-permanently)

"corrugate" the documents which are being processed through the singulation unit 500. Such corrugations has been found to be advantageous in supporting the normal forces which are developed against the documents being processed through the drums 508, 509 so as to cause effective singulation as previously described.

Appropriate means must therefore be provided to bias the drums 508, 509 into contact with one another to develop the normal forces required for proper singulation, while simultaneously maintaining appropriate separation between the surfaces 511, 512 of the drums 508, 509 to prevent premature wear of the surfaces 511, 512. A number of devices may be provided to accomplish this function.

One such device is illustrated in FIGS. 28 and 30. To this end, each of the drums 508, 509 are respectively received by a pair of arms 520, 521 which are adapted to pivot with respect to the surface of the processing unit 5, at 522 and 523. The ends of the arms 520, 521 which receive the drums 508, 509 are interconnected by a spring 524. A pair of pulleys 525 are provided at the pivots 522, 523 to operatively connect the drums 508, 509 with a common prime mover, in this case one of the rollers 517. As a consequence of this, each of the drums 508, 509 are positively driven in the appropriate direction, and are permitted to float with respect to the operative plane 519 of the transport path 510. Any wear which might occur at either of the surfaces 511, 512 of the drums 508, 509 is therefore capable of being compensated by self-adjustment of the distances between the rollers 508, 509, and the operative plane 519, under the influence of the spring 524 and the pivoted arms 520, 521.

To establish proper spacings between the drums 508, 509, and the operative plane 519, and to provide the normal forces required for singulation while ameliorating the effects of wear, a follower system 530 is provided which is operatively associated with the drive mechanism which is positioned beneath the working surface of the processing unit 5. As shown in FIG. 30, the drums 508, 509 are respectively received upon a pair of shafts 531, 532 which pass through a pair of apertures 533 provided in the base of the processing unit 5, and which are journaled for rotation within bearing blocks 534 formed in the ends of the pivotable arms 520, 521. The shafts 521, 532 are rotated by pulleys 525, 526, which are in turn associated with the prime mover as previously described. The shafts 531, 532 also receive a pair of rolling stops 535, 536 which are fixedly associated with the shafts 531, 532, and which therefore follow the rotation of their corresponding drums 508, 509. By configuring the rolling stops 535, 536 with a diameter which is slightly less than that of the associated drums 508, 509, the spacing (penetration) developed between the surfaces 511, 512 of the drums 508, 509 is capable of being regulated by contact between the peripheral surfaces of the rolling stops 535, 536.

Ordinarily, wear at the surfaces 511, 512 will be kept to a minimum by the space which is maintained between the interlaced protrusions 513, 514, as prescribed by the follower system 530, and as a consequence of the minimal wear which will generally result from contact with the paper surfaces of the documents being processed. For this reason, the rolling stops 535, 536 may be formed of a relatively hard material so that their mutual contact will limit the spacing between the surfaces 511, 512 of the drums 508, 509 without wearing significantly, despite rotation of the drums 508, 509 in opposite directions.

However, in the event that accelerated wear is encountered, either in the protrusions 513 of the drum 508 or the protrusions 514 of the drum 509, it is possible for the rolling stops 535, 536 to provide a self-adjusting function by respectively forming the rolling stops 535, 536 of materials which exhibit the same wear characteristics as the materials which form the surfaces 511, 512 of the drums 508, 509. As a result of this, contact between the rolling stops 535, 536 resulting from interaction between the drums 508, 509 will cause the rolling stops 535, 536 to wear at a rate which substantially corresponds to the rate of wear which is encountered at the interface between the drums 508, 509. This self-compensating function will accommodate either accelerated wear of the drum 508 or accelerated wear of the drum 509, or even combinations of these wear characteristics, by causing corresponding wearing of the rolling stops 535, 536. This function can be used to develop significant normal forces against even the roughest of papers, while maintaining significant service intervals before replacement of the surfaces 511, 512 due to wear becomes necessary.

The above described self-adjusting function therefore serves to accommodate either relatively accelerated or uneven wear characteristics exhibited at the interface of the drums 508, 509. While such specialized functions may be necessary in certain applications, it is expected that in many applications such special measures will not be necessary. In such cases, simplified follower systems may be used in place of the follower system 530 previously described.

Figure 31:
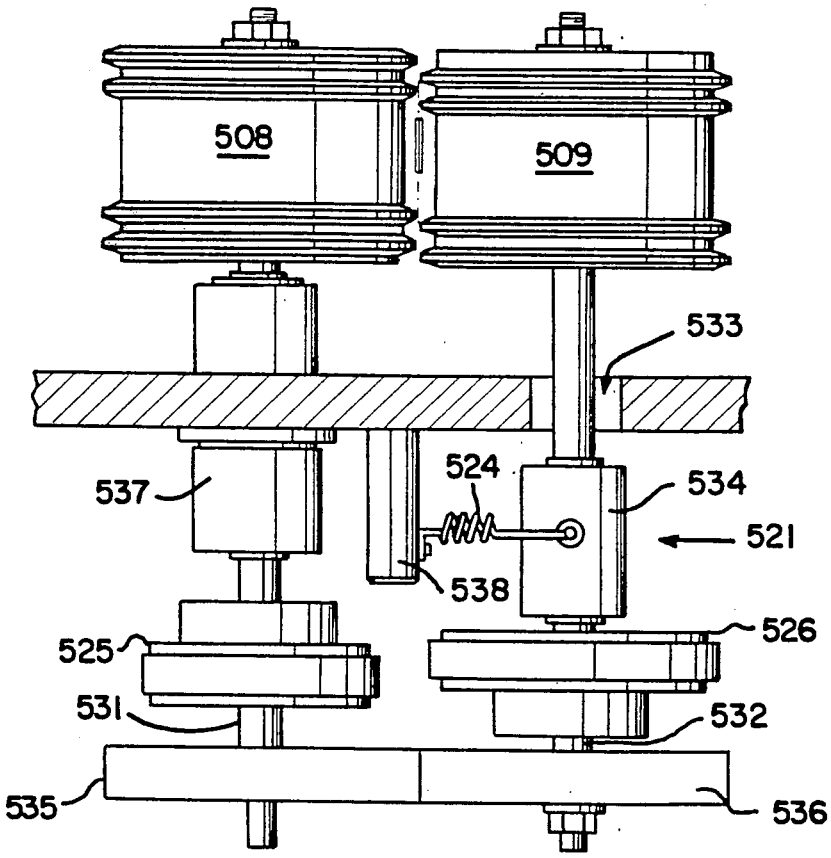

For example, while it is normally expected that the surface 512 of the retarding drum 509 will tend to wear, since it is repeatedly called upon to slide rearward with respect to the document which is contacts, the surface 511 of the drum 508 will tend to exhibit significantly less wear since it will tend to entrain the document which it contacts, rather than sliding along it. For this reason, it is expected that only the surface 512 will tend to exhibit any accelerated wear. In such cases, and with reference to FIG. 31, it is possible to eliminate the pivotable arm 520 which receives the drum 508 in favor of a fixed mounting, since only the drum 509 will require any self-adjusting capability. To this end, the pivotable arm 520 is replaced with a fixed bearing 537 which engages the shaft 531 which receives the drum 508, so that only the drum 509 is capable of movement with respect to the operative plane 519 of the transport path 510, and the spring 524 is connected between the pivotable arm 521 and a fixed mounting 538, rather that the pivotable arm 520. To be noted is that the surface of the rolling stop 536 would still wear in accordance with the wear exhibited at the surface 512 of the drum 509, compensating for anticipated wear of the drum 509 without having to operate upon the remaining drum 508.

Figure 32:
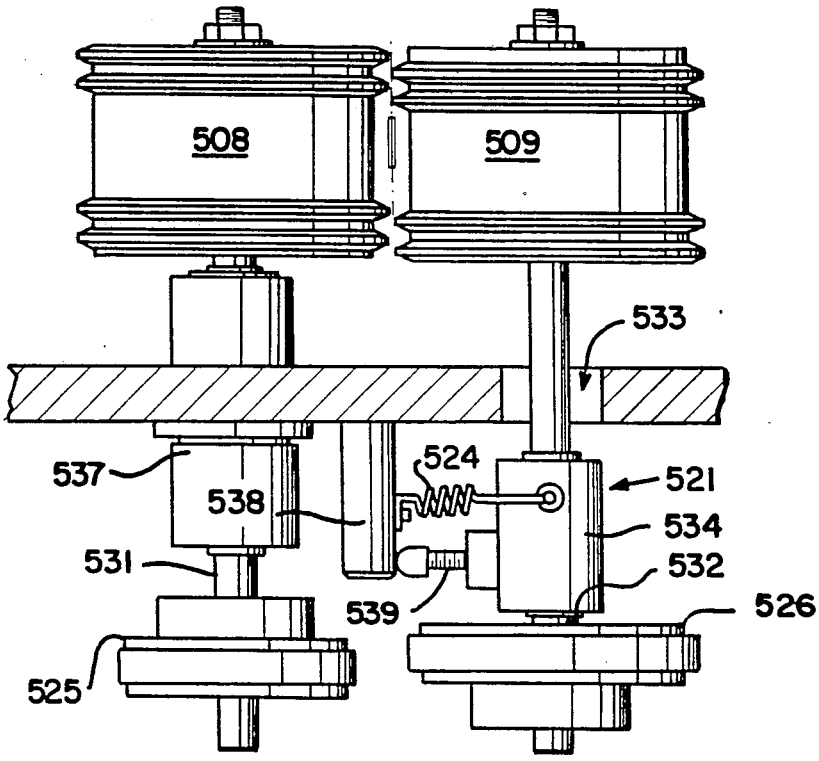

Some applications (e.g. mailing operations which make use of glossy papers) may even exhibit such little wear at the interface between the drums 508, 509 that no continuously self-adjusting feature will be required to achieve a satisfactory service life for the surfaces 511, 512. In such cases, and with reference to FIG. 32, it is even possible to completely eliminate the follower system 530. To this end, one of the opposed drums, preferably the drum 508, is fixed for rotation within a bearing 537, while the drum 509 is again pivoted for movement toward and away from the drum 508 in accordance with the biasing forces of the spring 524. Movement of the drum 509 toward the drum 508 is limited by a stop 539 which is positioned to contact the fixed mounting 538, to limit clockwise rotation of the pivotable arm 509. Adjustment of the stop 539 is then used to adjust the spacing developed between the drums 508, 509.

Irrespective of the means used to cause singulation, the drums 508, 509 will combine with the belt systems 506, 507 to cause the paired documents which are introduced to the singulation unit 500 to be separated (singulated) as they exit from between the drums 508, 509, and eventually from between the belt systems 506, 507. Two factors must be taken into account in connection with the discharge of such singulated documents from the singulation unit 500. First, the singulated documents will be discharged from the singulation unit 500 with the leading edge of each document immediately following the trailing edge of the document which preceeds it, with no gap. Second, the length along the transport path 510 which is occupied by the singulated documents will be essentially double the length which was originally occupied by the documents when paired. Accordingly, appropriate steps must be taken to interface the discharge of singulated documents from the singulation unit 500, for subsequent processing, with the input of paired documents to the singulation unit 500.

To this end, an accelerator unit 540 is positioned just beyond the output of the singulation unit 500, which generally comprises a belt system 541 in operative combination with a driven roller 542. Both the belt system 541 and the roller 542 are caused to rotate at a rate which exceeds the rate at which documents are delivered from the singulation unit 500. As a result, the documents which are discharged from the singulation unit 500 are transferred to a nip 543 which is developed downstream of the exit 544 from the singulation unit 500, at the point of contact between the roller 542 and the belt system 541, and which proceeds at the accelerated rate.

To effectively interface the documents being discharged from the singulation unit 500 with the portions of the apparatus which follow, while maintaining a relatively constant throughput as is preferred in accordance with the present invention, the accelerator unit 450 is preferably operated at a rate of speed which is approximately double the rate of speed of the singulation unit 500 (e.g., an increase from 50 IPS to 100 IPS), and the various operations which preceed it. As a consequence of this, the operations following singulation will proceed at a rate which is essentially double that of the rate of extraction, so that the singulated documents will be processed in correlation with the extraction of contents from the envelopes.

To enhance reliability, a gap is preferably provided between the documents being processed rather than attempting to process the serial documents which would ordinarily be discharged from the singulation unit 500. To accomplish this, the nip 543 is spaced from the exit 544 from between the belt systems 506, 507 for a specified distance. As described in connection with the transfer of envelopes from the input station 25 to the scanning station 26, the gap which is developed between the singulated documents will depend upon the differential in rates between the accelerator unit 540 and the singulation unit 500, in accordance with the distance between the exit 544 of the singulation unit 500 and the nip 543 (i.e., until the second of the paired documents leaves the exit 544). These parameters may therefore be adjusted to achieve a desired, appropriate spacing between the documents being discharged from the singulation unit 500.

In passing documents from the singulation unit 500 to the accelerator unit 540, there will be a brief period of time during which a document will simultaneously be captured between the belt systems 506, 507 and the belt 541 and roller 542. During this period of time, it is important for the document to progress under the control of the singulation unit 500, to ensure a proper gap. For this reason, the nip 543 and the exit 544 are configured so that the forces developed at the nip 543 are somewhat less than the forces developed between the belts 516 of the belt systems 506, 507, at the exit 544. As a consequence, the accelerator unit 540 will only take control of a document after it has been fully discharged from the singulation unit 500 and is ready to progress at its increased rate of speed from the output 545.

The contents being singulated within the separation station 30 will generally include an invoice and an accompanying check. Particularly in connection with applications involving windowed envelopes, it will generally be known which of these two documents lies on either side of the transport path 510. As previously indicated, the document which is positioned adjacent to the drum 508 will be the first document to be passed from the singulation unit 500. Thus, the order of the documents delivered from the separation station 30 will be known. In the event that it becomes desired to deliver the documents from the separation station 30 in the reverse order, two alternatives are available. First, the paired documents may be switched so that the other of the two documents lies adjacent to the drum 508, maintaining the order in which documents are passed from the singulation unit 500, but reversing the order of the documents so discharged. Second, the paired documents may be introduced to drums 508, 509 having surfaces which are reversed (in their characteristics) from the surfaces 511, 512 previously described. Thus, the documents will be separated in the reverse order. Since the drums 508, 509 and the structures which support them are essentially symmetrical, this is easily accomplished without adversely affecting the operation of the singulation unit 500.

JUSTIFICATION STATION

In operating upon the documents which have been extracted from the processed envelopes as previously described, two factors will combine to cause such documents to more likely than not assume irregular orientations as they are delivered from the separation station 31, at 545.

First, the documents will have generally assumed different orientations in the envelopes as originally presented to the processing apparatus 1, including different heights and/or angles within the envelopes, as well as different heights and/or angles with respect to one another. This will result not only from the manner in which the documents were originally placed in the envelopes, prior to mailing, but also as a result of the handling of such envelopes within the mailing process.

Second, the extraction process itself will tend to introduce slight variations in the orientation of the documents being delivered from the separation 31, due to the manner in which the documents have been handled. For example, within the extraction station 29, braking of the belt systems 426 of the separation devices 420, 421 will tend to alter the positioning of the documents being processed, particularly when the documents have been processed through different separation devices. These is also a potential for the documents to become askew as they are re-united to enter the thickness measuring device 447. Additional opportunities for the documents to become askew with one another are presented in the separation station 31. This would include singulation within the singulation unit 500, as well as acceleration within the accelerator 540.

To this point, such variations in orientation were of no concern, and were either simply ignored or accommodated by the configuration of the apparatus itself. However, subsequent to singulation, the documents preferably undergo certain analyses (within the check detection station 33, or the document orientation station 36, if used) which require that the documents be placed at a known orientation with respect to the working surface of the processing unit 5. To this end, a justification device 550 preferably immediately follows the accelerator unit 540, to re-orient the documents received from the separation station 31, if necessary, so that the documents are uniformly oriented for presentation to subsequent stations of the processing apparatus 1.

Figure 33:
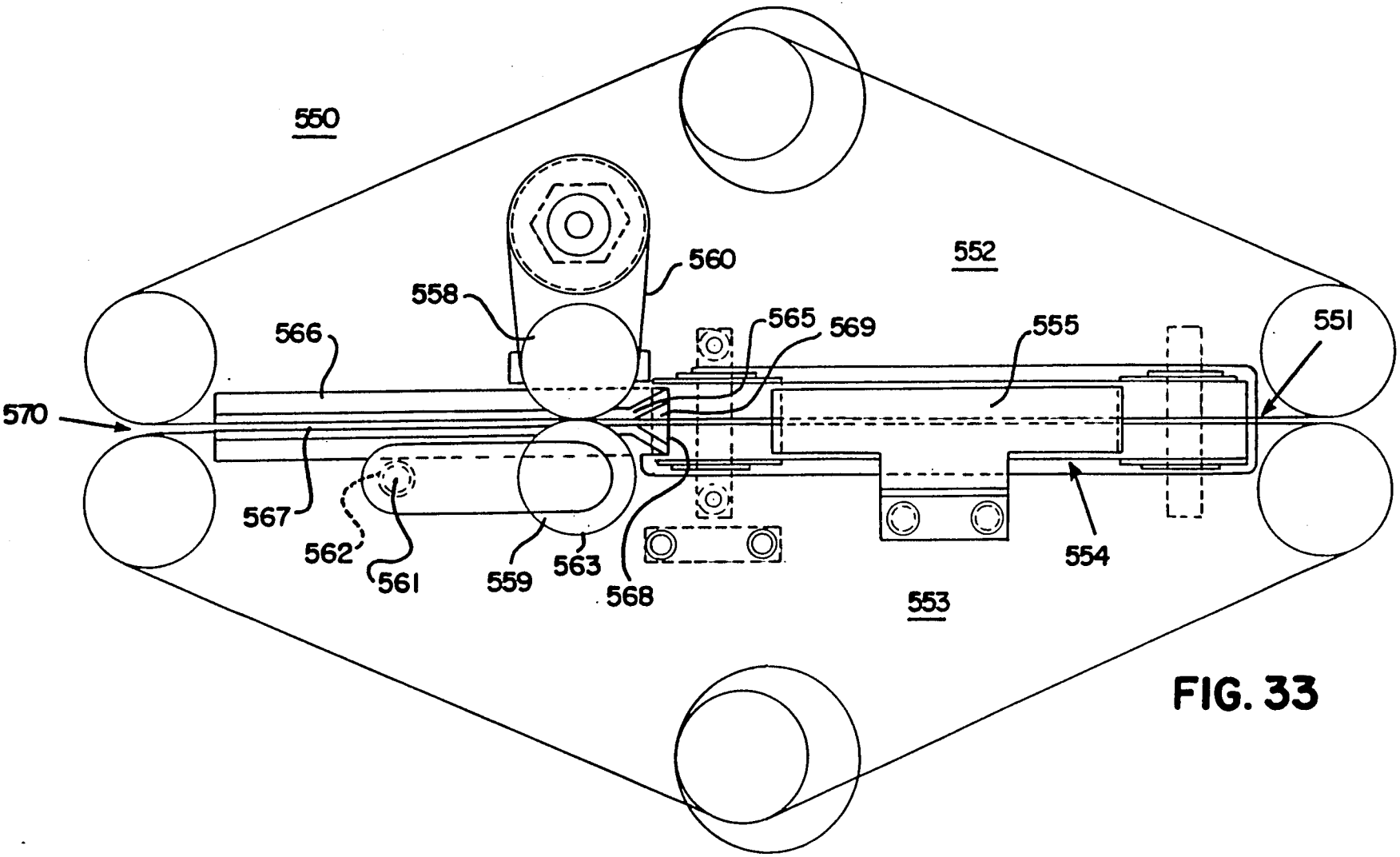
FIG. 33 is a top plan view of the justification station of the apparatus.
Figure 34:
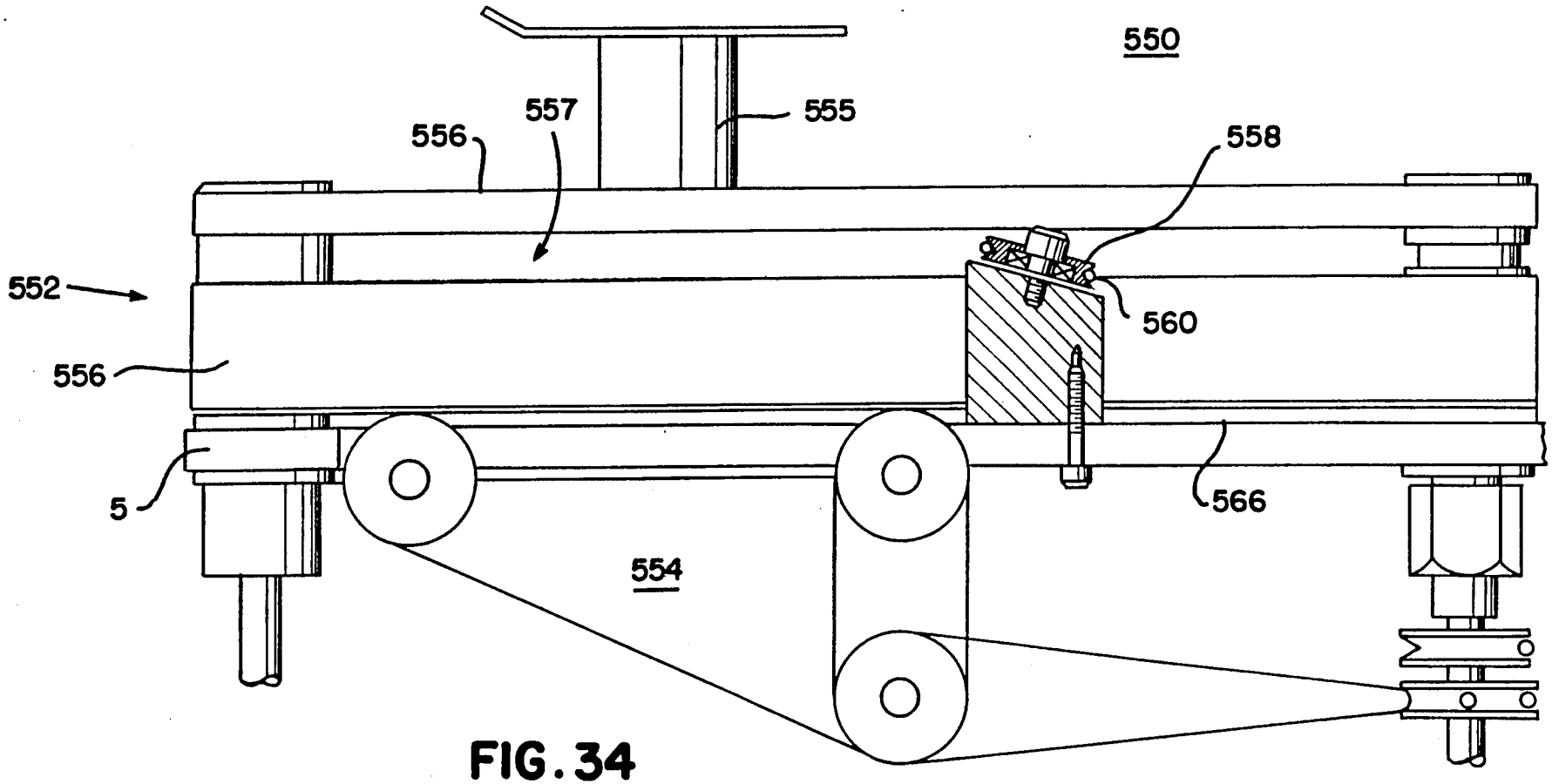
FIG. 34 is a side elevational view of the justification station.

Referring to FIG. 33 and 34, the justification device 550 receives documents discharged from the separation station 31 within a containment 551 which is defined by a pair of opposing belt systems 552, 553, and a third belt system 554 which is positioned beneath the opposing belt systems 552, 553.

As is best shown in FIG. 34, the belt system 552, 553 each includes a pair of belts 556 which combine to generally vertically support documents upon the belt system 554, and to define an opening 557 for receiving a pair of angled rollers 558, 559 which operate upon the documents to achieve the desired justification. Angled roller 558 is a fixed, driven roller operated by a drive belt 560 which also serves to develop a frictional surface at the periphery of the angled roller 558. Angled roller 559 is pivoted for movement with respect to the angled roller 558, about a pivot 561, and is biased toward the angled roller 558 under the influence of a spring 562. The angled roller 559 may be provided with a friction belt 563 at its periphery, if desired.

With the assistance of the belt systems 552, 553, 554, received documents are directed toward a nip 565 which is developed between the pair of angled rollers 558, 559. As a consequence of interaction between the angled rollers 558, 559, documents received within the nip 565 are urged generally downwardly, toward a reference surface which is developed by a guide shoe 566. The guide shoe 566 includes a slot 567 which receives the bottom edge of a document being passed through the justification device 550, and which therefore defines the justified reference which is desired for further processing of the document. The leading edge of the guide shoe 568 is provided with a tapered gather 569 which serves to facilitate the transfer of documents from the containment 551 to the nip 565, without hanging up at the leading edge of the guide shoe 566.

To be noted is that the angled rollers 558, 559 are permitted to freely operate upon the documents being delivered through the justification device 550 since the belts 556 of the opposing belt systems 552, 553 only loosely engage the documents being processed. As a consequence, the received documents are permitted to move freely within the containment 551 under the influence of the justifying rollers 558, 559. To avoid buckling of the documents as a consequence of this movement, a single point contact is developed between the documents and the nip 565 which engages them, to afford the documents a limited degree of freedom to rotate when first contact the guide shoe 556. The narrow, full length containment which is developed between the belt systems 552, 553 also serves to resist buckling by supporting the documents as they proceed through the containment and between the nip 565. The guide shoe 556 is also specially configured to prevent such buckling to the extent possible.

To be noted in this regard is that a document which is nearly justified when entering the nip 565 will often be subjected to downward pressures which the leading corner of the document cannot support, without deforming, often causing stoppage of the leading corner. As a result of this, the trailing edge of the document tends to raise up. A guide 555 is therefore positioned over the containment 551 to limit this upward movement, thereby preventing the document from rolling over within the containment 551. Upon inpacting the guide 555, the document will be dropped back down to a position which is appropriate for normal justification. In any event, the documents are discharged from between the opposing belt systems 552, 553, at 570, with their lower edges justified to a specified reference, readying them for further processing.

DETECTION STATION

The processed documents are transferred from the output 570 of the justification station 32 to the input of the detection station 33. As previously described, the detection station 33 serves as a means for determining the orientation of a check which is passing through the detection station 33, so that the document may be re-oriented, as necessary, for uniform delivery from the processing unit 5.

Figure 35:
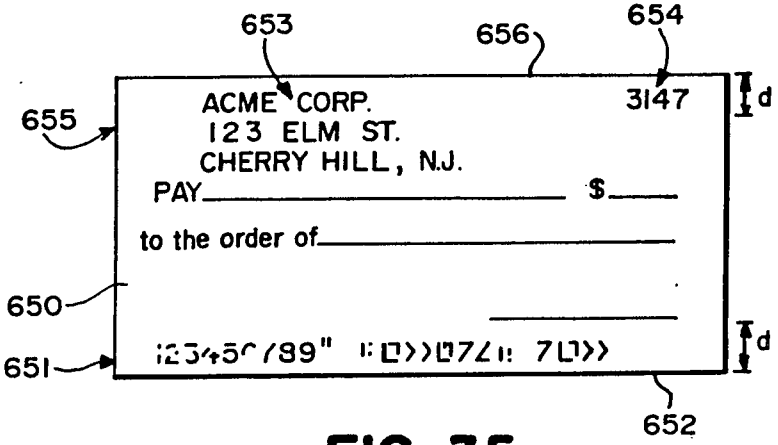
FIG. 35 is a plan view illustrating a check for processing through the detection station of the apparatus.

In accordance with the present invention, this is accomplished by analysing the "profile" of the check as revealed by certain of its characteristic features. For example, with reference to FIG. 35, every check 650 must include a MICR (magnetic ink character recognition) "data line" for processing through the banking system. Moreover, this data line, shown at 651, is uniformly placed at a specified distance ("d") from the lower edge 652 of the check, and only the identifying characters which comprises this data line may be placed in this segregated band. This feature therefore constitutes a known characteristic which may serve as a primary basis for making determinations as to orientation. Most checks further include personalized identification fields such as the name of the account owner, and a checking account sequence number. If used, the account name is uniformly placed at 653, while the sequence number is uniformly placed at 654. It has been found that a second data line, shown at 655, which is also spaced at a specific distance ("d") from the top edge 656 of the check, will intersect with the fields 653, 654, if provided, and that only these identifying fields will be found in this segregated band. This feature therefore constitutes a known characteristic which may serve as a secondary basis for making a determination as to orientation. It has been found that by analysing such characteristic features, along the data lines 651, 655, a determination may be made as to the orientation of the check 650.

To accomplish this, the detection station 33 generally operates upon the magnetic ink which is traditionally used to print conventionally available checks. To be noted is that since the data lines 651, 655 which are to operated upon are rather precisely spaced from the edges 652, 656 of the check 650 (by the specified distance "d"), it is important for the bottom most edge of the document being scanned to be at a known and proper orientation. It is for this reason that the documents are subjected to a justification step immediately preceeding their introduction to the detection station 33.

Figure 36:
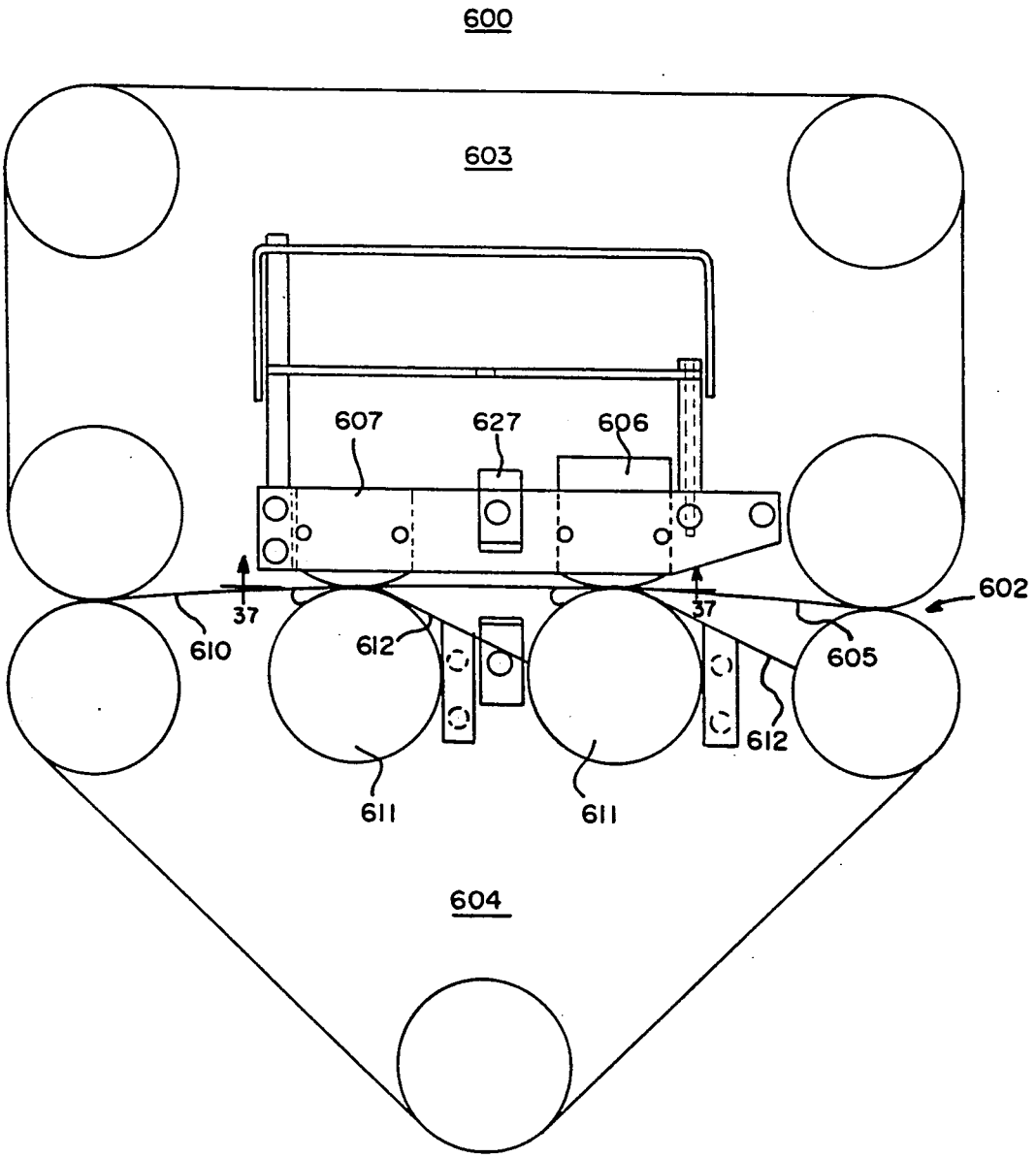
FIG. 36 is a top plan view of the detection fixture of the detection station.
Figure 37:
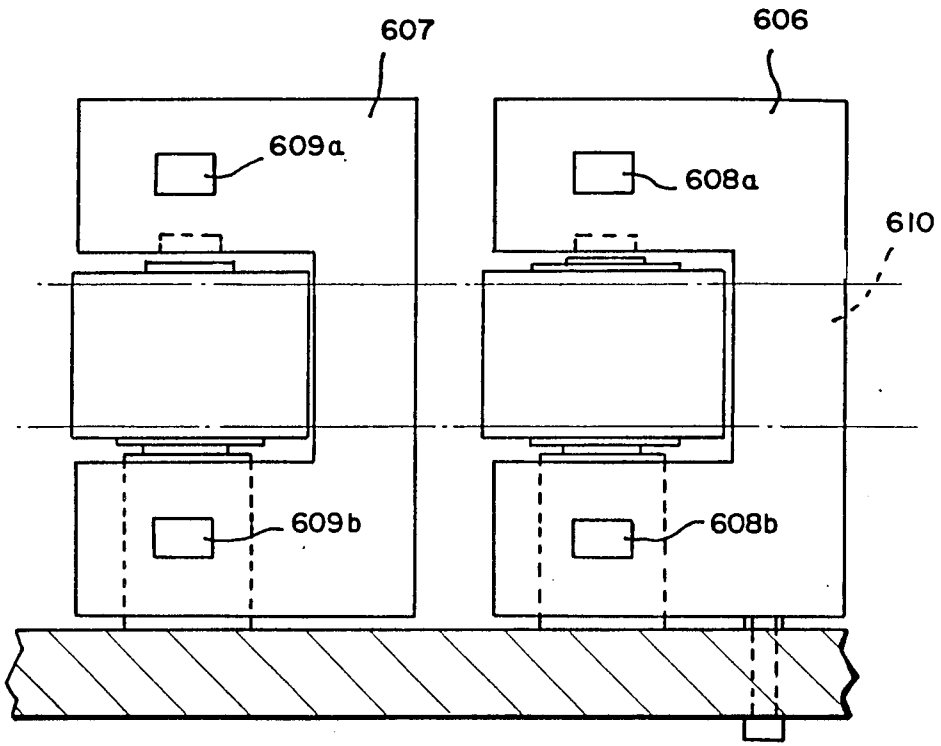
FIG. 37 is a partial, side elevational view of the detection fixture, taken along line 37—37 of FIG. 36.

Referring now to FIGS. 36 and 37, upon entering the detection station 33 the documents are presented to a detection fixture 600, entering a nip 602 which is defined between an opposing pair of belt systems 603, 604 which serve to draw the received documents through the detection station 33, along a transport path 605. Positioned along the transport path 605 which is developed by the belt systems 603, 604 are a pair of fixtures 606, 607. The fixture 606 includes a pair of charge heads 608 (608*a*, 608*b*) which are capable of imparting a magnetic charge to the ink on the checks which are being passed through the detection station 33. Downstream from the fixture 606 is a second fixture 607, which includes a pair of read heads 609 (609*a*, 609*b*) which are responsive to flux variations resulting from the movement of charged characters (numerals or letters) past the heads 609. To be noted is that the charge heads 608*a*, 608*b* are the read heads 609*a*, 609*b* are respectively positioned above and below the belts 610 of the belt systems 603, 604, so that the heads 608, 609 are exposed to the documents being conveyed through the detection fixture 600. Further to be noted is that the heads 608, 609 are vertically and symmetrically positioned along the fixtures 606, 607 so that the heads 608, 609 will be aligned with each of the data lines 651, 655 of the checks which are being processed through the detection fixture 600, irrespective of the orientation of each check as it progresses through the detection station 33. The reasons for this will become apparent from the description which follows.

To enhance the reading of magnetic flux, it is important for each check to be maintained in proper contact with the heads 608, 609 as the checks are drawn past the fixtures 606, 607. To this end, a pair of idler rollers 611 are positioned in general alignment with the fixtures 606, 607, to positively drive envelopes past the fixtures 606, 607, and to enable careful adjustment of the belts 610 of the belt systems 603, 604 into alignment with the plane of the heads 608, 609. A series of non-magnetic leaf springs 612 are positioned in general alignment with each of the heads 608*a*, 608*b*, 609*a*, 609*b*, on the opposite side of the transport path 605, to maintain intimate contact between the check and the heads 608, 609.

Figure 38:
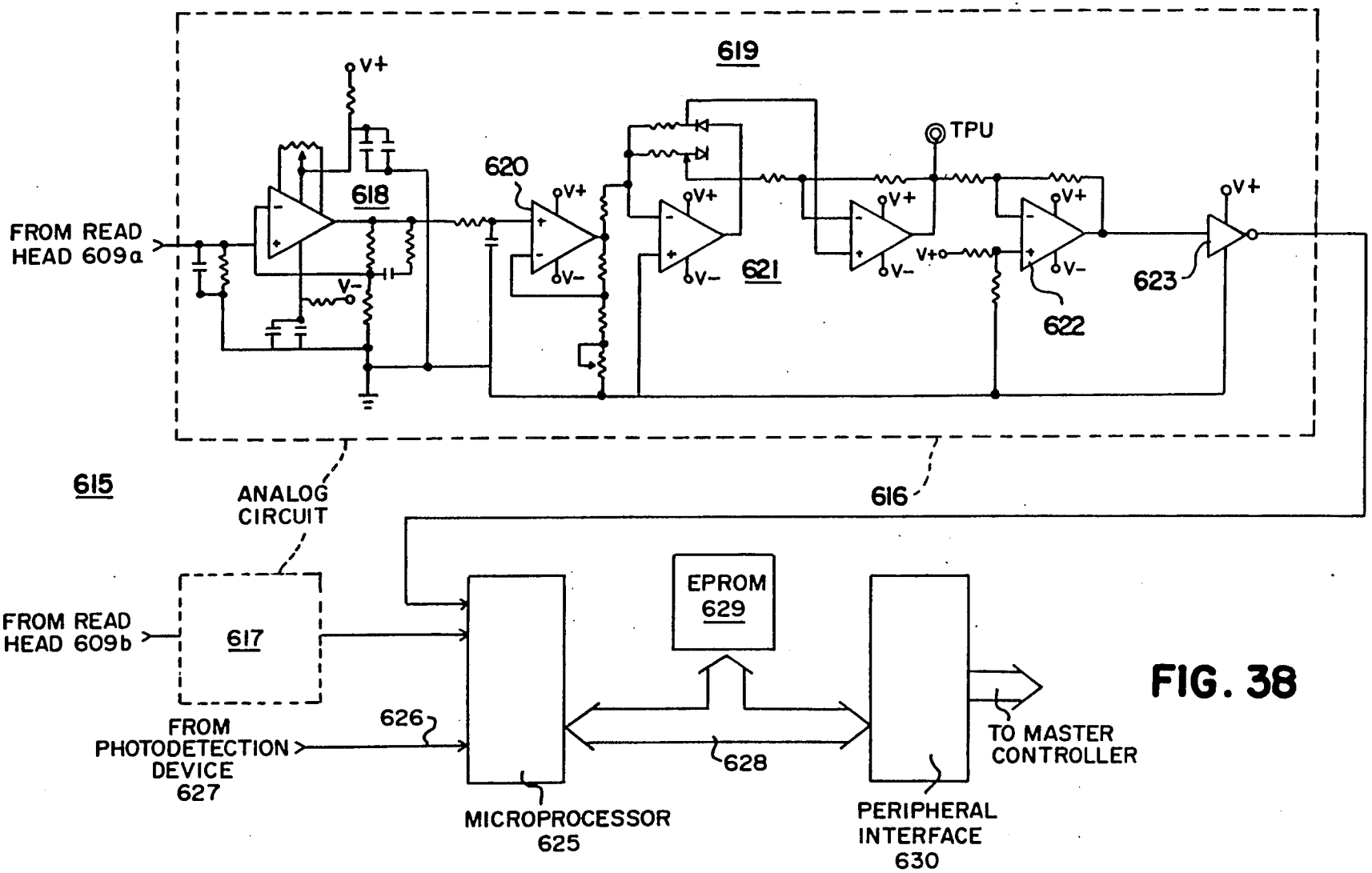
FIG. 38 is a schematic diagram showing a circuit for receiving and processing signals from the detection fixture.

Accordingly, as a check is drawn through the detection station 33, the ink of the check is magnetized at 608, and read at 609, to provide electrical signals which can be used to determine the orientation of the check. The resulting signals are applied to the detection circuit 615 which is shown in FIG. 38.

As previously indicated, a magnetic charge will first be imparted to any magnetic ink marking which are provided along the data lines 651, 655 of the check being scanned as the check passes the charge heads 608. Such a magnetic charge may be imparted to the magnetic ink using any of a variety of known circuits for uniformly energizing the charge heads 608. To be noted is that an appropriate charge will be imparted to the magnetic ink characters on the check even if the magnetic ink is on the side of the check which is opposite to the charge heads 608, since the desired charge will pass through the paper of the check as the check passes the charge heads 608.

Each of the read heads 609*a*, 609*b* are separately coupled to a circuit 616, 617 for respectively processing the analog signals received from the upper most read head 609*a* and the lower most head 609*b*. Each of the circuits 616, 617 are preferably positioned close to the read heads 609 to immediately amplify and process the signals which are received from the read heads 609, prior to their introduction to the remainder of the apparatus as will be described more fully below.

The circuits 616, 617 are identical in construction (only the circuit 616 is shown in detail to simplify the drawings), and each include a pre-amplifier 618 for immediately amplifying the signals received from the associated read head (in this case the read head 609*a*). The pre-amplified signal is then applied to a wave shaping circuit 619. Wave shaping circuit 619 includes an amplifier 620 for receiving signals from the pre-amplifier 618, a full-wave rectification circuit 621 which is coupled to the amplifier 620 to receive the amplified signal for full-wave rectification, preferably without any offset, and a differential amplifier 622 to set the final level for maximum noise immunity. Lastly, the wave shaping circuit 619 communicates with a Schmitt trigger circuit 623 which readies the amplified signal for digital processing.

A microprocessor 625 is provided to receive the various signals derived from the read heads 609, via the analog circuits 616, 617, to provide outputs which are indicative of the orientation of the check passing through the detection fixture 600 as will be described more fully below. To this end, the signals from the Schmitt trigger circuits 623 of the analog circuits 616, 617 are applied to the microprocessor 625, as interrupt signals. Also applied to the microprocessor 625 is an enabling signal 626 which is indicative of the passage of a check through the detection fixture 600, and which serves to initiate the orientation detection scheme to be described below. Passage of the check (the leading edge) through the detection fixture 600 may be detected by various means, such as a photodetection device 627 (See FIG. 36) positioned between the charge heads 608 and the read heads 609. A common buss 628 operatively connects the microprocessor 625 with EPROM 629, and a peripheral interface 630 for enabling communications with the remainder of the apparatus 1.

The detection circuit 615 operates to determine the orientation of two different types of checks including standard personal checks, which never vary in size, as well as commercial checks, which are nearly standard but which may vary to some extent. This is accomplished by magnetizing the ink of the check as previously described, and by reading the magnetized ink as the check passes through the detection fixture 600. Symmetrically paired, upper and lower charge heads 608 and read heads 609 are provided to enable the desired data to be obtained in a single pass of the check through the detection fixture 600, irrespective of its orientation. As with the charging procedure, the read heads 609 operate to read the magnetic data either directly, or through the check, for subsequent interpretation.

The decision as to the orientation of a check within the detection fixture 600 is based not upon an attempt to read portions of the MICR data line 651, but rather results from an interpretive process which is performed within the microprocessor 625. To this end, beginning at a set time after the leading edge of a check passes the photodetection device 627, to account for the distance between the photodetection device 627 and the read heads 609, data is provided to the microprocessor 625 which is indicative of the presence or absence of characters encountering the read heads 609. The microprocessor 625 the operates to monitor the length of "continuous" data fields which are encountered at the read heads 609, as well as discontinuities which exist between such data groupings, as follows.

Within the microprocessor 625, a series of counters are developed to monitor the lengths of marking groups read from the check being scanned, as well as gaps between such marking groups. Separate counters are provided to interpret the data being received from the upper read head 609*a* and the lower read head 609*b*. Since the characters on the date line 651 are conventionally provided at one-eighth inch spacings, a corresponding sampling period is established by the microprocessor 625. If, during the sampling period, a character is passing the read head 609*a* and 609*b*, the microprocessor 625 will operate to count a marking for the corresponding data line. If, during the sampling period, a character does not pass the read head 609*a* or 609*b*, the microprocessor will operate to count a space for the corresponding data line.

For encountered markings, the appropriate marking counter is incremented. Otherwise, the appropriate space counter is incremented. If a space counter ever counts more than a specified number (e.g., six) of spaces prior to a resumption of encountered markings, the occurrence is designated as a gap. The appropriate gap counter in incremented and the space counter and marking counter are reset to zero. If markings are again encountered before the space counter counts the specified number of spaces, the occurrence is not designated as a gap, but rather is designated as a space within with marking group. In such cases, the value of the space counter is added to the marking counter, and the space counter is reset to zero. Thus, the encountered spacing is treated as part of a continuous marking group. The various counters proceed in this fashion to identify the length of the last encountered marking group, and the number of any gaps, on each of the data lines 651, 655 of the check being scanned. These values are then used to make a determination as to the orientation of the check based upon various stored, empirically determined criteria (EPROM 629) within the microprocessor 625.

For example, if it is determined that the upper gap counter is non-zero and the lower gap is zero, while the upper pulse counter is greater than nine and the lower pulse counter is at least twenty-two, then the check has passed through the detection station 33 while upright and facing away from the read heads 609. If it is determined that the lower gap counter in non-zero and the upper gap counter is zero, while the lower pulse counter is less than seven and the upper pulse counter is at least twenty-two, then the check has passed through the detection station 33 while inverted and facing away from the read heads 609. If it is determined that the lower gap counter is non-zero and the upper gap counter is zero, while the upper pulse counter is at least twenty-two and the lower pulse counter is greater than nine, then the check has passed through the detection station 33 while inverted and facing the read heads 609. Lastly, if it is determined that the upper gap counter is non-zero and the lower gap counter is zero, while the upper pulse counter is less than seven and the lower pulse counter is at least twenty-two, then the check has passed through the detection station 33 while upright and facing the read heads 609.

The above criteria assume that a check having the characteristic features 651, 653, 654 has passed through the detection station 33. However, other types of documents can also be sensed in accordance with the present invention, if desired. For example, in the event that all gap and pulse counters equal zero, it can be assumed that the document is not a check, but rather is the corresponding invoice passing through the detection station 33. In the event that the document is a check, but does not include either of the fields 653, 654, different criteria may be devised to establish the orientation of such documents.

For example, assume that a check does not include a sequence number at 654. Such a document can be analyzed provided a count is made of the gap which extends between the leading edge of the document and the first detected marking group. This may be accomplished by retaining the data which is developed from the start of the count (responsive to the photodetection device 627) to the first encountered marking group. If it is determined that the lower gap counter exceeds the lower leading edge gap counter, the lower pulse counter exceeds twenty-three and the lower pulse counter exceeds the upper pulse counter, then the check has passed through the detection station 33 while upright and facing the read heads 609. If it is determined that the upper leading edge gap counter exceeds the upper gap counter, the upper pulse counter exceeds twenty-three and the upper pulse counter exceeds the lower pulse counter, then the check has passed through the detection station 33 while inverted and facing the read heads 609. If it is determined that the upper gap counter exceeds the upper leading edge gap counter, the upper pulse counter exceeds twenty-three and the upper pulse counter exceeds the lower pulse counter, then the check has passed through the detection station 33 while inverted and facing away from the read heads 609. Lastly, if it is determined that the upper leading edge gap counter exceeds the upper gap counter, the lower pulse counter exceeds twenty-three and the lower pulse counter exceeds the upper pulse counter, then the check has passed through the detection station 33 while upright and facing away from the read heads 609.

Other detection schemes (criteria) may be derived to determine the orientation of still other types of checks in similar fashion.

A circuit for providing the above-described functions may be developed by making use of the computer program disclosed in the microfiche appendix incorporated by reference, in a circuit comprised of the following components.

| | |
|---|---|
| Microprocessor 625 | 8751H |
| EPROM 629 | HN482764 |
| Peripheral Interface 630 | 8255A |

To correctly interface the foregoing elements, a latch (8282) operatively couples EPROM 629 and the data buss 628.

Based upon the decision made, microprocessor 625 produces a digitally encoded signal which indicates the orientation of the check which is passing through the detection fixture 600. This is used to selectively operate the reversal station 34 and the twisting station 35 to orient the check which has passed through the detection fixture 600. This is also used to selectively operate the various units which comprise the stacking station 39, as will be described more fully below.

REVERSAL STATION

Figures 39, 40:
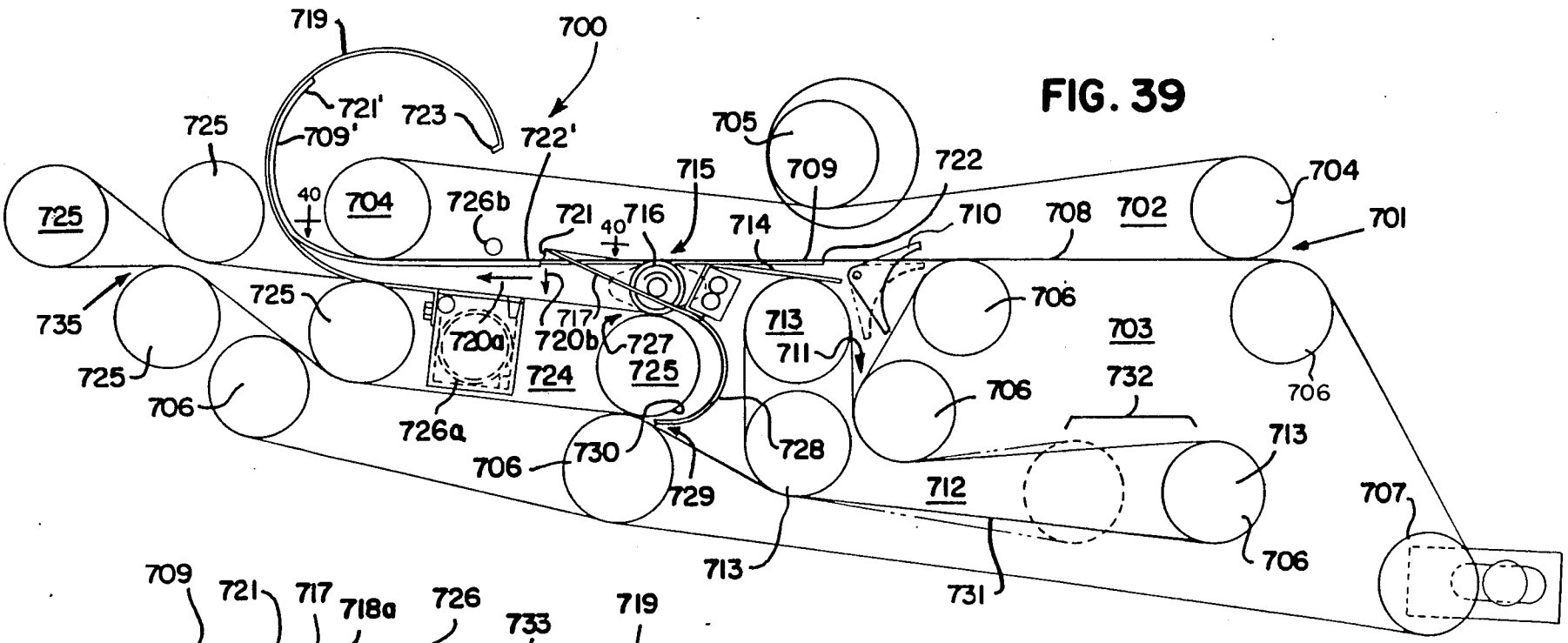
FIG. 39 is a top plan view of the reversal station of the apparatus.
FIG. 40 is a partial, side elevational view of portions of the reversal station, taken along line 40—40 of FIG. 39.

Referring to FIG. 39, documents are received within the reversal station 34 at a nip 701 which is defined between an opposing pair of belt systems 702, 703. Belt system 702 is defined by a pair of rollers 704, in combination with a tensioner 705. Belt system 703 is defined by a series of rollers 706, in combination with a tensioner 707. Documents entering the nip 701 will progress along the transport path 708 which is defined by the belt systems 702, 703, eventually encountering a deflector 710. When the deflector 710 is positioned as shown in solid lines in FIG. 39, the document will be deflected from the transport path 708 toward a nip 711 which is defined between the belt system 703 and yet another belt system 712 which is defined by a series of rollers 713. When the deflector 710 is positioned as shown in phantom in FIG. 39, the document is permitted to continue along the transport path 708, toward the reversal mechanism 700. A guide 714 is provided to prevent contact between a document being passed to the reversal 700 and the belt system 712.

With the assistance of the guide 714 and the belt system 702, a document to be reversed (schematically represented in FIG. 39, at 709) is introduced to a nip 715 which is developed between the belt system 702 and an idler roller 716. Referring to FIGS. 39 and 40, from the nip 715, the document 709 is passed to a blade 717 having fingers **718*a* which tend to corrugate (curl) the document being processed in a non-permanent fashion, and a flexible leaf 718*b* which cooperates with the belt system 702 to positively drive the curled document directly from the leaf 718*b* of the blade 717 to a curved guide 719, along a straight-line trajectory 720*a*, for reasons which will become apparent below. As the document is delivered from the nip 715 and across the blade 717, the leading edge 721' of the document 709' is received within the curved guide 719, progressing around the curved guide 719 until such time as the trailing edge 722' of the document passes the leaf 718*b*. Use of a curved guide 719 is preferred since the curvature of the guide has been found to provide progressive braking of the document 709' as it is received within the guide 719. A stop 723 is located at the end of the curved guide 719, so that the largest document to be processed can be fully received within the curved guide 719, but so that the documents being processed cannot be thrown from the curved guide 719** in the course of their processing.

After the trailing edge 722' of the document 709' has passed the leaf **718*b*, the trailing edge of the document being processed through the reversal mechanism is allowed to separate from the belt system 702, as shown by the arrow 720*b*, passing into contact with a belt system 724 which is defined by a series of rollers 725. Primarily, this results from the tendency of the document to straighten as it leaves the blade 717. However, this process is advantageously assisted with a vacuum supplied by a vacuum shoe 726*a* and/or compressed air supplied by an air jet 726*b*. To be noted is that the belt of the belt system 724 must pass through an aperture in the curved guide 719 in completing its defined transport path. To effectively receive the belt without developing a surface which could impede movement of the document along the curved guide 719 (during delivery of the document to the curved guide 719), a window 733 is provided having a tapered edge 734 which assists the edge of a document in traversing the window 733 by gradually guiding and returning the edge of the document to the plane of the curved guide 719**.

As the document is received against the belt system 724, the document is urged toward a nip 727 which is developed between the belt system 724 and the idler roller 716. Initially, the document is withdrawn from the curved guide 719 under the influence of the belt system 724, assisted by the vacuum supplied by the vacuum shoe **726*a*. Eventually, the document is positively withdrawn from the curved guide 719 by cooperation between the belt system 724 and the roller 716, at the nip 727. In any event, the document is ultimately caused to follow the belt system 724, with the assistance of a curved guide 728, with the trailing edge 722'** leading.

To be noted is that initially, a document to be processed through the reversal mechanism 700 was caused to depart from the blade 717 toward the curved guide 719 along a trajectory **720*a*. This is important to avoid contact between the leading edge 721 of the document and the belt of the belt system 724, which move in opposite directions. The temporary corrugation imparted to the document is used to reliably achieve such a transfer, even considering the vacuum which is being supplied by the vacuum shoe 726*a* and the compressed air which is being supplied by the air jet 726*b*. After the trailing edge 722 of the document passes the leaf 718*b*, the corrugation is dissipated so that the curl of the document will tend to assist in the positive transfer of the trailing edge 722 of the document to the belt system 724, together with the vacuum supplied by the vacuum shoe 726*a* and the compressed air supplied by the air jet 726*b*. Consequently, the vacuum provided by the vacuum shoe 726*a*, and the compressed air provided by the air jet 726*b*, are preferably adjusted so as to be sufficient to assist the trailing edge 722' in contacting the belt system 724, without promoting deflection of the leading edge 721 of the document from its desired trajectory 720*a***.

As a consequence of the foregoing, documents are delivered to a nip 729 which is defined between the belt systems 703, 724 from either of two transport paths 730, 731. Documents received from the transport path 730 will be reversed as a result of their having traversed the reversal mechanism 700. Documents received from the transport path 731 will be received in their original orientation. In either case, the received documents are then passed from the belt systems 703, 724, for eventual delivery from the output 735 of the reversal station 34.

To be noted is that a document will be somewhat delayed in traversing the transport path 730, as a consequence of the reversal procedure. A corresponding delay is therefore preferably introduced to the documents being delivered from the transport path 731, by means of an adjustable extension at 732, so that documents are received from the transport paths 730, 731 in general synchronization with their entry into the nip 701, rendering the reversal mechanism 700 essentially transparent to the documents being processed.

TWISTING STATION

Figure 41:
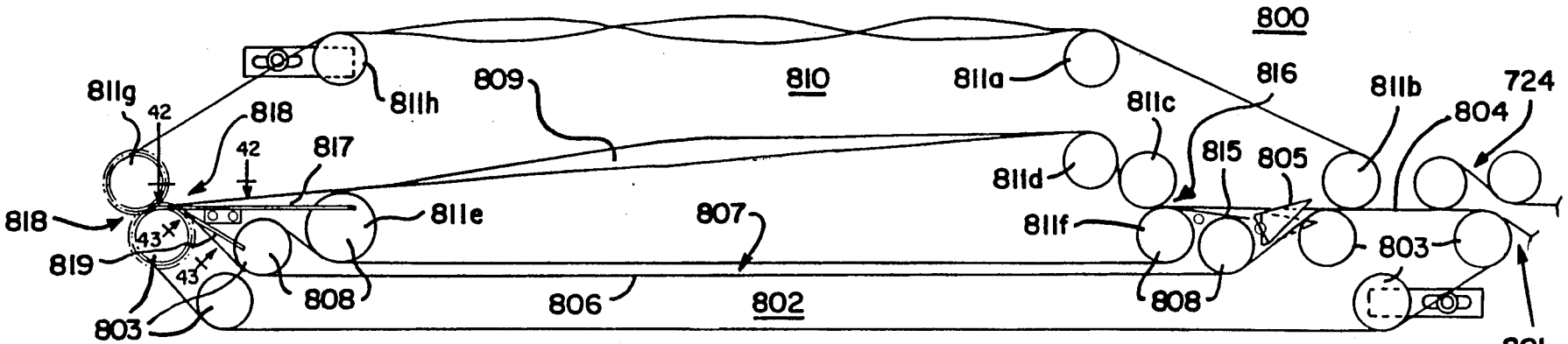
FIG. 41 is a top plan view of the twisting station of the apparatus.

Referring to FIG. 41, documents are received within the twisting station 35 at a nip 801 which is actually developed between the belt system 724 of the reversal station 34 and a belt system 802 associated with the twisting mechanism 800 and generally defined by a series of rollers 803. From the nip 801, documents are conveyed along a transport path 804, toward a deflector 805. When the deflector 805 assumes the position shown in solid lines in FIG. 41, documents are caused to progress along a transport path 806 which is defined between the belt system 802 and an opposing belt system 807 which is generally defined by a series of rollers 808, and which essentially by-passes the twisting mechanism 800. When the deflector 805 assumes the position shown in phantom in FIG. 41, documents are caused to progress along a transport path 809 which is configured to twist each document 180° about its longitudinal axis, as will be described more fully below. To be noted is that the lengths of the transport paths 806, 809 are approximately equal, so that the time required for a document to transverse the twisting mechanism 800 is approximately the same irrespective of whether or not a document is to undergo a twisting procedure.

Twisting of the documents is generally accomplished by entraining the documents between a pair of belts which are in contact with one another, and which undergo corresponding 180° transitions as they pass along the transport path 809. This function is developed by a belt system 810 which is configured to pass about a series of rollers 811. In the preferred embodiment, a single, continuous belt is used to develop the belt system 810. In operation, this belt progresses in a forward direction from a roller 811*a* toward a roller 811*b*, eventually encountering the rollers 811*c*, 811*d*. Upon leaving the roller 811*d*, the belt serves as the outboard belt for defining the transport path 809. Because of the 180° twist developed along the transport path 809, the belt is then caused to proceed around the roller 811*e*, subsequently traversing the roller 811*f* and again traversing the rollers 811*c*, 811*d*. Upon leaving the roller 811*d* for the second time, the belt now serves as the inboard belt for defining the other side of the transport path 809. Because of the 180° twist developed along the transport path 809, the belt is then caused to proceed around the rollers 811*g*, 811*h*, ultimately returning to the roller 811*a*. Suitable tensioning is provided by the roller 811*h* to achieve proper set-up. Also to be considered is that in traversing the various rollers 811*a*–811*h*, the continuous belt is caused to undergo two 180° transitions as the belt develops the opposing sides of the transport path 809. To avoid the need for an offset-type belt, the belt is caused to undergo three 180° twists as it progresses from the roller 811*h* to the roller 811*a*, to compensate for the twisting encountered along the transport path 809.

Figure 43:
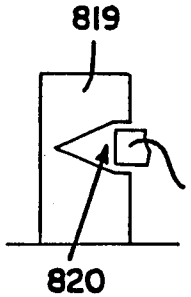
FIGS. 42 and 43 are partial, side elevational views of the twisting station, taken along lines 42—42 and 43—43 of FIG. 41, respectively.
Figure 42:
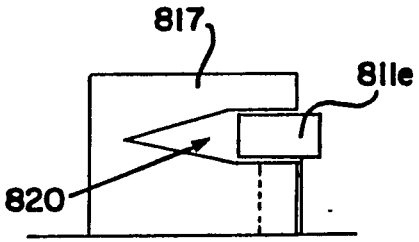

As a consequence of the foregoing construction, documents received at the nip 801 are gated by the deflector 805 so that the documents are either directed toward the by-pass path 806, or the twisted transport path 809. Documents which are to be processed through the twisted transport path 809 are received between a guide 815 and the belt system 810, eventually directing such documents into contact with a nip at 816. The received documents are then conveyed beyond the roller 811*d*, for twisting as they transverse the path 809 toward the roller 811*e*. A guide 817 is provided to direct the twisted documents from the roller 811*e* to a nip 818 which defines the output of the twisting mechanism 800, and to avoid contact with other of the operative rollers of the twisting mechanism 800. Documents which have not undergone a twisting operation are received between a guide 819, which is actually unitary with the guide 817, and the belt of the belt system 802, for delivery from the twisting mechanism 800 at the output nip 818. As shown in FIGS. 42 and 43, each of the guides 817, 819 are notched at 820, similarly to the notched aperture 733 of the curved guide 719 of the reversal mechanism 700, to avoid hanging up of the leading edge of a document at the notched apertures 820 which are needed to receive the rollers 811*e*, 811*f* of the belt system 810.

After leaving the twisting station 35, some of the documents will have been passed straight through the reversal station 34 (transport path 731) and the twisting station 35 (transport path 806). Still other documents will be subjected to a reversal within reversal station 34 (transport path 730) while passing straight through the twisting station 35 (transport path 806). Still other documents will be passed straight through the reversal station 34 (transport path 731) while being subjected to a twisting operation within twisting station 35 (transport path 809). Lastly, still other documents will be subjected to a reversal within reversal station 34 (transport path 730) and a twisting operation within twisting station 35 (transport path 809). By properly selecting between these various alternatives responsive to the decisions made by the detection station 33, it is possible for the documents being processed to be oriented as desired at the output 818 of the twisting station 35.

However, as a consequence of the operations which may be required for this to be accomplished, it is also possible for the re-oriented documents to be located at different positions with respect to the base of the processing unit 5, particularly regarding their height above the base of the processing unit 5. It is expected that skewing of the documents with respect to the base of the processing unit 5 will be kept to a minimum. However, when stacking the processed documents for subsequent removal from the processing apparatus 1, it is important for the stack which is ultimately formed to be uniformly placed against suitable reference surfaces, for ease of withdrawal and subsequent handling, as will be described more fully below. For this reason, documents exiting the twisting station 35 are subjected to a justification procedure within the justification station 37, prior to stacking. The justification station 37 is preferably identical in structure and operation to the justification station 32 so that the justification devices are modular, and essentially interchangable within the apparatus 1. Of course, if desired for a particular application, it is also possible to provide different justification units to satisfy special needs encountered at the different locations within the processing apparatus 1.

TURNABOUT SECTION

Upon delivery from the justification station 37, the documents will be oriented and in known order (either check or invoice leading), with the bottom edge of each document justified to the working surface of the processing unit 5. Consequently, the processed documents are ready for collection in the stacking station 39. However, so that the resulting stack (or stacks) of documents is appropriate for removal from the processing apparatus 1, and for subsequent processing, it is preferable for the documents to be stacked flat (horizontally) with their leading and lowermost edges justified to an appropriate reference. To place the documents in an appropriate orientation for delivery to the stacking station 39, the turnabout section 38 is provided to receive the generally vertically oriented documents from the orienting stations of the processing apparatus 1 and to redirect the received documents toward the stacking station 39 so that the output of the processing apparatus 1 is essentially coextensive with its input, and so that the documents are appropriately presented to the stacking station 39 for collection in the manner desired.

Figure 45:
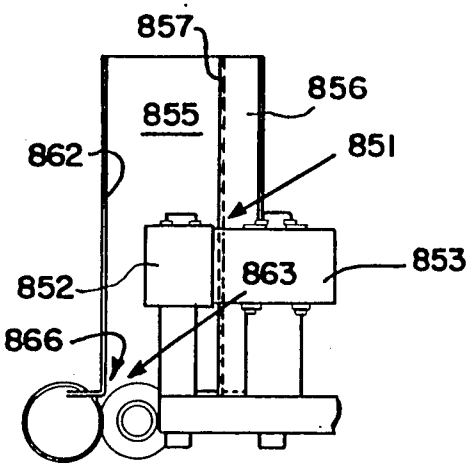
FIG. 45 is an end elevational view of the turnabout station.
Figure 46:
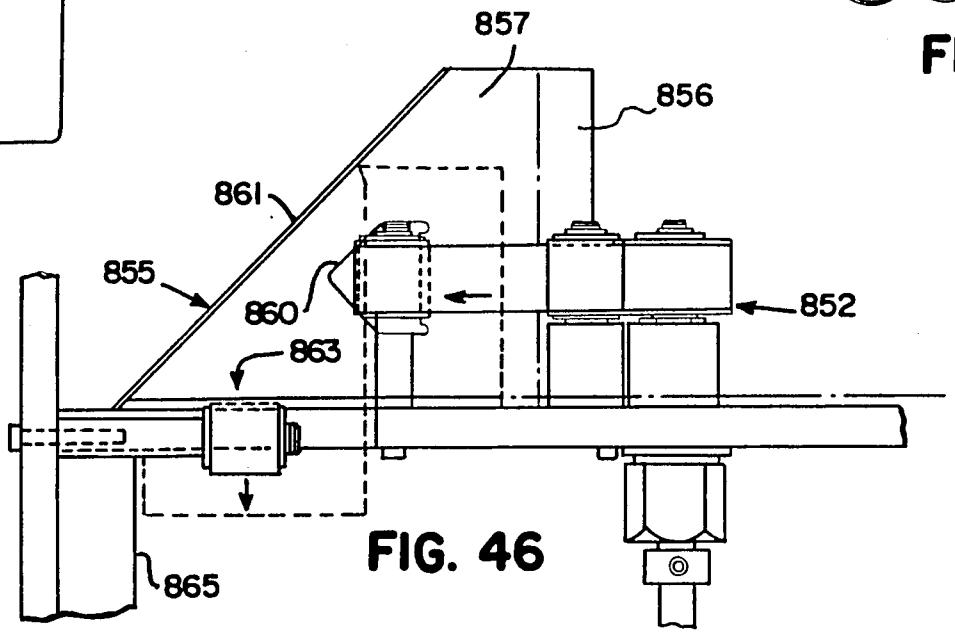
FIG. 46 is a partially sectioned, side elevational view of the turnabout station.
Figure 44:
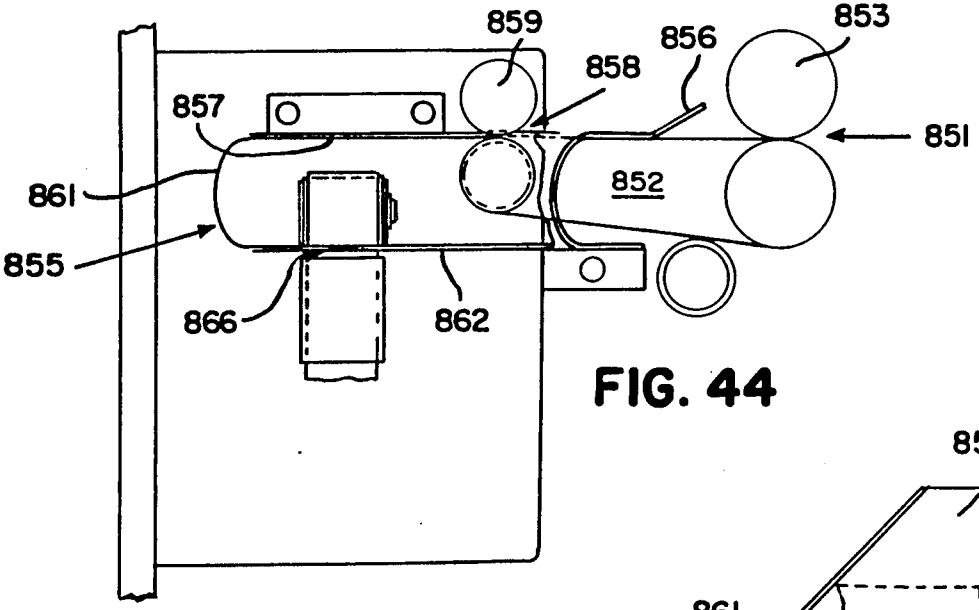
FIG. 44 is a top plan view of the turnabout station of the apparatus, with portions of the guide shoe removed to show construction detail.

To accomplish this, and with reference to FIGS. 44–46, documents discharged from the output of the justification station 37 are received within a nip 851 defined between a belt system 852 and an idler roller 853. From the nip 851, the received documents are delivered to a configured guide shoe 855 which serves to receive documents, and redirect the documents downwardly through the working surface of the processing unit 5. To this end, the received documents are passed between the belt of the belt system 852 and a guide 856 associated with the leading edge of the guide shoe 855, eventually encountering the face 857 of the guide shoe 855. After progressing along the face 857, the documents are received within yet another nip 858 developed between the belt system 852 and an idler roller 859, to positively drive the documents through the remainder of the guide shoe 855. A tapered aperture 860 is provided to receive the idler roller 859 without hanging up the documents being processed at their leading edges.

To be noted is that the belt system 852 causes the documents to be directed along the right most face 857 of the guide shoe 855, so that the documents will progress around the curved rear face 861 of the guide shoe 855, eventually encountering the left most face 862. The curved rear face 861 is preferably inclined at about 45° so that the documents are directed over and downwardly along the face 862 of the guide shoe 855 (as shown in phantom in FIG. 46), through an aperture 863 in the working surface of the processing unit 5. Further to be noted is that the documents are directed from the guide shoe 855 with the justified, bottom edge of each document facing rearwardly, toward a reference surface 865 which is in general alignment with the reference surface of the stacking station 39, as will be apparent from the description which follows.

Figure 47:
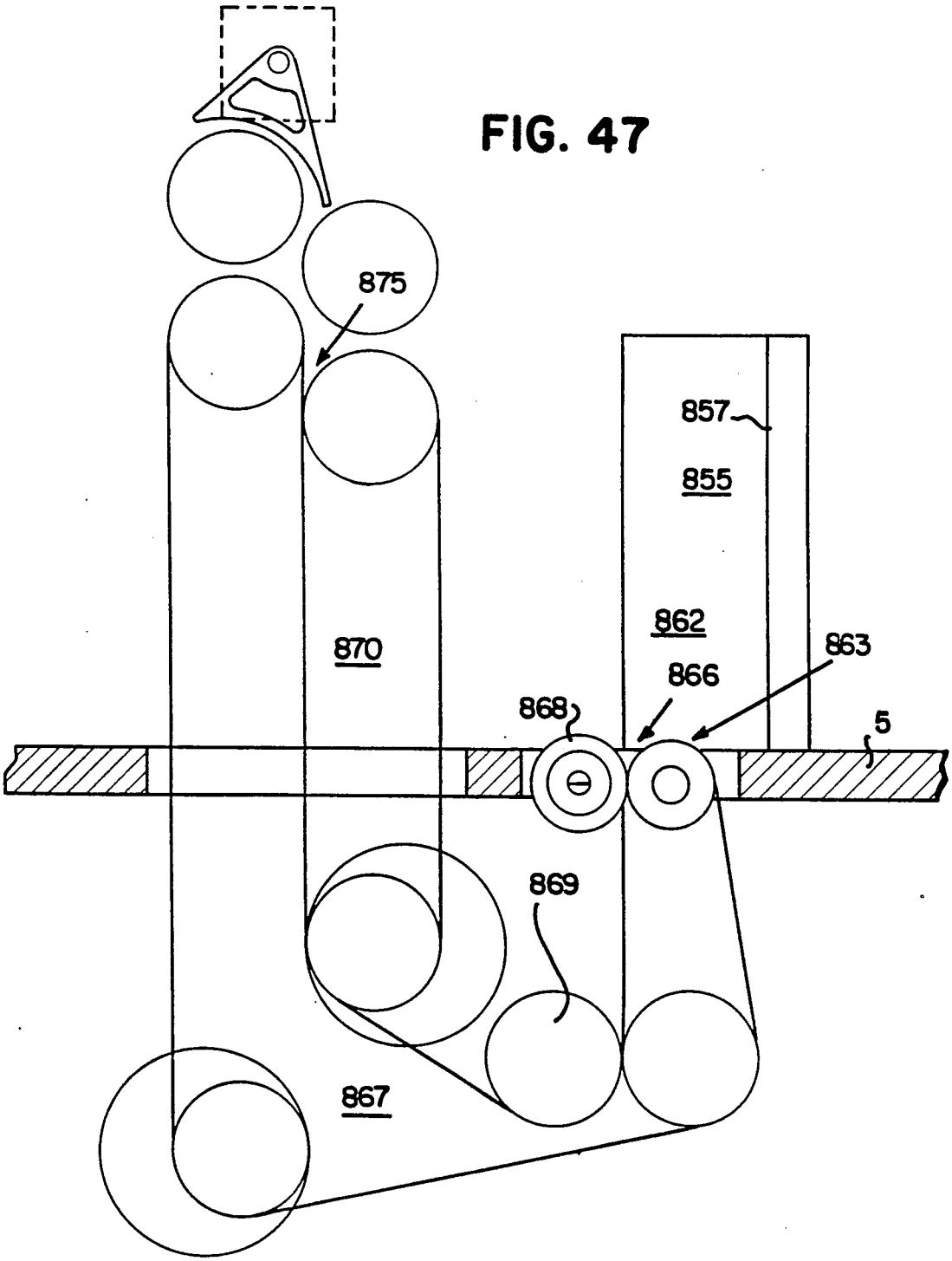
FIG. 47 is a side elevational view of the conveyor mechanism for the turnabout station.

Referring to FIG. 47, documents passed from the guide shoe 855 are received within a nip 866 which is defined between a belt system 867 and an idler roller 868, which serve to positively receive the downwardly directed documents. Belt system 867 generally serves to redirect the received documents upwardly, toward the stacking station 39. To assist in this transfer, an idler roller 869 is provided to drive the documents through a turnabout, and a belt system 870 is provided to drive the documents upwardly toward the stacking station, for discharge at the output 875.

In traversing the turnabout section 38, two factors are to be noted. First, when the documents are being directed through the guide shoe 855, contact between the documents being processed and the nips 858, 866 which drive the documents is limited. For this reason, it is preferred that the nips 858, 866 be maintained rather wide and tight so that significant frictional forces are applied to the documents as they proceed through the guide shoe 855, to hold the documents in proper position throughout the defined transition. Second, in passing a document from the nip 858 to the nip 866, the documents are oriented so that the justified, lower most edge of each document is aligned with the reference surface 865 of the turnabout section 38. Consequently, the documents are made ready for delivery to the stacking station 39 in an aligned fashion which permits justified stacking of the documents as described below.

STACKING STATION

Documents delivered from the output 875 of the turnabout section 38 are then ready for introduction to the stacking station 39, for ultimate collection. Due to the manner of operation of the turnabout section 38, the processed documents are delivered with their justified, bottom most edges facing inwardly, toward the reference surface 901 of the stacking device 900 so that the documents can be stacked with their justified, lower most edges in registration with the reference surface 901. Consequently, the documents will be neatly stacked, and appropriately positioned for removal by an operator.

The stacking device 900 is preferably comprised of a series of individual stacking units. This is preferred to provide the processing apparatus 1 with a sufficient capacity to accommodate the large volume of documents which is expected to be processed because of the automated operation of the apparatus. This also allows the processed documents to be selectively stacked, e.g., according to type, to enable further separation and/or organization of the documents being assembled for withdrawal by the operator, if desired for a particular operation. In the embodiment which is shown in the drawings, the stacking device 900 is separated into eight individual stacking units 902–909 which are disposed in two vertical groupings of four units each. Although this arrangement is preferred, other numbers of stacking units, and other arrangements for the stacking units provided, are capable of being developed as desired for a particular application.

Figure 48:
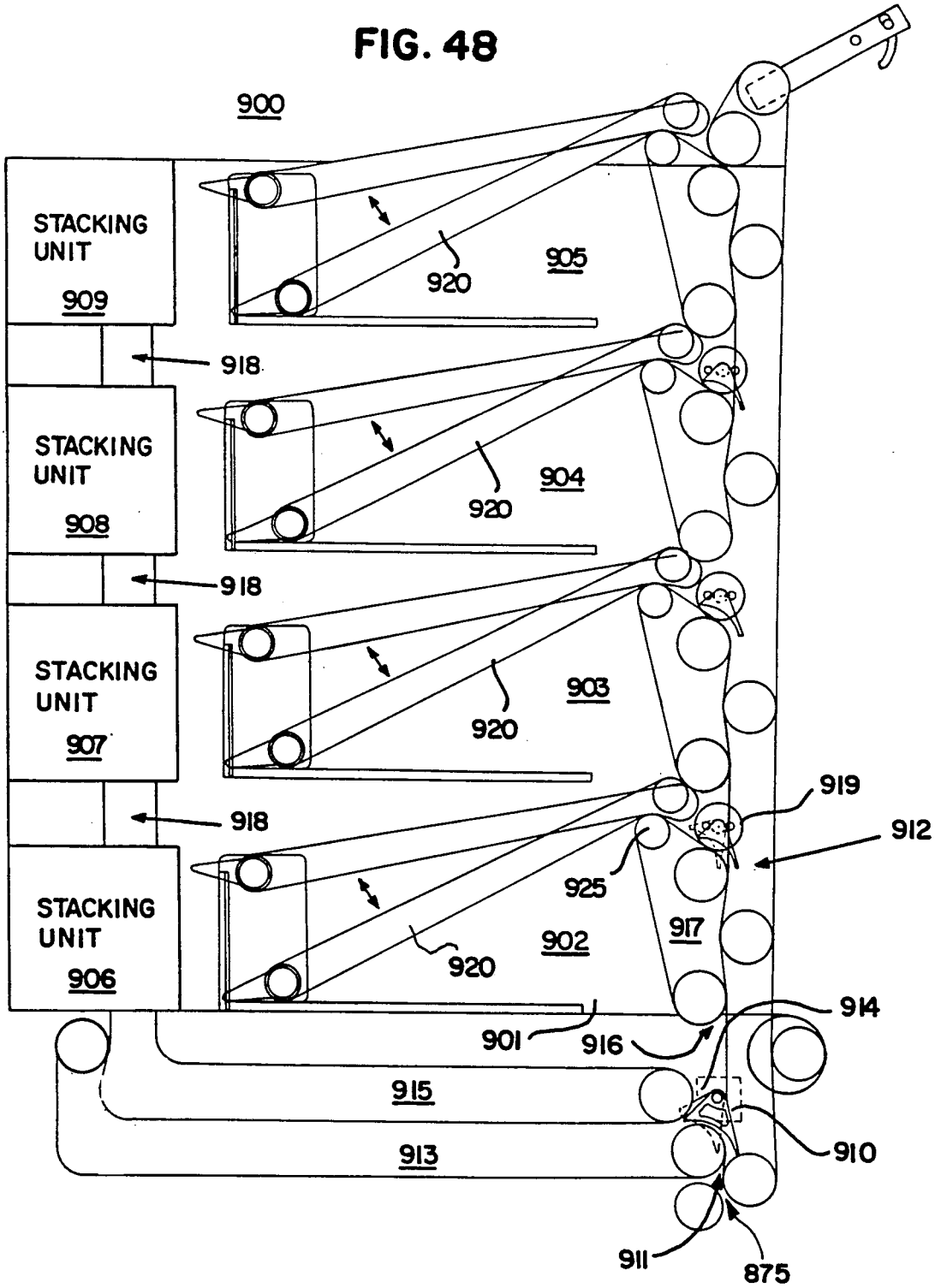
FIG. 48 is a partial, side elevational view of the stacking station of the apparatus.

As illustrated in FIG. 48, the stacking station 39 includes two groupings of stacking units 902–905 and 906–909, which are vertically arranged adjacent to one another. Selection between the stacking units 902–905 and the stacking units 906–909 is accomplished by a deflector 910 which is positioned just beyond a nip 911 defined between opposing belt systems 912, 913, and which serves to receive documents from the output 875 of the turnabout section 38. When the deflector 910 is positioned as shown in solid lines in FIG. 48, documents will be directed toward a nip 914 which is developed between the belt system 913 and an opposing belt system 915. The belt systems 913, 915 combine to direct a document, or series of documents, toward the series of stacking units 906–909. When the deflector 910 is positioned as shown in phantom in FIG. 48, documents will be directed toward a nip 916 which is developed between the belt system 912 and an opposing belt system 917. The belt systems 912, 917 combine to direct a document, or series of documents, toward the series of stacking units 902–905.

As previously indicated, the stacking device 900 is subdivided into two vertical groupings of stacking units 902–905 and 906–909. Responsive to operation of the deflector 910, documents are either delivered to the series of stacking units 902–905 by the opposing belt systems 912, 917, or to the series of stacking units 906–909 by the opposing belt systems 913, 915 (with the belt system 915 serving as the functional equivalent of the belt system 912, at 918), according to the desired stacking sequence. Since the overall operation of the series of stacking units 906–909 is the same as the overall operation of the series of stacking units 902–905, further description of the stacking station 39 will proceed assuming that a document (or series of documents) is to be delivered to the series of stacking units 902–905, it being understood that similar considerations would apply to a document (or series of documents) to be delivered to the series of stacking units 906–909.

Responsive to the deflector 910, the documents will be directed between the belt systems 912, 917, toward another deflector 919. In the event that the deflector 919 is positioned as shown in solid lines in FIG. 48, the documents will be directed toward the stacking unit 902, selecting the stacking unit 902 to receive documents. In the event that the deflector 919 is positioned as shown in phantom in FIG. 48, the documents will be directed toward one of the subsequent stacking units 903, 904, 905. In the latter case, deflectors similar to the deflector 919, and respectively associated with each of the stacking units 903, 904, will in turn serve to determine whether the documents being processed are to be passed to either of the stacking units 903, 904, or in default, to the stacking unit 905. Since the documents which are not deflected to one of the stacking units 902, 903, 904 will necessarily be received within the stacking unit 905, as the last stacking unit in the series, it is not necessary to provide a movable deflector in advance of the stacking unit 905. Rather, in connection with the stacking unit 905, the deflector is replaced by the termination of the belt system 912 to deflect the documents toward the stacking unit 905.

It shall now be assumed that the stacking unit 902 has been selected to receive documents. Consequently, the deflector 919 will be positioned to deflect documents from between the belt systems 912, 917 toward the stacking unit 902. For ease of construction, and to provide a certain degree of modularity, each of the stacking units 902–909 are preferably the same in terms of their basic construction. Consequently, while the following description addresses operation of the stacking unit 902, it is to be understood that the stacking units 903–909 are similar in construction.

Figure 49:
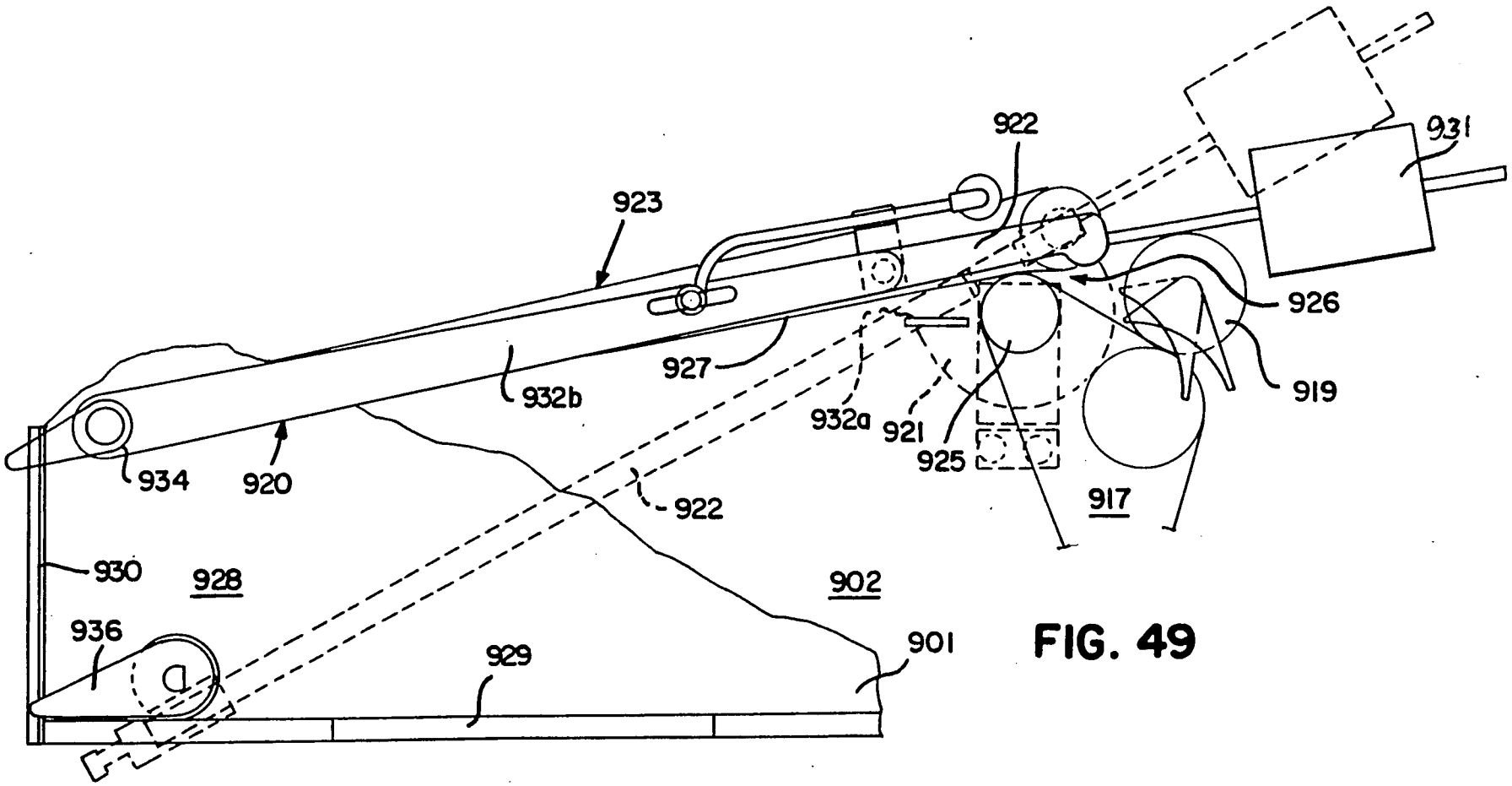
FIG. 49 is an enlarged, side elevational view of a stacking unit of the stacking station.
Figure 50:
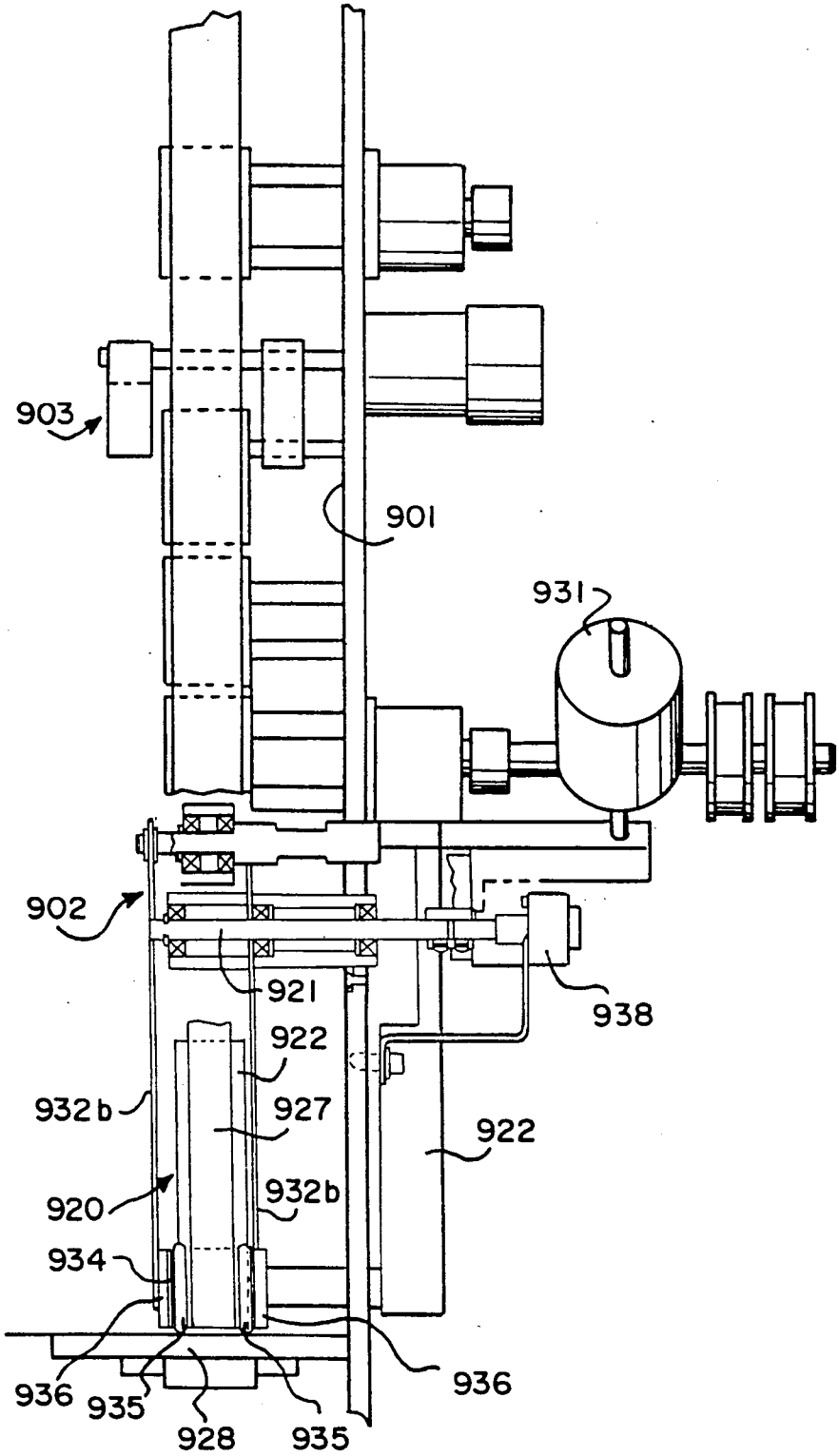
FIG. 50 is an end elevational view of the stacking unit.

Referring to FIGS. 49 and 50, documents deflected from between the belt systems 912, 917 will be directed toward a stacking arm 920 which is adapted for pivoted movement, at 921. Stacking arm 920 generally includes a frame 922 for receiving a belt system 923 which extends between opposite ends of the frame 922. By virtue of this construction, a deflected document is caused to progress along the belt of the belt system 917, ultimately passing over a roller 925 which is located at the apex of the belt system 917. At this juncture, the document is received in a floating nip 926 which is developed between the belt system 917 and the belt 927 of the pivoting belt system 923. This serves to, in essence, transfer the document to the belt system 923.

The stacking arm 920 pivots within a collection area 928 which is defined by the rearwardly positioned reference surface 901, a lower surface 929 and an edge stop 930. Thus, the documents which are conveyed along the belt system 923 are capable of being delivered to the lower surface 929, while justified to the reference surface 901, ultimately encountering the edge stop 930 under the influence of the belt system 923. As subsequent documents are received within the collection area 928, the stacking arm 920 is caused to rotate in a generally clockwise direction, to receive and stack subsequent documents upon the lower surface 929, in general registration with the edge stop 930 and the reference surface 901. Thus, the stacking arm 920 is a dynamic structure which is charged with the responsibility of stacking the documents discharged from the processing unit 5 in accordance with the operation of the deflectors 919. The stacking arm 920 is provided with a counterweight 931 to provide for the adjustment of this stacking function, by adjusting the normal forces applied against the collected stack of documents by the stacking arm 920.

The deflectors 919 may be operated responsive to a variety of regimens, depending upon the ultimate needs of the mail room operation. Generally, this will involve the filling of a first stacking unit (e.g., the stacking unit 902) until the unit has been filled, whereupon the documents to be stacked are directed to the next stacking unit in the series (e.g., the stacking unit 903). Alternatively, a first document (e.g., an invoice) may be directed to a first stacking unit (e.g., the stacking unit 902), while a second stacking unit (e.g., the stacking unit 903) is assigned with the task of receiving the accompanying document (e.g., a check). Other stacking units may be used to alternatingly receive invoices and checks, either serially or in parallel, as desired. Other combinations are clearly possible by varying the signals supplied to the several deflectors associated with the stacking units 902–909. In any event, the stacking station 39 serves to receive the documents delivered from the processed envelopes, for ultimate removal by an operator. To enhance the operation of the stacking units 902–909 of the stacking station 39, the stacking arm 920 is preferably provided with various structures for improving the reliability of its operation, as follows.

Although the belt system 923 of the stacking arm 920 can in and of itself serve to deliver documents from the nip 926 to the collection area 928, the stacking arm 920 is preferably provided with various means for assuring that this transfer takes place, even in the event that the belt system 923 picks up a static charge which would otherwise prevent the documents from freely dropping from the belt system 923 to the collection area 928. For example, a corrugating element **932*a* having corrugating fingers similar to the corrugating fingers 718*a* of the blade 717 used in the reversal mechanism 700 is preferably attached to the frame 922 of the stacking arm 920, so that it spans the belt 927. This serves to corrugate the documents as they progress along the belt system 923, for positive transfer to the collection area 928. A pair of edge guides 932*b* are preferably provided on either side of the belt system 923, to make sure that the documents are reliably separated from the stacking arm 920. The edge guides 932*b* each preferably bow outwardly as best shown in FIG. 49, to essentially peel the document from the belt system 923 as the document proceeds to the collection area 928. Lastly, an air-jet 933 is advantageously placed between the edge guides 932*b* of the stacking arm 920**, for similar reasons.

Steps may also be taken to make sure that the documents which are discharged from the stacking arm 920 are squarely received within the collection area 928, so that each document is justified against the various reference surfaces 901, 929, 930. To this end, the roller 934 of the belt system 923 which is spaced farthest from the pivot 921 is preferably provided with one or more friction belts 935, which serve to frictionally engage and urge the documents toward the edge stop 930. The remote end of the stacking arm 920 is additionally preferably provided with one or more paper guides 936 to resist buckling of the documents as they are pushed into the edge stop 930. The counterweight 931 may be used to regulate the amount of pressure which is applied against the documents by the friction belts 935, to avoid jamming or crumpling of the documents within the collection area 928.

Lastly, operatively associated with the pivot 921 which receives the stacking arm 920 is a monitoring device which is capable of providing a signal which indicates the status conditions within the collection area 928. This monitoring device preferably takes the form of a potentiometer 938 which is attached to the pivot 921, and which is capable of providing a signal (change in resistance) which varies according to the pivotal displacement of the stacking arm 920.

The potentiometers 938 for the several stacking units 902–909 are coupled to a circuit 940, as shown in FIG. 51, which measures changes in voltage resulting from changes in resistance measured responsive to pivoting of the stacking arm 920. Changes in resistance measured by the several potentiometers 938 associated with the stacking units 902–909 are respectively detected by a series of wave shaping circuits 941 which serve to filter and scale the resulting signals for presentation to an analog-to-digital converter 942. The resulting digital signals are in turn provided to a peripheral interface 943 which serves to communicate with the remainder of the processing apparatus 1 to indicate when the several stacking units 902–909 have been filled, to cause the selection of another stacking unit responsive to such indications, and to indicate jams by sensing relatively large changes in voltage (displacement) resulting from a document having become crumpled within the collection area 928 of a particular stacking unit 902–909. Such functions may be provided by making use of the computer program which is disclosed in the microfiche appendix incorporated by reference, in a circuit comprised of the following components.

| | |
|---|---|
| A/D Converter 942 | AD7828KN |
| Peripheral Interface 943 | 8255A |

To provide the operator with a visual indication of the status of the various stacking units 902–909, appropriate indicators such as light emitting diodes may be provided adjacent to each of the several stacking units, if desired. If so, these displays may be operated directly from the peripheral interface 943, at 944, provided appropriate drivers (N7416N) are used to operatively connect the displays with the peripheral interface 943.

CENTRAL CONTROL SYSTEMS

The above-described apparatus provides all of the various functions necessary to extract contents (documents) from envelopes, orient the resulting documents, and deliver the oriented documents to appropriate stacking units for collection. However, in order to effectively operate the processing apparatus 1 on a continuous basis and in automated fashion, suitable means are needed to interactively control the various stations comprising the processing apparatus 1 to effectively operate the various stations as a cohesive unit.

For example, a number of discrete motors are provided to operate the various rollers and belt systems previously described. In some cases, one or more motors will serve to operate a particular station, while in other cases, a single motor will serve to operate plural stations. In any event, suitable means are needed to control the motors which operate these rollers and belt systems to effectively process envelopes and documents within the several stations of the apparatus, as well as to correctly interface the various stations with one another. A circuit for providing these functions may be developed by making use of the computer program disclosed in the microfiche appendix incorporated by reference, in the circuit which is illustrated in FIG. 52. Essentially, the motor control circuit 945 is comprised of a peripheral interface 946 (8255A) which is capable of providing control signals to the various motors which comprise the processing apparatus 1, via bus 947, and of communicating with the remainder of the processing apparatus 1.

Yet another overall control function relates to the manner in which the processing apparatus 1 is operated in the event that an envelope or document is improperly processed through one of the several stations of the processing apparatus 1; a so-called "jam" condition. To monitor and effectively deal with such jam conditions, a jam control circuit 950 is provided. The primary functions of the jam control circuit 950 include the detection of paper jams (envelope or document), and the management of the various paper paths which are developed throughout the processing apparatus 1 in the event that a jam is encountered, to minimize the extent of the jam and to minimize the amount of time required for an operator to clear the processing apparatus 1 for continued operation.

To accomplish these functions, the jam control circuit 950 operates to track the progress of the various objects (envelopes, envelope faces, or documents) which are simultaneously passing through the several stations of the processing apparatus 1. The status of these objects within the processing apparatus 1 is monitored by means of sensors provided along the various transport (paper) paths developed throughout the apparatus 1, which serve to detect passage of the leading and/or trailing edges of the objects as they pass through the processing apparatus 1. The resulting information is then analyzed, primarily to determine whether or not a given object being processed through the apparatus 1 has arrived at, or has departed from a given sensor within a specified time period. So long as the objects reach or depart from their designated positions within the specified time periods, operation of the apparatus proceeds in normal fashion. If an object is late in departing from a given sensor, or in reaching the next sensor in the series, a jam condition is declared.

In such cases, the jam control circuit 950 operates to locate the declared jam, to determine the condition of the various deflectors which are provided throughout the apparatus for routing purposes, and to provide control signals which are used to effectively manage the jam. Such management includes interrupting the feeding of further envelopes to the processing unit 5, diverting objects upstream from the location of the jam into appropriate holding areas, shutting down the portion of the apparatus where the jam has occurred, and allowing all downstream objects to complete their normal processing. This serves to identify the location of the jam, which must then be cleared by the operator, while minimizing the effect which the jam has on the various other objects which are being processed through the apparatus 1.

Tracking of the various objects which are passing through the processing apparatus 1 is generally accomplished by developing a listing of paper edges (both leading and trailing) which are passing from sensor to sensor. Each paper edge is assigned a counter which provides an indication of the amount of time which should be taken for that edge to arrive at (or depart from) its next appointed location. A station model is created in software for each of the various sensors provided, and for each of the deflectors associated with the processing apparatus 1. The station models are provided with a list of paper edges which are to pass the modelled sensors or deflectors. Gated portions of the various paper paths are monitored to advise the jam control circuit 950 of the direction that a particular object will take as it passes through the processing apparatus 1, so that the various station models may be advised of the anticipated timing (routing) for the various listed edges which are assigned to it.

For each of the paper edges developed, the associated counter is provided with an indication of the time period which it should take for the paper edge to pass the modelled station, plus a margin for possible slippage or other machine idiosyncracies. Failure of the paper edge to reach its assigned position before expiration of the associated counter signifies a jam within the modelled station, calling for appropriate management of the detected jam.

While the majority of the monitoring procedure used to detect jam conditions proceeds in this fashion, certain portions of the processing apparatus 1 require special attention since they are not appropriately monitored in this fashion. For example, there can be no assumed time for a leading edge of an envelope to proceed from the input station 25, since this is the first time that the object enters the perview of the jam control circuit 950. Consequently, at this interface, passage of the leading edge of the envelope is used to initialize the system by creating a leading edge and a trailing edge for subsequent monitoring purposes. Preferably associated with this assignment procedure is a count of the timing between the actual leading edge and the modelled trailing edge, for the longest envelope which is to be processed through the apparatus 1. If the established count expires before the trailing edge of the envelope passes the corresponding sensor, it can be assumed that there is a jam in the input station 25.

Another special case involves the extraction station 29. Monitoring of the passage of objects through the extraction station 29 is complicated by the fact that what was previously a single object is converted into a plurality of objects which may proceed along any of a number of valid combinations of paper paths as they proceed through the extraction station 29. Thus, special steps must be taken to monitor the passage of objects through the extraction station, beyond the sensing of leading and trailing edges.

For example, as the edge-severed envelope traverses the containment 401, steps must be taken to re-define the object, converting a single object into two separate objects which proceed in parallel. Thus, after separation within the containment 401, identical copies of the original object are created, and appropriate counters are established. If either object later fails to reach its assigned location, a jam is declared.

From the containment 401, the duplicated objects are then passed to the separation devices 420, 421, for friction separation. Because of the manner in which documents are randomly positioned against the severed faces of the envelope, a document may or may not be pulled from the severed envelope faces as these items are delivered to the thickness measuring devices 446, 447, 448. Appropriate logic must therefore be provided which is capable of ignoring "missing objects" along optional transport paths, while making sure that the various objects which are being processed through the extraction station 29 continue to proceed through its various structures. Thus, provisions must be made to essentially disable an optional paper path which does not contain an object, while making sure to actively monitor an optional paper path once it has been determined that an object has entered that paper path. Provisions must also be made to monitor selected groupings of paper paths to make sure that a particular object passes along one of the available paper paths, and is not ignored by all available paper path models. If an object fails to traverse a designated paper path, or one of the several available paper paths in an assigned grouping, a jam is declared.

Also to be considered is that after the documents have been separated from the envelope faces, the expected result will be three objects passing along the transport paths 456, 457, 458. Suitable steps must therefore be taken to either modify, or create leading and trailing edge models for monitoring along the several transport paths, and through the reuniter unit 460. Steps must also be taken to delete created leading and trailing edges for re-united envelopes which have been diverted from further processing, to provide a real indication of their final status.

Lastly, special attention is required within the separation station 31. The purpose of the separation station 31 is to singulate parallel documents received from the extraction station 29. Consequently, it is expected that for the purposes of jam management, a single object (paired documents) will enter the singulation unit 500, while two objects (serial documents) will leave the singulation unit 500. In the interim, the distance between the leading and trailing edges of the single object entering the singulation unit will be extended as the paired documents are subjected to separation. Steps must therefore be taken to accordingly adjust the listings for the object edges being passed through and from the separation station 31.

For example, as a single object (paired documents) entering the singulation unit 500 commences separation, the length of the single object adjacent to the drums 508, 509 will appear to extend. Steps must therefore be taken to make sure that this event does not cause the false indication of a jam. An expired counter at this point is therefore ignored. Also to be considered is that care must be taken to monitor the singulation process, to modify the leading and trailing edge models according to the actual results of separation. Thus, as a first document leaves the singulation unit 500, steps are taken to see if a second document remains behind, between the drums 508, 509. If so, two documents are defined from the original model. If not, only a single model is maintained to provide a real indication of output. Steps must also be taken to account for the increased feed rates encountered through the accelerator unit 540, which will affect subsequent timing periods.

Consideration must also be given to the fact that within the separation station 31, as well as within the separation devices 420, 421 of the extraction station 29, the intended purpose is to intentionally delay one or more documents with respect to another document.

Special consideration must therefore be given to the time periods which are established within these sections of the apparatus, to account for these intentionally introduced delays in correlating the results obtained in monitoring objects passing along separate yet related paper paths. Also to be considered is that within the separation station 31, as well as in passing an object from the input station 25 to the scanning station 26, a gap is intentionally introduced between the objects being processed. Special consideration must therefore be given to these gaps, to make sure that appropriate gaps are developed without creating excessive spaces between successive objects.

The jam control circuit 950 operates to monitor these various conditions, until such time as a jam is declared. At that time, the jam control circuit 950 operates to discontinue the feeding of envelopes to the processing unit 5, and to clear the jam in the most effective way. To this end, the software model operates to monitor the status of the various objects upstream and downstream from the location of the detected jam. This information is checked to determine if any objects lie across (or too close to) a particular deflector, which would preclude operation of the deflector and in essence cause another jam. A decision is then made as to where to direct the various objects along the paper path, and when it is safe to activate the deflectors which are necessary to divert upstream paper flow from the jammed unit, and to isolate the jammed unit. Once the jammed unit has been isolated, it is shut down for manual clearing. The remainder of the processing apparatus 1 is permitted to function in its normal mode as downstream documents are cleared from the apparatus. These various functions are enabled by operatively connecting the motors which operate the various stations of the processing apparatus 1 with appropriate clutches which permit the stations of the apparatus to be selectively and independently enabled (run) or disabled (stopped) responsive to signals received from the jam control circuit 950, as will be described below. Documents upstream from the jam are capable of being cleared to the reject trays 6, 7 associated with the sorting station 27, the collector 387 associated with the edge-severing station 28, the stacking unit 12 associated with the extraction station 29, and a pair of collectors 951, 952 which respectively follow the detection station 33 and the twisting station 35 (see FIG. 2). Documents downstream from the jam are delivered to the stacking station 39, in normal fashion.

Figure 53:
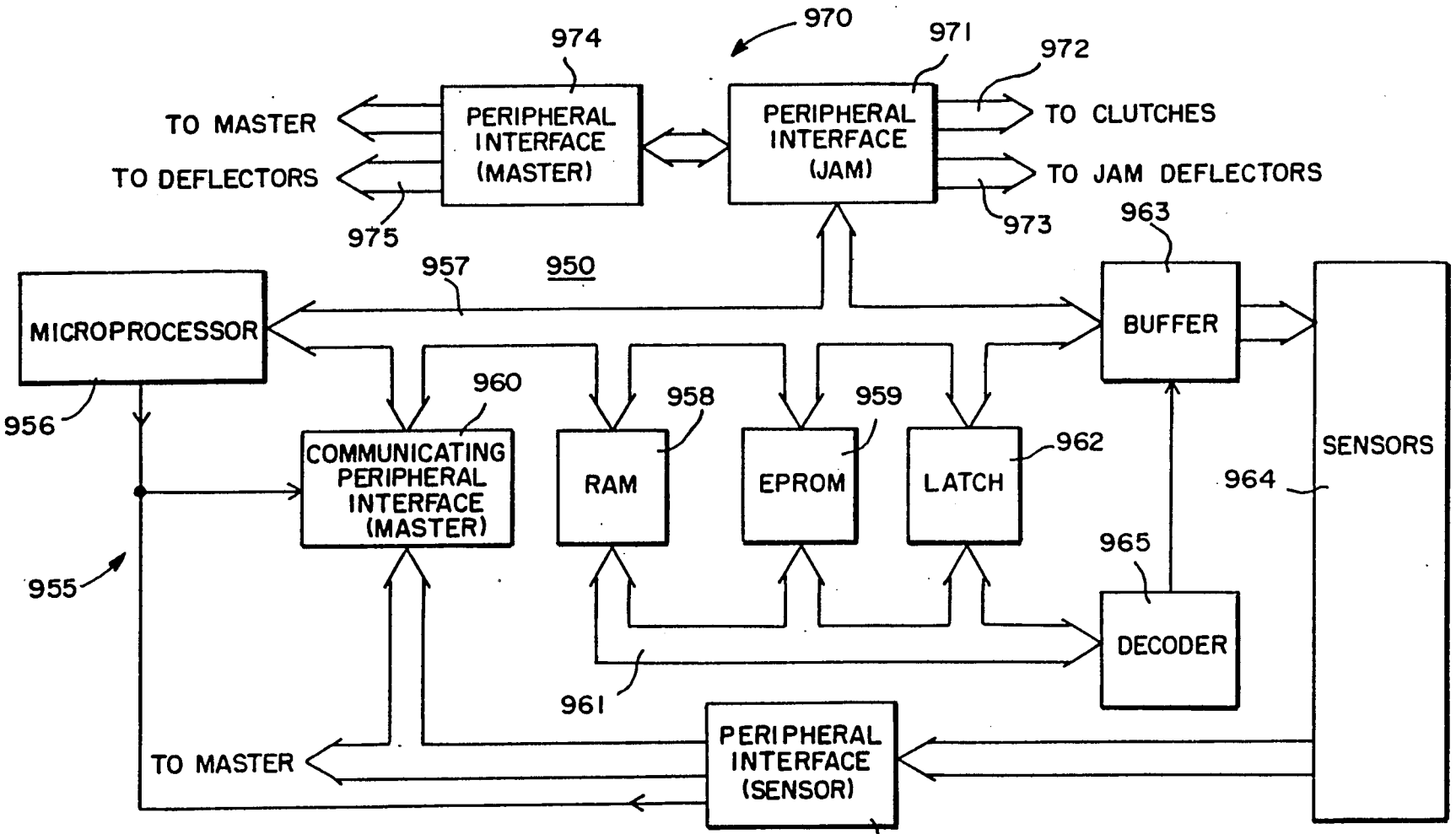
FIG. 53 is a schematic diagram showing a circuit for receiving and processing signals from the apparatus, to detect and manage jams within the system.

A jam control circuit 950 which is capable of making the decisions previously described, and of controlling the various portions of the processing apparatus 1 to carry out these decisions in the most efficient manner, is shown in FIG. 53. Essentially, the circuit 950 includes two sections; a first section 955 for receiving and processing signals from the various sensors distributed throughout the processing apparatus 1, and a second section 970 for carrying out the steps necessary to handle the jam in accordance with the information received from the sensors.

The sensor monitoring section 955 of the jam control circuit 950 is regulated by a microprocessor 956 which operatively communicates via common buss 957 with temporary storage in RAM 958 and programming in EPROM 959, as well as a communicating peripheral interface 960. RAM 958 and EPROM 959 additionally communicate via control buss 961, which is additionally coupled to common buss 957 by a latch 962. Common buss 957 provides operative signals to a buffer 963 which communicates with the series of sensors associated with the processing apparatus 1 (generally represented at 964), in accordance with signals received from control buss 961 via decoder 965. Signals received from the sensors 964 are delivered to a dedicated peripheral interface 966, which is additionally coupled to the communicating peripheral interface 960. Accordingly, the sensor monitoring section 955 operates to poll the various sensors 964 associated with the processing apparatus 1, and to receive data in accordance with the passage of leading and trailing edges across the sensors. To be noted here is that any of a number of sensors may be placed at any of a number of different locations throughout the processing apparatus 1, in accordance with the various paper paths developed within the apparatus, and the detail of the information which is required to effectively monitor the passage of objects through the apparatus.

This information is then interpreted by the jam control section 970. To this end, a dedicated peripheral interface 971 for interpreting jam conditions communicates with common buss 957 to receive data from the sensor monitoring section 955. Peripheral interface 971 makes use of the information received to control the various clutches 972 and deflectors 973 which are used to divert objects from the normal paper handling path toward the various temporary storage devices which are used to clear the apparatus in the event of a jam (reject trays 6, 7, collectors 387, 951, 952, and stacking unit 12), and to shut down desired portions of the processing apparatus 1. Peripheral interface 971 additionally communicates with a communicating peripheral interface 974, which in turn communicates with the remaining deflectors 975 in the system to direct objects through the various stations and toward the means which are provided to receive the objects which are being cleared from the jam, as well as to communicate with the remainder of the processing apparatus 1.

A circuit for providing the above-described functions may be developed by making use of the computer program disclosed in the microfiche appendix incorporated by reference, in a circuit comprised of the following components.

| | |
|---|---|
| Microprocessor 956 | 8751H |
| RAM 958 | HM6116 P-3 |
| EPROM 959 | HN482764 |
| Peripheral Interfaces (960, 966, 971, 974) | 8255A |
| Latch 962 | 8282 |
| Buffer 963 | 74LS244 |
| Decoder 965 | P3205 |

To be noted is that the various communications developed within the jam control circuit 950 are preferably full duplex and totally asynchronous so that the various processors can send data to one another with no constraints (so long as the transmission does not overwrite data which had previously been sent but not yet received).

To oversee all of the operations previously described, the processing apparatus 1 includes a master controller 980, as shown in FIG. 54. Master controller 980 generally comprises a microprocessor 981 which communicates with the central processing unit 15, which serves as a host, via interface 982. Microprocessor 981 additionally communicates with temporary storage in RAM 983 and programming in EPROM 984, as well as a communicating peripheral interface 985, via common buss 986. RAM 983 and EPROM 984 additionally communicate with one another via control buss 987, which is operatively coupled to common buss 986 by a latch 988. Common buss 986 serves to provide data communications with each of the communicating peripheral interfaces previously described. Common buss 987 operates through a decoder 989 to address (control) the various microprocessors, communicating peripheral interfaces and analog-to-digital converters of the various circuits previously described. Peripheral interface 985 operates the signal interrupt means associated with the various microprocessors, communicating peripheral interfaces and analog-to-digital converters of the various circuits previously described, to selectively activate and deactivate such circuits as needed. The foregoing circuit may be used to provide overall control of the processing apparatus 1 by making use of the computer program disclosed in the microfiche appendix incorporated by reference, in a circuit comprised of the following components.

| | |
|---|---|
| Microprocessor 981 | 8751H |
| Host Interface 982 | MAX232 |
| Host 15 | IBM 5531 |
| RAM 933 | HM6116 P-3 |
| EPROM 984 | HN482764 |
| Peripheral Interface 985 | 8255A |
| Latch 988 | 8282 |
| Decoder 989 | P3205 |

The computer programs for microprocessor 981 and host computer 15, as disclosed in the microfiche appendix incorporated by reference, provide all of the functions necessary to monitor and regulate operation of the processing apparatus 1 to provide for the continuous and automated extraction of contents from envelopes supplied to the input conveyor 4, for collection at the stacking unit 12. Generally, this is accomplished making use of the leading and trailing edge models described in connection with the jam control circuit 950. As envelopes are received within the processing unit 5, each envelope is inventoried by an appropriate model. These models are then amended as the envelopes are processed through the apparatus, to account for changes in status of the envelopes, and eventually their component parts (i.e., envelope faces and contents), and to record the results of the tests performed on the envelopes and/or their contents as such time pass through the processing unit 5. Each model is then capable of being consulted by the several stations of the apparatus, to handle the associated envelope and/or document according to its current status.

Additionally provided are the functions necessary to correctly interface with the operator stationed at the processing apparatus 1 (at the operator position 14). For example, displays are provided to keep the operator advised of the status of the processing apparatus 1 (operations, operating conditions, statistics, warnings, jams, etc.), as are appropriate displays for setting up the apparatus for desired operations (job parameters), as well as changing the desired settings. Also provided are a number of diagnostic functions which enable various portions of the apparatus to be tested either by means of simulation, or by directing envelopes (either live or test mail) through the apparatus, and monitoring the resulting operating conditions. Thus, the processing apparatus 1 is made fully interactive with the operator, enabling simplified control of the apparatus from a common location.

It will be understood that various changes in the details, materials and arrangement of parts which have been herein described and illustrated in order to explain the nature of this invention may be made by those skilled in the art within the principle and scope of the invention as expressed in the following claims.

What is claimed is:

1. An apparatus for severing envelope edges in continuous fashion, comprising:

a plurality of means for severing an envelope edge; and means for conveying envelopes past said plurality of severing means, and for rotating said envelopes to present envelope edges to said plurality of severing means in an orientation which permits edge-severing of each presented envelope edge.

2. The apparatus of claim 1 wherein said severing means cuts the edge of said envelope.

3. The apparatus of claim 2 wherein said severing means includes a reference surface for receiving said edge to be severed, means for urging said envelope edge into contact with said reference surface, and a pair of opposed cutting wheels for severing said envelope edge.

4. The apparatus of claim 3 wherein said reference surface is adjustable with respect to said cutting wheels.

5. The apparatus of claim 3 wherein said severing means includes nip forming rollers for retaining said envelope edge in position during said severing.

6. The apparatus of claim 5 wherein said severing means operates irrespective of orientation.

7. The apparatus of claim 3 wherein said severing means includes means for directing slivers severed from said envelope edges away from said envelope.

8. The apparatus of claim 7 wherein said slivers are received within means for subdividing said slivers into smaller portions.

9. The apparatus of claim 8 wherein said subdividing means includes a first pair of rollers defining a nip for receiving said slivers from said severing means, a second pair of rollers defining a nip for receiving said slivers from the nip of said first rollers, and means for rotating said second pair of rollers at a rate which exceeds the rate of rotation of said first pair of rollers, thereby tearing said slivers from the nip of said first pair of rollers.

10. The apparatus of claim 1 wherein said severing apparatus severs three adjacent envelope edges.

11. The apparatus of claim 10 wherein said three edges include the top, bottom and leading side edges of said envelope.

12. The apparatus of claim 11 wherein said envelopes are received by means for placing the leading side edges of said envelopes in position for severing within a first severing means.

13. The apparatus of claim 12 wherein said envelopes are rotated into said position by a first nip forming pair of rollers spaced from and in general alignment with a remotely spaced pivot point.

14. The apparatus of claim 13 wherein a second nip forming pair of rollers are spaced from and in general alignment with said first pair of rollers.

15. The apparatus of claim 14 wherein said second pair of rollers are operated through a one-way clutch capable of overrunning only in the forward direction.

16. The apparatus of claim 12 wherein the envelopes delivered from said first severing means are received by means for placing the top edges of said envelopes in position for severing within a second severing means.

17. The apparatus of claim 16 wherein said envelopes are rotated into said position by a first nip forming pair of rollers spaced from and in general alignment with a remotely spaced pivot point.

18. The apparatus of claim 17 wherein a second pair of nip forming rollers are positioned ahead of said first pair of rollers, to assist envelopes in passing to said first pair of rollers.

19. The apparatus of claim 18 wherein said second pair of rollers are adapted to slidingly receive said envelopes.

20. The apparatus of claim 16 wherein said second severing means is inverted from said first severing means.

21. The apparatus of claim 16 wherein the envelopes delivered from said second severing means are received by means for placing the bottom edges of said envelopes in position for severing within a third severing means.

22. The apparatus of claim 21 wherein said envelopes are lowered into said position by a first nip forming pair of rollers disposed at a generally downward angle extending toward said third severing means.

23. The apparatus of claim 22 wherein a second pair of nip forming rollers are positioned ahead of said first pair of rollers, to assist envelopes in passing to said first pair of rollers.

24. The apparatus of claim 22 wherein said second severing means and said third severing means are separated by means for slidingly engaging said envelopes as said envelopes are lowered to said third severing means.

25. The apparatus of claim 21 wherein said third severing means is inverted from said second severing means.

26. The apparatus of claim 1 wherein said conveying means operates to convey said envelopes in a generally upright orientation.

27. The apparatus of claim 1 wherein said conveying means operates to rotate said envelopes about an axis generally perpendicular to faces of the envelopes.

28. The apparatus of claim 27 wherein said conveying means operates to rotate said envelopes through an angle of about 90 degrees.

29. The apparatus of claim 1 wherein said envelopes are rotated by means for engaging said envelopes, spaced from and in general alignment with a remotely spaced pivot point.

* * * * *